US010002565B2

(12) United States Patent
Kikuchi et al.

(10) Patent No.: US 10,002,565 B2
(45) Date of Patent: Jun. 19, 2018

(54) DISPLAY UNIT, METHOD OF DRIVING THE SAME, AND CONTROL PULSE GENERATION DEVICE

(71) Applicant: Sony Corporation, Tokyo (JP)

(72) Inventors: Ken Kikuchi, Tokyo (JP); Takehiro Misonou, Kanagawa (JP); Genichiro Oga, Kanagawa (JP); Takahiro Kita, Kagoshima (JP); Takaaki Sugiyama, Kanagawa (JP); Eiji Nagasaka, Kanagawa (JP); Kenji Watanabe, Kanagawa (JP); Takayuki Kubota, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 314 days.

(21) Appl. No.: 14/165,751

(22) Filed: Jan. 28, 2014

(65) Prior Publication Data

US 2014/0218272 A1 Aug. 7, 2014

(30) Foreign Application Priority Data

Feb. 4, 2013 (JP) ..... 2013-019289
May 23, 2013 (JP) ..... 2013-108555
Sep. 12, 2013 (JP) ..... 2013-189062

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0814* (2013.01);
(Continued)

(58) Field of Classification Search
None
See application file for complete search history.

(56) References Cited

U.S. PATENT DOCUMENTS 9,159,262 B2 10/2015 Kikuchi et al.
2001/0043202 A1* 11/2001 Choi ..... G09G 5/18 345/204
(Continued)

FOREIGN PATENT DOCUMENTS

CN 1698084 A 11/2005
CN 102047312 A 5/2011
(Continued)

OTHER PUBLICATIONS

U.S. Appl. No. 14/224,124, filed Mar. 25, 2014, Kikuchi et al.
U.S. Appl. No. 14/819,262, filed Aug. 5, 2015, Kikuchi et al.
Chinese Office Action dated Aug. 2, 2017 in connection with Chinese Application No. 201410041541.9, and English translation thereof.

*Primary Examiner* — Nicholas J Lee
*Assistant Examiner* — Duane N Taylor, Jr.
(74) *Attorney, Agent, or Firm* — Wolf, Greenfield & Sacks, P.C.

(57) ABSTRACT

A display unit includes a pixel group having pixels. Each of the pixels includes a light emitting section and a drive circuit. The pixel group is divided into P pieces of pixel blocks. The display unit is configured to allow the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and when the light emitting sections configuring the respective pixels in pixel blocks of the P pieces of pixel blocks emit light, configured to allow the light emitting sections configuring the respective pixels in remaining pixel blocks of the P pieces of pixel blocks not to emit light.

10 Claims, 25 Drawing Sheets

(52) U.S. Cl.
CPC ..... *G09G 2300/0866* (2013.01); *G09G 2310/0218* (2013.01)

(56) References Cited

U.S. PATENT DOCUMENTS

| | | | | |
|---|---|---|---|---|
| 2005/0225683 | A1* | 10/2005 | Nozawa | G09G 3/2014 348/801 |
| 2006/0038501 | A1* | 2/2006 | Koyama | G09G 3/3216 315/169.3 |
| 2006/0169979 | A1* | 8/2006 | Endo | G09G 3/3233 257/59 |
| 2011/0157134 | A1* | 6/2011 | Ogura | G09G 3/20 345/211 |
| 2012/0043911 | A1* | 2/2012 | Takahashi | G09G 3/3225 315/294 |
| 2012/0242708 | A1* | 9/2012 | Tsai | G09G 3/3266 345/690 |
| 2014/0292745 | A1 | 10/2014 | Kikuchi et al. | |
| 2015/0302795 | A1* | 10/2015 | Genoe | G09G 3/2018 345/691 |
| 2015/0339979 | A1 | 11/2015 | Kikuchi et al. | |

FOREIGN PATENT DOCUMENTS

| | | |
|---|---|---|
| JP | 2003-223136 | 8/2003 |
| JP | 2003-223136 A | 8/2003 |

* cited by examiner

| INPUT SIGNAL VOLTAGE $V_{sig}$ | OUTPUT SIGNAL VOLTAGE $V_{sig}$ |
|---|---|
| 0 | 0. 0 |
| 1 | 0. 8 |
| 2 | 1. 6 |
| 3 | 2. 4 |
| 4 | 3. 2 |
| 5 | 4. 0 |
| 6 | 4. 8 |
| 7 | 5. 6 |
| 8 | 6. 4 |
| 9 | 7. 2 |
| 10 | 8. 0 |
| 11 | 12. 8 |
| 12 | 13. 6 |
| 13 | 14. 4 |
| 14 | 15. 2 |
| 15 | 16. 0 |
| 16 | 16. 8 |
| 17 | 17. 6 |
| 18 | 18. 4 |
| 19 | 19. 2 |
| 20 | 20. 0 |

| INPUT SIGNAL VOLTAGE $V_{sig}$ | OUTPUT SIGNAL VOLTAGE $V_{sig}$ |
|---|---|
| 0 | 0.000 |
| 1 | 1.000 |
| 2 | 2.000 |
| 3 | 3.000 |
| 4 | 4.000 |
| 5 | 5.000 |
| 6 | 5.500 |
| 7 | 6.000 |
| 8 | 6.500 |
| 9 | 7.500 |
| 10 | 8.636 |
| 11 | 9.773 |
| 12 | 10.909 |
| 13 | 12.045 |
| 14 | 13.182 |
| 15 | 14.318 |
| 16 | 15.455 |
| 17 | 16.591 |
| 18 | 17.727 |
| 19 | 18.864 |
| 20 | 20.000 |

DISPLAY UNIT, METHOD OF DRIVING THE SAME, AND CONTROL PULSE GENERATION DEVICE

CROSS REFERENCE TO RELATED APPLICATIONS

This application claims the benefit of Japanese Priority Patent Application JP 2013-19289 filed Feb. 4, 2013, Japanese Priority Patent Application JP 2013-108555 filed May 23, 2013, and Japanese Priority Patent Application JP 2013-189062 filed Sep. 12, 2013, the entire contents of each of which are incorporated herein by reference.

BACKGROUND

The present disclosure relates to a display unit, a method of driving the same, and a control pulse generation device.

Development of a light emitting diode (LED) display unit using a light emitting diode as a light emitting element is earnestly proceeding. In the light emitting diode display unit, a light emitting section configured of a red light emitting diode functions as a red light emission sub-pixel, a light emitting section configured of a green light emitting diode functions as a green light emission sub-pixel, and a light emitting section configured of a blue light emitting diode functions as a blue light emission sub-pixel. A color image is displayed by light emission of the three kinds of sub-pixels. For example, in a full high-definition (HD) full-color television having a diagonal of 40 inches, the number of pixels in a horizontal direction of a screen is 1920, and the number of pixels in a vertical direction of the screen is 1080. Therefore, in this case, the number of light emitting diodes to be mounted is 1920×1080×(the number of the three kinds of light emitting diodes, namely, the red-light emitting diode, the green-light emitting diode, and the blue-light emitting diode, necessary for configuring one pixel), which is about six million pieces.

In an organic electroluminescence display unit (hereinafter, simply referred to as an organic EL display unit) using organic electroluminescence elements (hereinafter, simply referred to as organic EL elements) as a light emitting section, a variable constant current driving method having a fixed light emission duty is widely used as a drive circuit configured to drive the light emitting section. In addition, in terms of reduction in emission ununiformity, an organic EL display unit employing PWM driving is disclosed in Japanese Unexamined Patent Application Publication No. 2003-223136, for example. In a method of driving an organic EL display unit disclosed in Japanese Unexamined Patent Application Publication No. 2003-223136, a picture signal voltage is written to all pixels during a first period of one frame period in a state where light emission of current driving type light emitting elements in all the pixels are stopped, and the current driving type light emitting elements in all the pixels are allowed to emit light together within one or more light emission periods determined by the picture signal voltage written to the respective pixels during a second period subsequent to the first period of the one frame period.

SUMMARY

Incidentally, in a light emitting diode, blue shift occurs in a spectrum wavelength due to increase of an amount of a drive current, which results in change of light emission wavelength. Therefore, in variable constant current driving, monochrome chromaticity point may be disadvantageously varied by luminance (the amount of the drive current). To avoid such a disadvantage, it is necessary to drive the light emitting diode based on the PWM driving method. In the PWM driving method, it is necessary to appropriately define emission period, emission timing, and write timing of image data in order to sufficiently ensure emission period for each pixel.

It is desirable to provide a display unit and a method of driving the display unit in each of which light emission periods and emission timings of each pixel are optimized, and a control pulse generation device suitable for use in the display unit.

According to an embodiment (1) of the disclosure, there is provided a display unit including a pixel group having a plurality of pixels that are arranged in a form of a two-dimensional matrix in a first direction and a second direction. Each of the pixels includes a light emitting section and a drive circuit configured to drive the light emitting section. The pixel group is divided into P pieces of pixel blocks along the first direction where P is an integer of two or more. Each of the drive circuits includes a comparator device and a light emitting section drive transistor. The comparator device is configured to compare control pulses with a potential that is based on a signal voltage and output a predetermined voltage based on a comparison result, and the light emitting section drive transistor is configured to supply a current to the light emitting section according to the predetermined voltage from the comparator device to allow the light emitting section to emit light. The display unit is configured to allow the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and when the light emitting sections configuring the respective pixels in pixel blocks of the P pieces of pixel blocks emit light, configured to allow the light emitting sections configuring the respective pixels in remaining pixel blocks of the P pieces of pixel blocks not to emit light.

According to an embodiment (2) of the disclosure, there is provided a display unit including a pixel group having a plurality of pixels that are arranged in a form of a two-dimensional matrix in a first direction and a second direction. Each of the pixels includes a light emitting section and a drive circuit configured to drive the light emitting section. The pixel group is divided into P pieces of pixel block groups along the first direction where P is an integer of two or more. A p-th pixel block group of the P pieces of pixel block groups is divided into $Q_p$ pieces of pixel blocks along the first direction where $1 \leq p \leq P$. Each of the drive circuits includes a comparator device and a light emitting section drive transistor. The comparator device is configured to compare control pulses with a potential that is based on a signal voltage and output a predetermined voltage based on a comparison result, and the light emitting section drive transistor is configured to supply a current to the light emitting section according to the predetermined voltage from the comparator device to allow the light emitting section to emit light. The display unit is configured to allow the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of pixel block groups to sequentially emit light together on a pixel block basis, and when the light emitting sections configuring the respective pixels in pixel blocks of the $Q_p$ pieces of pixel blocks emit light, configured to allow the light emitting sections configuring the respective pixels in remaining pixel blocks of the $Q_p$ pieces of pixel blocks not to emit light.

According to an embodiment (3) of the disclosure, there is provided a display unit a pixel group having a plurality of pixels that are arranged in a form of a two-dimensional matrix in a first direction and a second direction. Each of the pixels includes a light emitting section and a drive circuit configured to allow the light emitting section to emit light for a time corresponding to a potential that is based on a signal voltage. The pixel group is divided into P pieces of pixel blocks along the first direction where P is an integer of two or more. The display unit is configured to allow the light emitting sections from the light emitting sections configuring the respective pixels in a first pixel block of the P pieces of pixel blocks to the light emitting sections configuring the respective pixels in P-th pixel block of the P pieces of pixel blocks to sequentially emit light together on a pixel block basis, and when the light emitting sections configuring the respective pixels in pixel blocks of the P pieces of pixel blocks emit light, configured to allow the light emitting sections configuring the respective pixels in remaining pixel blocks of the P pieces of pixel blocks not to emit light.

According to an embodiment (4) of the disclosure, there is provided a display unit including a pixel group having a plurality of pixels that are arranged in a form of a two-dimensional matrix in a first direction and a second direction. Each of the pixels includes a light emitting section and a drive circuit configured to allow the light emitting section to emit light for a time corresponding to a potential that is based on a signal voltage. The pixel group is divided into P pieces of pixel block groups along the first direction where P is an integer of two or more. A p-th pixel block group of the P pieces of pixel block groups is divided into $Q_p$ pieces of pixel blocks along the first direction where $1 \leq p \leq P$. The display unit is configured to allow the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of the pixel block groups to sequentially emit light together on a pixel block basis, and when the light emitting sections configuring the respective pixels in pixel blocks of the $Q_p$ pieces of pixel blocks emit light, configured to allow the light emitting sections configuring the respective pixels in remaining pixel blocks of the $Q_p$ pieces of pixel blocks not to emit light.

According to an embodiment (1) of the disclosure, there is provided a control pulse generation device including a control pulse generation circuit configured to generate control pulses having a sawtooth voltage variation to control a drive circuit in a display unit. The display unit includes a pixel group having a plurality of pixels that are arranged in a form of a two-dimensional matrix in a first direction and a second direction. Each of the pixels includes a light emitting section and the drive circuit configured to allow the light emitting section to emit light for a time corresponding to a potential that is based on a signal voltage. The pixel group is divided into P pieces of pixel blocks along the first direction where P is an integer of two or more. The control pulse generation circuit sequentially supplies the control pulses to the drive circuits from the drive circuits configuring the respective pixels in a first pixel block of the P pieces of pixel blocks to the drive circuits configuring the respective pixels in a P-th pixel block of the P pieces of pixel blocks on a pixel block basis, and when the control pulse generation circuit supplies the control pulses to the drive circuits configuring the respective pixels in pixel blocks of the P pieces of pixel blocks, the control pulse generation circuit does not supply the control pulses to the drive circuits configuring the respective pixels in remaining pixel blocks of the P pieces of pixel blocks.

According to an embodiment (2) of the disclosure, there is provided a control pulse generation device. The control pulse generation device is configured to generate control pulses having a sawtooth voltage variation to control a drive circuit in a display unit. The display unit includes a pixel group having a plurality of pixels that are arranged in a form of a two-dimensional matrix in a first direction and a second direction. Each of the pixels includes a light emitting section and a drive circuit configured to allow the light emitting section to emit light for a time corresponding to a potential that is based on a signal voltage. The pixel group is divided into P pieces of pixel block groups along the first direction where P is an integer of two or more. The control pulse generation circuit is provided in each of the pixel block groups. A p-th pixel block group of the P pieces of pixel block groups is divided into $Q_p$ pieces of pixel blocks along the first direction where $1 \leq p \leq P$. The control pulse generation circuit in each of the pixel block groups supplies the control pulses sequentially to the drive circuits from the drive circuits configuring the respective pixels in a first pixel block in a first pixel block group of the P pieces of pixel block groups to the drive circuits configuring the respective pixels in a $Q_P$-th pixel block in a P-th pixel block group of the P pieces of pixel block groups on a pixel block basis, and when the control pulse generation circuit supplies the control pulses to the drive circuits configuring the respective pixels in pixel blocks of the $Q_p$ pieces of pixel blocks, the control pulse generation circuit does not supply the control pulses to the drive circuits configuring the respective pixels in remaining pixel blocks of the $Q_p$ pieces of pixel blocks. Note that the control pulse generation circuit may include a capacitor between a control pulse generation section and an output section, and further, a DC power source common to the control pulse generation circuits is connected the capacitor and the output section through a switch.

According to an embodiment (1) of the disclosure, there is provided a method of driving a display unit. The method includes: preparing the display unit, the display unit including a pixel group having a plurality of pixels that are arranged in a form of a two-dimensional matrix in a first direction and a second direction, each of the pixels including a light emitting section and a drive circuit configured to drive the light emitting section, the pixel group being divided into P pieces of pixel blocks along the first direction where P is an integer of two or more, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light; allowing the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and allowing, when the light emitting sections configuring the respective pixels in pixel blocks of the P pieces of pixel blocks emit light, the light emitting sections configuring the respective pixels in remaining pixel blocks of the P pieces of pixel blocks not to emit light.

According to an embodiment (2) of the disclosure, there is provided a method of driving a display unit. The method includes: preparing the display unit, the display unit including a pixel group having a plurality of pixels that are arranged in a form of a two-dimensional matrix in a first direction and a second direction, each of the pixels including a light emitting section and a drive circuit configured to drive the light emitting section, the pixel group being divided into P pieces of pixel block groups along the first direction where P is an integer of two or more, a p-th pixel block group of the P pieces of pixel block groups being divided into $Q_p$ pieces of pixel blocks along the first direction where $1 \leq p \leq P$, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light; allowing the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of pixel block groups to sequentially emit light together on a pixel block basis, and allowing, when the light emitting sections configuring the respective pixels in pixel blocks of the $Q_p$ pieces of pixel blocks emit light, the light emitting sections configuring the respective pixels in remaining pixel blocks of the $Q_p$ pieces of pixel blocks not to emit light.

According to an embodiment (3) of the disclosure, there is provided a method of driving a display unit. The method includes: preparing the display unit, the display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel blocks along the first direction where P is an integer of two or more; allowing the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and allowing, when the light emitting sections configuring the respective pixels in pixel blocks of the P pieces of pixel blocks emit light, the light emitting sections configuring the respective pixels in remaining pixel blocks of the P pieces of pixel blocks not to emit light.

According to an embodiment (4) of the disclosure, there is provided a method of driving a display unit. The method includes: preparing the display unit, the display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel block groups along the first direction where P is an integer of two or more, a p-th pixel block group of the P pieces of pixel block groups being divided into $Q_p$ pieces of pixel blocks along the first direction where $1 \leq p \leq P$; allowing the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of pixel block groups to sequentially emit light together on a pixel block basis, and allowing, when the light emitting sections configuring the respective pixels in pixel blocks of the $Q_p$ pieces of pixel blocks emit light, the light emitting sections configuring the respective pixels in remaining pixel blocks of the $Q_p$ pieces of pixel blocks not to emit light.

In the display unit or the method of driving the display unit according to the embodiment (1) or (3) of the present disclosure, the pixel group is divided into P pieces of pixel blocks along the first direction. The display unit is configured to allow the light emitting sections configuring the respective pixels in the first pixel block of the P pieces of pixel blocks to the light emitting sections configuring the respective pixels in the P-th pixel block of the P pieces of pixel blocks to sequentially emit light together on a pixel block basis. In addition, when the light emitting sections configuring the respective pixels in pixels of the P pieces of pixel blocks emit light, the display unit is configured to allow the light emitting sections configuring the respective pixels in the remaining pixel blocks not to emit light. Moreover, in the control pulse generation device according to the embodiment (1) of the present disclosure, the control pulse generation circuit supplies the control pulses to the drive circuits so that the light emitting sections configuring the respective pixels are operated in such a way. In the display unit or the method of driving the display unit according to the embodiment (2) or (4) of the present disclosure, the pixel group is divided into P pieces of pixel block groups, and a p-th pixel block group of the P pieces of pixel block groups is divided into $Q_p$ pieces of pixel blocks along the first direction where $1 \leq p \leq P$. The display unit is configured to allow the light emitting sections from the light emitting sections configuring the respective pixels in the first pixel block in the first pixel block group of the P pieces of pixel block groups to the light emitting sections configuring the respective pixels in the $Q_P$-th pixel block in the P-th pixel block group of the P pieces of pixel block groups to sequentially emit light together on a pixel block basis, and when the light emitting sections configuring the respective pixels in pixel blocks of the $Q_p$ pieces of pixel blocks emit light, the display unit is configured to allow the light emitting sections configuring the respective pixels in the remaining pixel blocks of the $Q_p$ pieces of pixel blocks not to emit light. In addition, in the control pulse generation device according to the embodiment (2) of the present disclosure, The control pulse generation circuit supplies the control pulses sequentially to the drive circuit so that the light emitting sections configuring the respective pixels are operated in such a way. Consequently, in the driving the display unit based on the PWM driving method, emission period is lengthened, which makes it possible to improve emission efficiency.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Figure 1A:
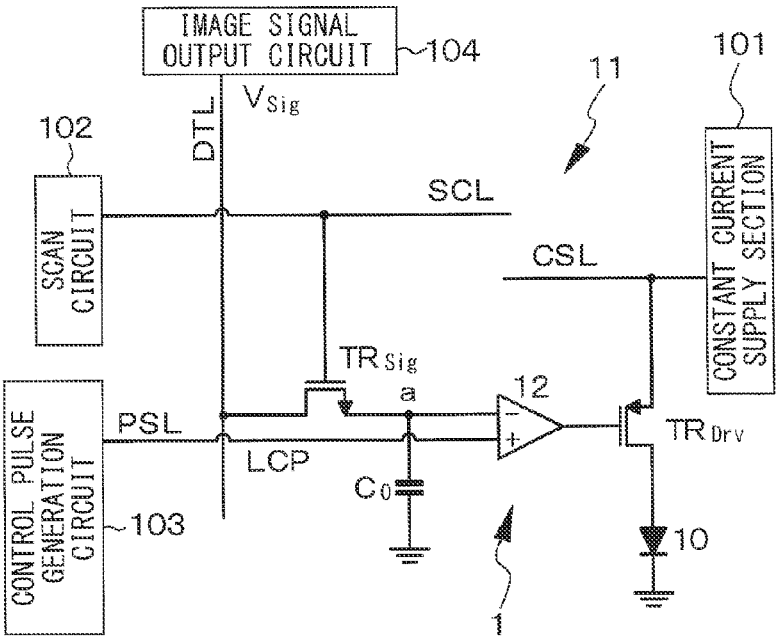
FIG. 1A and FIG. 1B are an equivalent circuit diagram of a pixel configured of a light emitting section and a drive circuit in a display unit according to embodiment 1, and a schematic diagram illustrating control pulses and the like for explaining operation of one pixel, respectively.

Hereinafter, the present disclosure will be described based on some embodiments with reference to drawings. However, the present disclosure is not limited to the embodiments, and numerical values and materials in the embodiments are merely exemplified. Note that the description will be given in the following order.

1. Display unit and method of driving display unit according to first to fourth embodiments of present disclosure, control pulse generation device according to first and second embodiments of the present disclosure, and general description
2. Embodiment 1 (display unit and method of driving display unit according to first embodiment and third embodiment (third-A embodiment) of present disclosure)
3. Embodiment 2 (modification of embodiment 1)
4. Embodiment 3 (modification of embodiments 1 and 2)
5. Embodiment 4 (another modification of embodiments 1 and 2)
6. Embodiment 5 (modification of embodiments 3 and 4)
7. Embodiment 6 (modification of embodiment 5)
8. Embodiment 7 (display unit and method of driving display unit according to second embodiment and fourth embodiment (fourth-A embodiment) of present disclosure)

9. Embodiment 8 (modification of embodiments 1 to 6, and display unit and method of driving display unit according to third-B embodiment of present disclosure)

10. Embodiment 9 (modification of embodiment 7, display unit and method of driving display unit according to fourth-B embodiment of present disclosure), and others (Display Unit and Method of Driving Display Unit According to First to Fourth Embodiments of Present Disclosure, Control Pulse Generation Device According to First and Second Embodiments of Present Disclosure, and General Description)

A display unit according to a first embodiment of the present disclosure and a method of driving the display unit according to the first embodiment of the present disclosure may be hereinafter simply referred to as "first embodiment of the present disclosure" collectively in some cases. A display unit according to a second embodiment of the present disclosure and a method of driving the display unit according to the second embodiment of the present disclosure may be hereinafter simply referred to as "second embodiment of the present disclosure" collectively in some cases. A display unit according to a third embodiment of the present disclosure and a method of driving the display unit according to the third embodiment of the present disclosure may be hereinafter simply referred to as "third embodiment of the present disclosure" collectively in some cases. A display unit according to a fourth embodiment of the present disclosure and a method of driving the display unit according to the fourth embodiment of the present disclosure may be hereinafter simply referred to as "fourth embodiment of the present disclosure" collectively in some cases. In addition, a plurality of pixels are arranged in a form of a two-dimensional matrix in a first direction and a second direction, and a group of pixels arranged in the first direction may be referred to as "column-direction pixel group" and a group of pixels arranged in the second direction may be referred to as "row-direction pixel group" in some cases. In the case where the first direction is a vertical direction in the display unit and the second direction is a horizontal direction in the display unit, the column-direction pixel group refers to a group of pixels arranged in the vertical direction, and the row-direction pixel group refers to a group of pixels arranged in the horizontal direction. An order of driving of the pixel blocks is inherently optional, and the number of pixels configuring each pixel blocks may be the same as one another or may be different from one another.

The display unit according to the first embodiment of the present disclosure may include one control pulse generation circuit that is configured to generate control pulses having a sawtooth voltage variation. By employing such a configuration, light emission of the light emitting section is allowed to be accurately controlled without causing variation in series of control pulses. Alternatively, the first embodiment of the present disclosure may include a plurality of control pulse generation circuits each configured to generate control pulses having a sawtooth voltage variation. By employing such a configuration, it is possible to employ a larger value for a value of P (a dividing number of pixel blocks along the first direction, which will be described later). Note that the shapes of the control pulses generated by the plurality of control pulse generation circuits may be preferably the same as one another as much as possible, and the control pulses generated by the plurality of control pulse generation circuits may be preferably shifted in phase (may preferably have a phase difference). Incidentally, such preferred embodiments of the display unit according to the first embodiment of the present disclosure may be referred to as "display unit according to first-A embodiment of present disclosure" for convenience in some cases. In addition, in the display unit according to the second embodiment of the present disclosure, each of the pixel block groups may include one control pulse generation circuit that is configured to generate control pulses having a sawtooth voltage variation. Incidentally, such preferred embodiments of the display unit according to the second embodiment of the present disclosure may be referred to as "display unit according to second-A embodiment of present disclosure" for convenience in some cases.

In the display unit according to the third and fourth embodiments of the present disclosure, the light emitting section may emit light multiple times, based on the control pulses having a sawtooth voltage variation supplied to the drive circuit and the potential that is based on a signal voltage. The display according to the third embodiment of the present disclosure based on such embodiments may include one control pulse generation circuit that is configured to generate control pulses having a sawtooth voltage variation (incidentally, such an embodiment may be referred to as "display unit according to third-A embodiment of present disclosure" for convenience in some cases). In addition, in the display unit according to the fourth embodiment of the present disclosure based on such embodiments, each of the pixel block groups may include one control pulse generation circuit that is configured to generate the control pulses having a sawtooth voltage variation (incidentally, such an embodiment may be referred to as "display unit according to fourth-A embodiment of present disclosure" for convenience in some cases). Moreover, in such embodiments, the control pulses may have the same crest value of the voltage variation, and may have the same voltage variation pattern.

Furthermore, in the display unit according to the third or fourth embodiment of the present disclosure including one or more of the above-described preferred embodiments, the absolute value of the voltage each of the control pulses may be increased and then decreased with lapse of time, and further, a gamma correction may be performed based on the voltage of the control pulses varied with lapse of time. Specifically, the voltage of the control pulses may be represented by the following expressions (1-1) and (1-2) when time is denoted by t, and "2.2" may be exemplified as the value of $\gamma$. Here, $V_0$ indicates an absolute value of a crest value, $T_0$ indicates a time length from start of the voltage variation of one control pulse LCP until end of the voltage variation. When $0 \leq (t/T_0) \leq 0.5$ is established, the voltage of the control pulses is represented by the expression (1-1), and when $0.5 \leq (t/T_0) \leq 1.0$ is established, the voltage of the control pulses is represented by the expression (1-2).

$$V = V_0[1-(2t/T_0)]^{1/\gamma} \quad (1\text{-}1)$$

$$V = V_0[(2t/T_0)-1]^{1/\gamma} \quad (1\text{-}2)$$

Alternatively, in the display unit according to the third embodiment of the present disclosure, the light emitting section may emit light multiple times, based on the control pulses having the sawtooth voltage variation supplied to the drive circuit and the potential based on the signal voltage, the control pulses may include two or more kinds of control pulses having different crest values of the voltage variation from one another, and the same number of control pulse generation circuits as the control pulses may be provided. Incidentally, such an embodiment may be referred to as "display unit according to third-B embodiment of present disclosure" for convenience in some cases.

Alternatively, in the display unit according to the fourth embodiment of the present disclosure, the light emitting section may emit light multiple times based on control pulses and the potential that is based on the signal voltage, the control pulses having a sawtooth voltage variation supplied to the drive circuit, the control pulses may include two or more kinds of control pulses having different crest values of the voltage variation from one another, and each of the pixel block groups may include the same number of control pulse generation circuits as the control pulses. Incidentally, such an embodiment may be referred to as "display unit according to fourth-B embodiment of present disclosure" for convenience in some cases.

In the display unit according to the third-B embodiment or the fourth-B embodiment of the present disclosure, the two or more kinds of control pulses may have different voltage variation patterns from one another.

Furthermore, in the display unit according to the third-B embodiment or the fourth-B embodiment including one or more of such preferred embodiments, the number of emission times of the light emitting section may be dependent on the potential based on the signal voltage, and further, the number of emission times of the light emitting section may be varied between a case where the potential based on the predetermined signal voltage is lower than a predetermined potential and a case where the potential is equal to or higher than the predetermined potential.

Furthermore, in the display unit according to the third-B embodiment or the fourth-B embodiment of the disclosure including one or more of such preferred embodiments, when a control pulse having a large absolute value of the crest value of the voltage variation is defined as a first control pulse and a control pulse having a small absolute value of the crest value of the voltage variation is defined as a second control pulse, a waveform of the first control pulse may change discontinuously at a voltage of the first control pulse equal to a predetermined voltage $V_{pd}$ of the second control pulse. Alternatively, when the control pulse having the large absolute value of the crest value of the voltage variation is defined as the first control pulse and the control pulse having the small absolute value of the crest value of the voltage variation is defined as the second control pulse, the voltage of the first control pulse exceeding the absolute value of the predetermined voltage $V_{pd}$ of the second control pulse (more actually, the first control pulse whose absolute value of the voltage is larger than the absolute value of the predetermined voltage $V_{pd}$, the same applies hereinafter) may follow the above-described expressions (1-1) and (1-2), and a voltage of a synthesized pulse of the first control pulse and the second control pulse which are equal to or lower than the absolute value of the predetermined voltage $V_{pd}$ (more actually, the first control pulse whose absolute value of the voltage is equal to or lower than the absolute value of the predetermined voltage $V_{pd}$ and the second control pulse, the same applies hereinafter) may follow the above-described expressions (1-1) and (1-2). In this case, the voltage of the first control pulse exceeding the absolute value of the predetermined voltage $V_{pd}$ may be varied in a first variation pattern, the voltage of the first control pulse equal to or lower than the absolute value of the predetermined voltage $V_{pd}$ may be varied in a second variation pattern, and the voltage of the second control pulse equal to or lower than the absolute value of the predetermined voltage $V_{pd}$ may be varied in a third variation pattern. Furthermore, the second variation pattern may be equal to the third variation pattern, and alternatively, the second variation pattern may be different from the third variation pattern.

Furthermore, in the display unit according to the third-B embodiment or the fourth-B embodiment of the present disclosure including one or more of such preferred embodiments, when the control pulse having the large absolute value of the crest value of the voltage variation is defined as the first control pulse, the control pulse having the small absolute value of the crest value of the voltage variation is defined as the second control pulse, the waveform shape of the edge of the first control pulse may be a rectangular shape or a rounded shape. Such an embodiment makes it possible to stabilize emission state (emission time) of the light emitting section based on the signal voltage having a voltage equal to the voltage near the edge of the first control pulse.

Furthermore, in the display unit according to the third-B embodiment or the fourth-B embodiment of the present disclosure including one or more of such preferred embodiments, when the control pulse having the large absolute value of the crest value of the voltage variation is defined as the first control pulse, the control pulse having the small absolute value of the crest value of the voltage variation is defined as the second control pulse, a time width of the second control pulse at the predetermined voltage $V_{pd}$ of the second control pulse is defined as $T_2$, a time width of the first control pulse at the voltage of the first control pulse equal to the predetermined voltage $V_{pd}$ of the second control pulse is defined as $T_1$, an expression $20 \leq T_1/T_2 \leq 100$ may be satisfied. In this case, the value of $T_1$ may be 5 microseconds to 10 microseconds both inclusive, without limitation.

Furthermore, in the display unit according to the third-B embodiment or the fourth-B embodiment of the present disclosure including one or more of such preferred embodiments, the control pulses may be supplied to the drive circuit in ascending order of the absolute value of the crest value of the voltage variation. Accordingly, it is possible to effectively prevent occurrence of flicker.

In the first to fourth embodiments of the present disclosure including one or more of the above-described preferred embodiments or a control pulse generation circuit of first and second embodiments of the present disclosure, when a series of control pulses are generated in one display frame, and light emitting sections configuring respective pixels in one of pixel blocks do not emit light, the control pulses may not be supplied to drive circuits configuring the respective pixels in the one of pixel blocks by masking a part of the control pulses.

In the first and second embodiments of the present disclosure including one or more of the above-described preferred embodiments, the light emitting section may emit light multiple times based on the control pulses. In addition, in the control pulse generation device according to the first embodiment or the second embodiment of the present disclosure including one or more of the above-described preferred embodiments, the light emitting section may emit light multiple times based on the control pulses. Further, in such embodiments and in the third and fourth embodiments of the present disclosure including one or more of the above-described embodiments, time intervals between the control pulses may be preferably fixed.

In the first to fourth embodiments of the present disclosure including one or more of the above-described various kinds of preferred embodiments, the number of control pulses supplied to the drive circuit in one display frame may be smaller than the number of control pulses in the one display frame. Also in the control pulse generation device according to the first and second embodiments of the present disclosure including one or more of the above-described various kinds of preferred embodiments, similarly, the number of control pulses supplied to the drive circuit in one display frame may be smaller than the number of control pulses in the one display frame. As described above, these embodiments may be achievable in such a way that when a series of control pulses are generated in one display frame and the light emitting sections configuring the respective pixels in the one of pixel blocks do not emit light, the control pulses may not be supplied to the drive circuits configuring the respective pixels in the one of the pixel blocks by masking a part of the control pulses.

Further, in the first to fourth embodiments of the present disclosure including one or more of the above-described various kinds of preferred embodiments, any of the pixel blocks may emit light constantly in one display frame, or any of the pixel blocks may not emit light in one display frame. Likewise, in the control pulse generation device according to the first and second embodiments of the present disclosure including one or more of the above-described various kinds of preferred embodiments, any of the pixel blocks may emit light constantly in one display frame, or any of the pixel blocks may not emit light in one display frame.

Further, in the first and second embodiments of the present disclosure including one or more of the above-described various kinds of preferred embodiments and configurations, and in the control pulse generation device of the first and second embodiments of the present disclosure including one or more of the above-described various kinds of preferred embodiments and configurations, an absolute value of a voltage of one of the control pulses may be preferably increased and then deceased with lapse of time. This makes the light emitting sections configuring all pixels in each of the pixel blocks emit light at the same timing. In other words, temporal centers of light emission of the light emitting sections configuring all the pixels in each of the pixel blocks are aligned (are coincident with one another). In this case, gamma correction may be preferably performed based on a voltage of the control pulses varied with lapse of time, which makes it possible to simplify the entire circuit of the display unit. Note that the voltage of the control pulses may preferably follow the above-described expressions (1-1) and (1-2).

Further, in the first and second embodiments of the present disclosure including one or more of the above-described various kinds of preferred embodiments and configurations, operation and non-operation of a comparator device may be controlled by the control pulse. Specifically, the comparator device may be operated only before and after a period in which the light emitting section emits light, which makes it possible to reduce a dark current or a through current flowing through the comparator device even with a simple circuit configuration.

Alternatively, in the first and second embodiments of the present disclosure including one or more of the above-described various kinds of preferred embodiments and configurations, the comparator device may include: a signal write transistor configured to receive the signal voltage; and a capacitor connected to the signal write transistor and configured to retain the potential based on the signal voltage in response to operation of the signal write transistor.

Alternatively, in the first and second embodiments of the present disclosure including one or more of the above-described various kinds of preferred embodiments and configurations, the comparator device may include: a signal write transistor configured to receive the signal voltage; a capacitor connected to the signal write transistor and configured to retain the potential based on the signal voltage in response to operation of the signal write transistor; and a comparator circuit including a first input section connected to a control pulse line, a second input section connected to the capacitor, and an output section. A light emitting section drive transistor is connected to the output section of the comparator circuit, and is operated with use of an output of a predetermined voltage from the comparator circuit based on a comparison result between the potential based on the signal voltage retained by the capacitor and a sawtooth voltage of a control pulse, thereby supplying a current to a light emitting section through a current supply line to allow the light emitting section to emit light. Incidentally, the comparator device having such a configuration is referred to as "comparator device having first configuration" for convenience. Also, in the comparator device having the first configuration, operation and non-operation of the comparator circuit may be controlled by the control pulse.

Alternatively, in the first and second embodiments of the present disclosure including one or more of the above-described various kinds of preferred embodiments and configurations, the comparator device may include a comparison section that includes: a signal write transistor configured to receive the signal voltage; a control pulse transistor configured to receive the control pulses and to perform ON-OFF operation based on a signal having a reversed phase from that of the signal write transistor; an inverter circuit; and a capacitor having a first end connected to the signal write transistor and the control pulse transistor, and a second end connected to the inverter circuit, and configured to retain a potential based on the signal voltage in response to operation of the signal write transistor. Incidentally, the comparator device having such a configuration is referred to as "comparator device having second configuration" for convenience.

In the comparator device having the second configuration, a control section configured to control operation and non-operation of the comparison section with use of the control pulses may be provided. The control section may have a switch circuit that is connected in series to the inverter circuit and is configured to perform ON-OFF operation according to the sawtooth voltage of the control pulse. In addition, the control section may have a second switch circuit that is connected in parallel to the switch circuit and is turned on in an operation period of the comparator device. Moreover, the control section may have a resistance element that is connected in series to the inverter circuit, or the inverter circuit may have a configuration in which inverters are connected in two or more-stage cascade.

Alternatively, in the first and second embodiments of the present disclosure including one or more of the above-described various kinds of preferred embodiments and configurations, the comparator device may include a comparison section that includes: a signal write transistor configured to receive the signal voltage; a capacitor connected to the signal write transistor and configured to retain the potential based on the signal voltage in response to operation of the signal write transistor; a differential circuit configured to receive the control pulses and the signal voltage from the signal write transistor; and a constant current source configured to supply a constant current to the differential circuit. Incidentally, the comparator device having such a configuration is referred to as "comparator device having third configuration" for convenience.

In the comparator device having the third configuration, the comparator device may further include a control section configured to control operation and non-operation of the comparison section with use of the control pulses. The control section may have a switch circuit that is connected in series to the constant current source and is configured to perform ON-OFF operation according to the sawtooth voltage of the control pulses. In addition, the control section may have a second switch circuit that is connected in series to a constant voltage circuit and is configured to perform ON-OFF operation according to the sawtooth voltage of the control pulses. The constant voltage circuit is configured to apply a constant voltage to a gate electrode of a transistor configuring the constant current source.

Further, in the first and second embodiments of the present disclosure including the above-described comparator device (the comparator device having the first configuration, the comparator device having the second configuration, or the comparator device having the third configuration) having the signal write transistor and the capacitor, in each pixel block, the signal write transistors in all pixels (the row-direction pixel group) in one line in the second direction may be put into an operation state together. In such a configuration, in each pixel block, operation in which the signal write transistors in the row-direction pixel group are put into an operation state together may be sequentially performed on the signal write transistors from the signal write transistors in all pixels (a row-direction pixel group in a first row) in a first row in the first direction to the signal write transistors in all pixels (a row-direction pixel group in a last row) in the last row. Further, in each pixel block, the operation in which the signal write transistors in the row-direction pixel group are put into an operation state together may be sequentially performed on the signal write transistors from the signal write transistors in the row-direction pixel group in the first row to the signal write transistors in the row-direction pixel group in the last row, and then the control pulses may be supplied to the pixel block in which the operation has been performed. Incidentally, the period during which the operation, in which the signal write transistors in the row-direction pixel group are put into the operation state together, is sequentially performed on the signal write transistors from the signal write transistors in the row-direction pixel group in the first row to the signal write transistors in the row-direction pixel group in the last low, may be referred to as "signal voltage write period" in some cases, and the period during which the light emitting sections, configuring all the pixels in each pixel block, emit light may be referred to as "pixel block emission period" in some cases.

In the third and fourth embodiments of the present disclosure including one or more of the above-described various kinds of preferred embodiments and configurations, the drive circuit may include the comparator device, the control pulses and the signal voltage may be input to the comparator device, and the light emitting section may be operated with use of an output of the comparator device based on a comparison result between the sawtooth voltage of the control pulses and the potential based on the signal voltage. In such an embodiment, operation and non-operation of the comparator device may be controlled by the control pulse, which makes it possible to reduce a dark current or a through current flowing through the comparator device even with a simple circuit configuration.

Moreover, in the third and fourth embodiments of the present disclosure including one or more of the above-described various kinds of preferred embodiments and configurations, in each pixel block, the drive circuits in the row-direction pixel group may be put into an operation state together. In such a configuration, in each pixel block, the operation in which the drive circuits in the row-direction pixel group are put into an operation state together may be sequentially performed on the drive circuits from the drive circuits in the row-direction pixel group in a first row to the drive circuits in the row-direction pixel group in a last row. Further, in each pixel block, the operation in which the drive circuits in the row-direction pixel group are put into an operation state together may be sequentially performed on the drive circuits from the drive circuits in the row-direction pixel group in the first row to the drive circuits in the row-direction pixel group in the last low, and then, the control pulse generation circuit may supply the control pulses to those pixel blocks in which the operation has been performed.

Moreover, in the control pulse generation device of the first and second embodiments of the present disclosure including one or more of the above-described various kinds of preferred embodiments and configurations, in each pixel block, the drive circuits in the row-direction pixel group may be put into an operation state together. In such a configuration, in each pixel block, the operation in which the drive circuits in the row-direction pixel group are put into an operation state together may be sequentially performed on the drive circuits from the drive circuits in the row-direction pixel group in the first row to the drive circuits in the row-direction pixel group in the last row. Further, in each pixel block, the operation in which the drive circuits in the row-direction pixel group are put into an operation state together may be sequentially performed on the drive circuits from the drive circuits in the row-direction pixel group in the first row to the drive circuits in the row-direction pixel group in the last row, and then the control pulses may be supplied to the pixel blocks in which the operation has been performed.

Further, in the first to fourth embodiments of the present disclosure including one or more of the above-described various kinds of preferred embodiments and configurations, and in the control pulse generation device of the first and second embodiments of the present disclosure including one or more of the above-described various kinds of preferred embodiments and configurations, the light emitting section may be configured of a light emitting diode (LED). The light emitting diode may have a known configuration and a known structure. In other words, a light emitting diode that has an optimal configuration and an optimal structure and is fabricated by an appropriate material may be selected depending on emission color of the light emitting diode. In the display unit including the light emitting diode as a light emitting section, a light emitting section configured of a red light emitting diode functions as a red light emitting sub-pixel, a light emitting section configured of a green light emitting diode functions as a green light emitting sub-pixel, and a light emitting section configured of a blue light emitting diode functions as a blue light emitting sub-pixel. One pixel is configured of such three kinds of sub-pixels, and a color image is allowed to be displayed by light emission of the three kinds of sub-pixels. Incidentally, "one pixel" in one embodiment of the present disclosure corresponds to "one sub-pixel" in such a display unit. Therefore, "one sub-pixel" in such a display unit may be read as "one pixel". In the case where the three kinds of sub-pixels configure one pixel, delta arrangement, stripe arrangement, diagonal arrangement, rectangle arrangement may be used as an arrangement of the three kinds of sub-pixels. The light emitting diodes are driven with a constant current based on a PWM driving method. This makes it possible to prevent occurrence of blue shift in spectrum wavelength of the light emitting diode. In addition, three panels may be prepared, and a first panel may be configured of the light emitting section that may be configured of the red light emitting diode, a second panel may be configured of the light emitting section that may be configured of the green light emitting diode, and a third panel may be configured of the light emitting section that may be configured of the blue light emitting diode. Then, light from the three panels may be combined with use of, for example, a dichroic prism. Hence, in one embodiment, the technology may be applied to a projector.

Further, in the first and second embodiments of the present disclosure including one or more of the above-described various kinds of preferred embodiments and configurations, the pixels in one line in the second direction may be connected to the control pulse line, and the control pulse line may be provided with voltage follower circuits (buffer circuits) that may be provided at predetermined intervals (for every predetermined number of pixels). This makes waveform dullness difficult to occur in the control pulses transmitted through the control pulse line. In this case, for example, a configuration in which one voltage follower circuit is provided for every ten to twenty pixels (pixels in a row-direction pixel group) in one line in the second direction may be exemplified, however, the configuration is not limited thereto.

Embodiment 1

Figure 2:
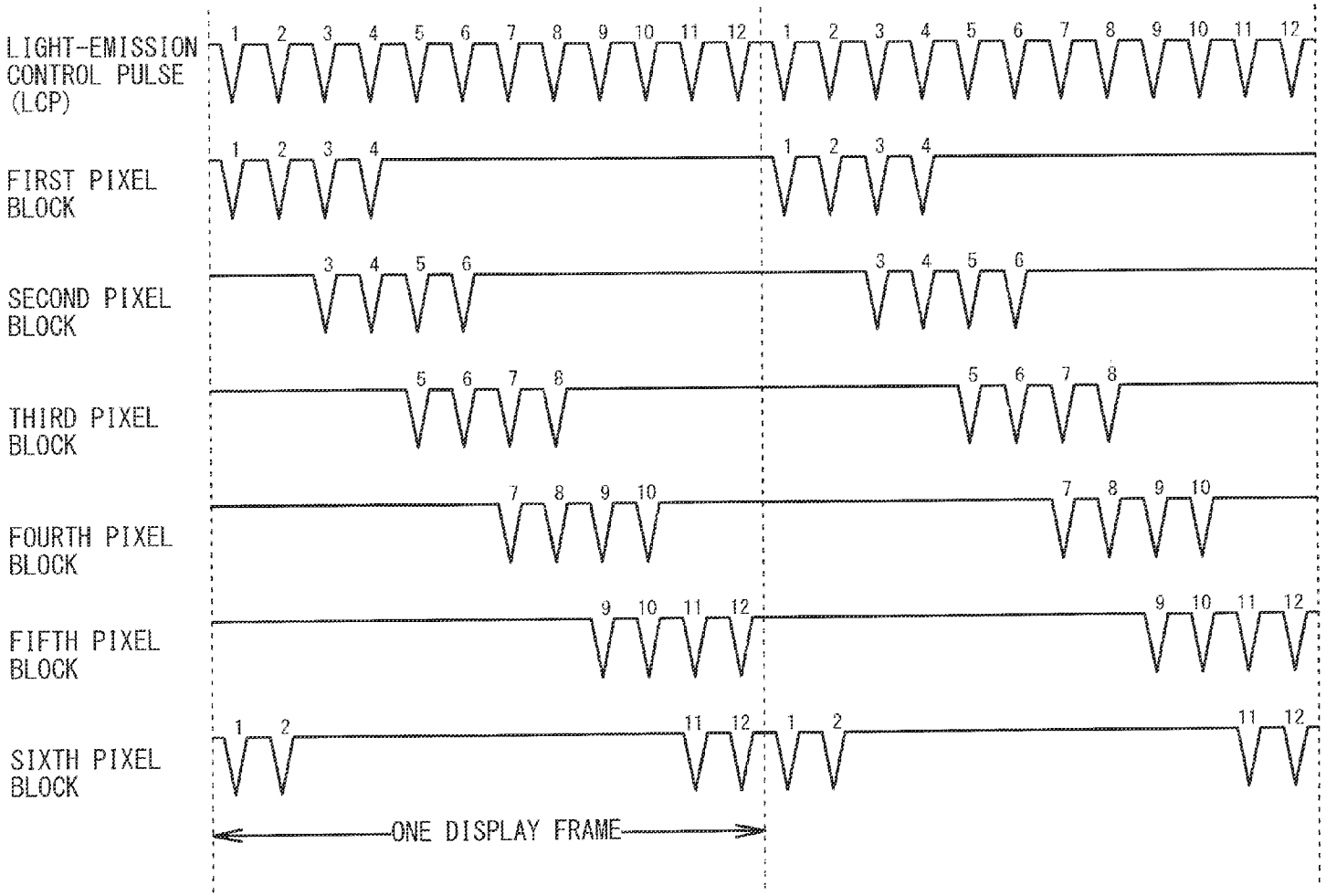
FIG. 2 is a diagram schematically illustrating supply of a plurality of control pulses to pixel blocks in the display unit according to the embodiment 1.

Embodiment 1 relates to the display unit and the method of driving the display unit according to the first embodiment and the third embodiment (specifically, the third-A embodiment) of the present disclosure, and further relates to the control pulse generation device according to the first embodiment of the present disclosure. FIG. 1A is an equivalent circuit diagram of a pixel 1 that includes the light emitting section and the drive circuit in the display unit of the embodiment 1, and FIG. 4 is a conceptual diagram of a circuit configuring the display unit of the embodiment 1. For simplification of the drawings, FIG. 4 and FIG. 5 described later each illustrate 3×5 pieces of pixels. In addition, FIG. 2 schematically illustrates supply of a plurality of control pulses to the pixel blocks in the display unit of the embodiment 1. Further, FIG. 6A is a conceptual diagram of the control pulse generation device in the display unit of the embodiment 1. FIG. 2 as well as FIG. 3, FIG. 9, FIG. 10, FIG. 11, FIG. 15, FIG. 25, and FIG. 26 that will be described later each illustrates the sawtooth waveform of the control pulses in a triangle for convenience.

To provide description based on the display unit or the method of driving the display unit according to the first embodiment of the present disclosure, the display unit of the embodiment 1, or the display unit in the method of driving the display unit of the embodiment 1 includes a pixel group having a plurality of pixels (more specifically, sub-pixels, and the same applies to the following) 1 arranged in a form of a two-dimensional matrix in the first direction and the second direction, and the pixel group is divided into P pieces of pixel blocks along the first direction. Each of the pixels 1 includes a light emitting section 10, and a drive circuit 11 driving the light emitting section 10. Note that the display unit includes one control pulse generation circuit 103 that is configured to generate control pulses LCP having a sawtooth voltage variation.

Each drive circuit 11 includes: (a) a comparator device that is configured to compare the control pulses with a potential that is based on a signal voltage to output a predetermined voltage based on a comparison result; and (b) a light emitting section drive transistor $TR_{Drv}$ that is configured to supply a current to the light emitting section according to the predetermined voltage from the comparator device to allow the light emitting section 10 to emit light. Note that, specifically, a signal voltage $V_{Sig}$ is a picture signal voltage controlling emission state (luminance) of the pixel. Specifically, the comparator device is connected to a control pulse line PSL and a data line DTL, and compares the control pulses LCP having a sawtooth voltage variation from the control pulse line PSL with a potential that is based on the signal voltage (emission intensity signal) $V_{Sig}$ from the data line DTL, to output the predetermined voltage based on the comparison result. In addition, the light emitting section drive transistor $TR_{Drv}$ is operated with use of the output of the predetermined voltage from the comparator device, and thus supplies a current to the light emitting section 10 through a current supply line CSL, to allow the light emitting section 10 to emit light.

More specifically, the comparator device in the embodiment 1 includes: a signal write transistor $TR_{Sig}$ configured to receive the signal voltage $V_{Sig}$; and a capacitor $C_0$ connected to the signal write transistor $TR_{Sig}$ and configured to retain the potential based on the signal voltage $V_{Sig}$ in response to operation of the signal write transistor $TR_{Sig}$. Operation and non-operation of the comparator device is controlled by the control pulses LCP.

Alternatively, more specifically, the comparator device in the embodiment 1 is configured of the comparator device having the first configuration, and includes: the signal write transistor $TR_{Sig}$ configured to receive the signal voltage $V_{Sig}$; the capacitor $C_0$ connected to the signal write transistor $TR_{Sig}$, and configured to retain the potential based on the signal voltage $V_{Sig}$ in response to the operation of the signal write transistor $TR_{Sig}$; and a comparator circuit 12 including a first input section (a non-inverting input terminal) connected to the control pulse line PSL, a second input section (an inverting input terminal) connected to the capacitor $C_0$, and an output section. The light emitting section drive transistor $TR_{Drv}$ is connected to the output section of the comparator circuit 12, is operated with use of the output of a predetermined voltage (for convenience, referred to as "first predetermined voltage") from the comparator circuit 12 based on the comparison result between the potential based on the signal voltage $V_{Sig}$ retained in the capacitor $C_0$ and the sawtooth voltage of the control pulses LCP, thereby supplying a current to the light emitting section 10 through the current supply line CSL to allow the light emitting section 10 to emit light.

In addition, to provide description based on the display unit or the method of driving the display unit according to the third embodiment of the present disclosure, the display unit of the embodiment 1 or the display unit in the method of driving the display unit in the embodiment 1 includes a pixel group having a plurality of pixels 1 arranged in a form of two-dimensional matrix in the first direction and the second direction, and the pixel group is divided into P pieces of pixel blocks along the first direction. Each of the pixels 1 includes the light emitting section 10 and the drive circuit 11 allowing the light emitting section 10 to emit light for a time corresponding to the potential based on the signal voltage $V_{Sig}$. The light emitting sections 10 from the light emitting sections 10 configuring the respective pixels 1 in a first pixel block to the light emitting sections 10 configuring the pixels 1 in P-th pixel block are allowed to sequentially emit light together on a pixel block basis, and when the light emitting sections 10 configuring the respective pixels 1 in some of the pixel blocks emit light, the light emitting sections 10 configuring the respective pixels 1 in the remaining pixel blocks are not allowed to emit light. For example, the drive circuit 11 includes the comparator device, the control pulses LCP and the signal voltage $V_{Sig}$ are input to the comparator device, and therefore the light emitting section 10 is operated by the output of the comparator device based on the comparison result between the sawtooth voltage of the control pulses LCP and the potential based on the signal voltage $V_{Sig}$. Further, operation and non-operation of the comparator device is controlled by the control pulses LCP. Incidentally, as described above, the comparator device includes the comparator circuit 12, the signal write transistor $TR_{Sig}$, and the capacitor $C_0$. The control pulses LCP are input to the first input section of the comparator circuit 12, and the signal voltage $V_{Sig}$ is input to the second input section of the comparator circuit 12.

The signal write transistor $TR_{Sig}$ and the light emitting section drive transistor $TR_{Drv}$ configuring the drive circuit 11 are each configured of an existing field effect transistor that has a gate electrode, a channel forming region, and source-drain electrodes. Note that, although the signal write transistor $TR_{Sig}$ is an n-channel field effect transistor and the light emitting section drive transistor $TR_{Drv}$ is a p-channel field effect transistor, the channel type is not limited thereto.

The gate electrode of the signal write transistor $TR_{Sig}$ is connected to a scan circuit 102 provided in the display unit through a scan line SCL. In addition, one of the source-drain electrodes of the signal write transistor $TR_{Sig}$ is connected to an image signal output circuit 104 provided in the display unit through the data line DTL. Further, the other of the source-drain electrodes of the signal write transistor $TR_{Sig}$ is connected to a first end of the capacitor $C_0$ and the second input section (the inverting input terminal) of the comparator circuit 12.

On the other hand, the gate electrode of the light emitting section drive transistor $TR_{Drv}$ is connected to the output section of the comparator circuit 12. In addition, one of the source-drain electrodes of the light emitting section drive transistor $TR_{Drv}$ is connected to a constant current supply section 101 provided in the display unit through the current supply line CSL. Further, the other of the source-drain electrodes of the light emitting section drive transistor $TR_{Drv}$ is connected to the light emitting section 10.

A second end of the capacitor $C_0$ is grounded. In addition, the light emitting section 10 is configured of a light emitting diode. Note that the constant current supply section 101, the scan circuit 102, the control pulse generation circuit 103, the image signal output circuit 104, and the like may be provided in the display unit or in the outside.

For example, an example is assumed here of a full HD full-color display unit in which the number of pixels in the horizontal direction (in the second direction) of a screen is 1920, and the number of pixels in the vertical direction (in the first direction) of the screen is 1080. The pixel group is divided into P pieces of pixel blocks along the first direction, and it is assumed that P is six. In this example, pixel groups from a pixel group in a first row to a pixel group in 180th row are included in a first pixel group, pixel groups from a pixel group in 181st row to a pixel group in 360th row are included in a second pixel block, pixel groups from a pixel group in 361th row to a pixel group in 540th row are included in a third pixel block, pixel groups from a pixel group in 541th row to a pixel group in 720th row are included in a fourth pixel block, pixel groups from a pixel group in 721th row to a pixel group in 900th row are included in a fifth pixel block, and pixel groups from a pixel group in 901th row to a pixel group in 1080th row are included in a sixth pixel block.

Hereinafter, operation of each pixel in the first pixel block is described.

(Signal Voltage Write Period)

Figure 1B:
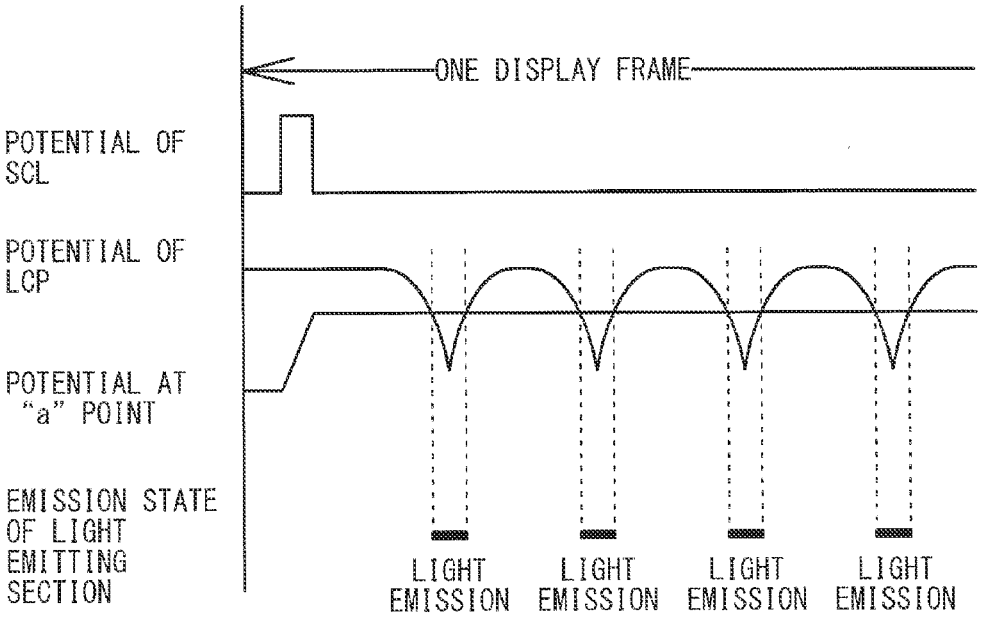

As illustrated in FIG. 1B, when a scan signal is input from the scan circuit 102 to the gate electrode of the signal write transistor $TR_{Sig}$ through the scan line SCL, the signal write transistor $TR_{Sig}$ is tuned on. At the same time or before, the signal voltage (the emission intensity signal) $V_{Sig}$ is output from the image signal output circuit 104 through the data line DTL. As a result, charge based on the signal voltage $V_{Sig}$ is accumulated in the capacitor $C_0$. After that, input of the scan signal to the gate electrode of the signal write transistor $TR_{Sig}$ is stopped, and the signal write transistor $TR_{Sig}$ is turned off. The capacitor $C_0$ retains the potential based on the signal voltage $V_{Sig}$ (see the potential at "a" point). Incidentally, a signal voltage (a signal voltage of black display) of "0" may be first transmitted from the image signal output circuit 104 through the data line DTL, and then the signal voltage $V_{Sig}$ may be transmitted from the image signal output circuit 104.

In the first pixel block, the drive circuits 11 (specifically, the signal write transistors $TR_{Sig}$) in all pixels (row-direction pixel group) in one line in the second direction are put into an operation state together. Then, in the first pixel block, operation in which the drive circuits 11 (specifically, the signal write transistors $TR_{Sig}$) in all pixels (the row-direction pixel group) in one line in the second direction are put into an operation state together is sequentially performed on the drive circuits 11 from the drive circuits 11 (specifically, the signal write transistors $TR_{Sig}$) in all pixels (the row-direction pixel group in the first low) in the first row in the first direction to the drive circuits 11 (specifically, the signal write transistors $TR_{Sig}$) in all pixels (the row-direction pixel group in the last row) in the last row (specifically, 180th row).

(Pixel Block Emission Period)

When the above-described operation is completed in the first pixel block, the control pulses LCP are supplied from the control pulse generation circuit 103 to the first pixel block. In other words, the drive circuits 11 (specifically, the light emitting section drive transistors $TR_{Drv}$) configuring all the pixels 1 in the first pixel block are put into the operation state together, and the light emitting sections 10 in all the pixels 1 in the first pixel block emit light. The absolute value of the voltage of one control pulse LCP is increased and then decreased with lapse of time. Incidentally, in the example illustrated in FIG. 1B, the voltage of one control pulse LCP is increased and then decreased with lapse of time. Then, gamma correction is performed with use of the voltage of the control pulse LCP varied with lapse of time. In other words, the voltage of the control pulses LCP follows the above-described expressions (1-1) and (1-2). Note that the control pulses LCP have the same crest values of the voltage variation and the same voltage variation patterns.

In the example illustrated in FIG. 1B, during the signal voltage write period, the voltage of the control pulse LCP may be, for example, equal to or larger than 3 volts. Therefore, during the signal voltage write period, the comparator circuit 12 outputs the second predetermined voltage (H) from the output section, and thus the light emitting section drive transistor $TR_{Drv}$ is in an off state. During the pixel block emission period, when the voltage of the control pulse LCP starts to decrease and becomes the potential at "a" point or lower, the comparator circuit 12 outputs the first predetermined voltage (L) from the output section. As a result, the light emitting section drive transistor $TR_{Drv}$ is turned on, and the current is supplied to the light emitting section 10 through the current supply line CSL to allow the light emitting section 10 to emit light. The voltage of the control pulse LCP is decreased to about 1 volt, and then increased. When the voltage of the control pulse LCP exceeds the potential at "a" point, the comparator circuit 12 outputs the second predetermined voltage (H) from the output section. As a result, the light emitting section drive transistor $TR_{Drv}$ becomes off state, the supply of the current to the light emitting section 10 through the current supply line CSL is blocked, and therefore the light emitting section 10 stops emitting light. In other words, the light emitting section 10 is allowed to emit light during a time period in which the potential based on the signal voltage (the emission intensity signal) $V_{Sig}$ cuts the sawtooth waveform of the control pulses LCP. The luminance of the light emitting section 10 at this time is dependent on the length of the time to be cut.

Specifically, the emission time of the light emitting section 10 is based on the potential retained in the capacitor $C_0$ (specifically, the potential at "a" point) and the voltage of the control pulses LCP from the control pulse generation circuit 103. Further, gamma correction is performed based on the sawtooth voltage of the control pulses LCP varied with lapse of time. In other words, since the voltage of the control pulses LCP follows the above-described expressions (1-1) and (1-2), it is unnecessary to provide a circuit for the gamma correction. For example, it is conceivable to use control pulses having a linear sawtooth voltage (a triangular waveform), and to vary the signal voltage $V_{Sig}$ by $(1/\gamma)$ power (=(1/2.2) power) of the linear luminance signal. However, practically, the voltage variation is excessively small at low luminance, and in particular, a larger bit number is necessary in order to achieve such a voltage variation by digital processing, which is not an effective method.

In the embodiment 1, one control pulse generation circuit 103 that generates the control pulses LCP having the sawtooth voltage variation is provided. As schematically illustrated in FIG. 1B, the voltage of the control pulses LCP is rapidly varied at low grayscale part (low voltage part), and is sensitive particularly to waveform quality of the control pulse waveform at this part. Therefore, it is necessary to consider variation of the control pulses LCP generated by the control pulse generation circuit. However, since only one control pulse generation circuit 03 is provided in the display unit of the embodiment 1, the control pulses LCP generated by the control pulse generation circuit are virtually not varied in waveform. In other words, the entire display unit is allowed to emit light based on the same control pulse waveform, which prevents occurrence of variation in the emission state. In addition, since the absolute value of the voltage of the control pulse LCP is increased and then decreased with lapse of time, the light emitting sections configuring all the pixels (more specifically, all the sub-pixels) in one of the pixel blocks are allowed to emit light at the same timing. In other words, temporal centers of the light emission of the light emitting sections configuring all the pixels in each pixel block are aligned (are coincident with one another). Therefore, it is possible to ensure that occurrence of vertical lines (vertical stripe) on the image caused by delay of light emission in the column-direction pixel group is prevented.

In the display unit or the method of driving the display unit in the embodiment 1, the light emitting section 10 emits light multiple times based on the plurality of control pulses LCP. Alternatively, the light emitting section 10 emits light multiple times based on the plurality of control pulses LCP having sawtooth voltage variation supplied to the drive circuit 11 and the potential based on the signal voltage $V_{Sig}$. Still alternatively, in the control pulse generation circuit 103, the light emitting section 10 emits light based on the plurality of control pulses LCP. Time intervals between the plurality of control pulses LCP are fixed. Specifically, in the embodiment 1, during the pixel block emission period, four control pulses LCP are transmitted to all the pixels 1 configuring each pixel block, and each of the pixels emits light four times.

As schematically illustrated in FIG. 2, in the display unit or the method of driving the display unit in the embodiment 1, in one display frame, twelve control pulses LCP are supplied to six pixel blocks. Further, the number of the control pulses LCP supplied to the drive circuit 11 in one display frame is smaller than the number of control pulses LCP in one display frame. Alternatively, in the control pulse generation circuit 103, the number of the control pulses LCP supplied to the drive circuit 11 in one display frame is smaller than the number of control pulses LCP in one display frame. Specifically, in the example illustrated in FIG. 2, the number of control pulses LCP in one display frame is twelve, and the number of control pulses LCP supplied to the drive circuit 11 in one display frame is four. In the adjacent pixel blocks, two control pulses are overlapped. In other words, two adjacent pixel blocks emit light at the same time. In addition, the first pixel block and the last pixel block also emit light at the same time. Such an embodiment may be achievable in such a way that when the plurality of control pulses LCP are generated in one display frame, and the light emitting sections 10 configuring the pixels 1 in one of the pixel blocks are not allowed to emit light, a part of a series of the plurality of control pulses LCP may be masked and the control pulses LCP may be not supplied to the drive circuits 11 configuring the pixels 1 in the one of the pixel blocks. Specifically, for example, a part (four consecutive control pulses LCP) of the control pulses LCP in one display frame may be extracted and may be supplied to the drive circuit 11, with use of a multiplexer.

Specifically, the control pulse generation circuit 103 configuring the control pulse generation device in the embodiment 1 is a control pulse generation circuit generating the control pulses LCP having a sawtooth voltage variation. The control pulses LCP are to control the drive circuits 11 in the display unit that has a pixel group having a plurality of pixels 1 arranged in a form of a two-dimensional matrix in a first direction and a second direction. Each of the pixels 1 includes the light emitting section 10 and the drive circuit 11 configured to allow the light emitting section 10 to emit light for a time corresponding to the potential based on the signal voltage $V_{Sig}$. The pixel group is divided into P pieces of pixel blocks along the first direction. Further, the control pulse generation circuit 103 supplies the control pulses LCP sequentially toe the drive circuits 11 from the drive circuits 11 configuring the respective pixels 1 in a first pixel block to the drive circuits 11 configuring the respective pixels 1 in P-th pixel block, on the pixel block basis. In addition, the control pulse generation circuit 103 supplies the control pulses LCP to the drive circuits 11 configuring the respective pixels 1 in some of the pixel blocks while not supplying the control pulses LCP to the drive circuits 11 configuring the respective pixels 1 in the remaining pixel blocks. In this case, when the control pulse generation circuit 103 generates a plurality of control pulses LCP in one display frame, and the light emitting sections 10 configuring respective pixels 1 in one of the pixel blocks are not allowed to emit light, a part of the plurality of control pulses LCP is masked so as not to supply the control pulses LCP to the drive circuits 11 configuring the respective pixels 1 in the one of the pixel blocks.

More specifically, as illustrated in the conceptual diagram of FIG. 6A, in the control pulse generation circuit 103, waveform signal data of the control pulses stored in a memory 21 is read out by a controller 22, the read waveform signal data is transmitted to a D/A converter 23, the waveform signal data is converted into a voltage by the D/A converter 23, the voltage is integrated by a low pass filter 24 to generate control pulses having (1/γ) powered curve. Alternatively, waveform signal data capable of generating control pulses having the (1/γ) powered curve is stored in the memory 21 in advance, the waveform signal data is read out by the controller 22, the read waveform signal data is transmitted to the D/A converter 23, the waveform signal data is converted into a voltage by the D/A converter 23, the voltage is allowed to pass through the low pass filter 23 to generate control pulses having (1/γ) powered curve. Further, the control pulses are distributed to a plurality of (six in the embodiment 1) multiplexers 26 through an amplifier 25. Under the control of the controller 22, each of the multiplexers 26 allows necessary part of the control pulses LCP to pass therethrough and masks the remaining control pulses LCP to generate a desired control pulse group (specifically, six control pulse groups each configured of four consecutive control pulses LCP). Note that, since original sawtooth waveform is only one, it is possible to ensure that occurrence of variation in generation of the control pulses LCP by the control pulse generation circuit 103 is suppressed.

Further, the above-described operation during the signal voltage write period and during the pixel block emission period is performed sequentially on the pixel blocks from the first pixel block to the sixth pixel block. In other words, as illustrated in FIG. 2, the light emitting sections 10 from the light emitting sections 10 configuring the pixels 1 in the first pixel block to the light emitting sections 10 configuring the pixels 1 in the P-th pixel block are allowed to emit light sequentially for each pixel block together. In addition, when the light emitting sections 10 configuring the pixels 1 in some of the pixel blocks are allowed to emit light, the light emitting sections 10 configuring the pixels 1 in the remaining pixel blocks are not allowed to emit light. Incidentally, in one display frame, constantly, any of the pixel blocks emit light, or alternatively, any of the pixel blocks is allowed to emit light.

Incidentally, an existing driving method has the following disadvantages in which a picture signal voltage is written to all pixels in a state of stopping light emission of all the pixels in a first period of one display frame period, and in a second period, light emitting sections of all the pixels are allowed to emit light in one or more emission periods determined by the picture signal voltage written to the respective pixels. Specifically, a picture signal is often transmitted uniformly over the entire one display frame period. Therefore, in a television receiving system, when a vertical blanking period is assigned to the second period, all the pixels may emit light at the same time. However, the vertical blanking period normally has a time length of about 4% of one display frame. Therefore, emission efficiency of the display unit becomes excessively low. In addition, to write the picture signal transmitted over the one display frame to all the pixels in the first period, it is necessary to prepare a large signal buffer. Moreover, to transmit the pixel signal to all the pixels at a rate equal to or higher than a transfer rate of the picture signal, it is necessary to give much consideration to a signal transmission circuit. Further, since all the pixels are allowed to emit light together in the second period, power necessary for light emission is disadvantageously concentrated to a short time, which results in difficulty of power source design.

In contrast, in the embodiment 1, when the light emitting sections configuring the pixels in some of the pixel blocks (for example, the first and second pixel blocks) are allowed to emit light, the light emitting sections configuring the pixels in remaining pixel blocks (for example, the third to sixth pixel blocks) are not allowed to emit light. Therefore, in driving the display unit based on a PWM driving method, emission period is allowed to be lengthened, which makes it possible to improve emission efficiency. In addition, it is unnecessary to write the picture signal transmitted over one display frame to all the pixels simultaneously within a certain period, namely, it is possible to sequentially write, for each row-direction pixel group, the picture signal that is transmitted over one display frame. Therefore, it is unnecessary to prepare a large signal buffer, and it is also unnecessary to give much consideration to the signal transmission circuit such that the picture signal is transmitted to all the pixels at a rate equal to or higher than a transfer rate of the picture signal. Furthermore, all the pixels do not have to emit light together during pixel emission period, i.e., for example, the light emitting sections configuring the pixels in the third to sixth pixel blocks do not emit light when the light emitting sections configuring the pixels in the first and second pixel blocks emit light. Therefore, power necessary for light emission is not concentrated for a short time, which makes it easier to design a power source.

Figure 3:
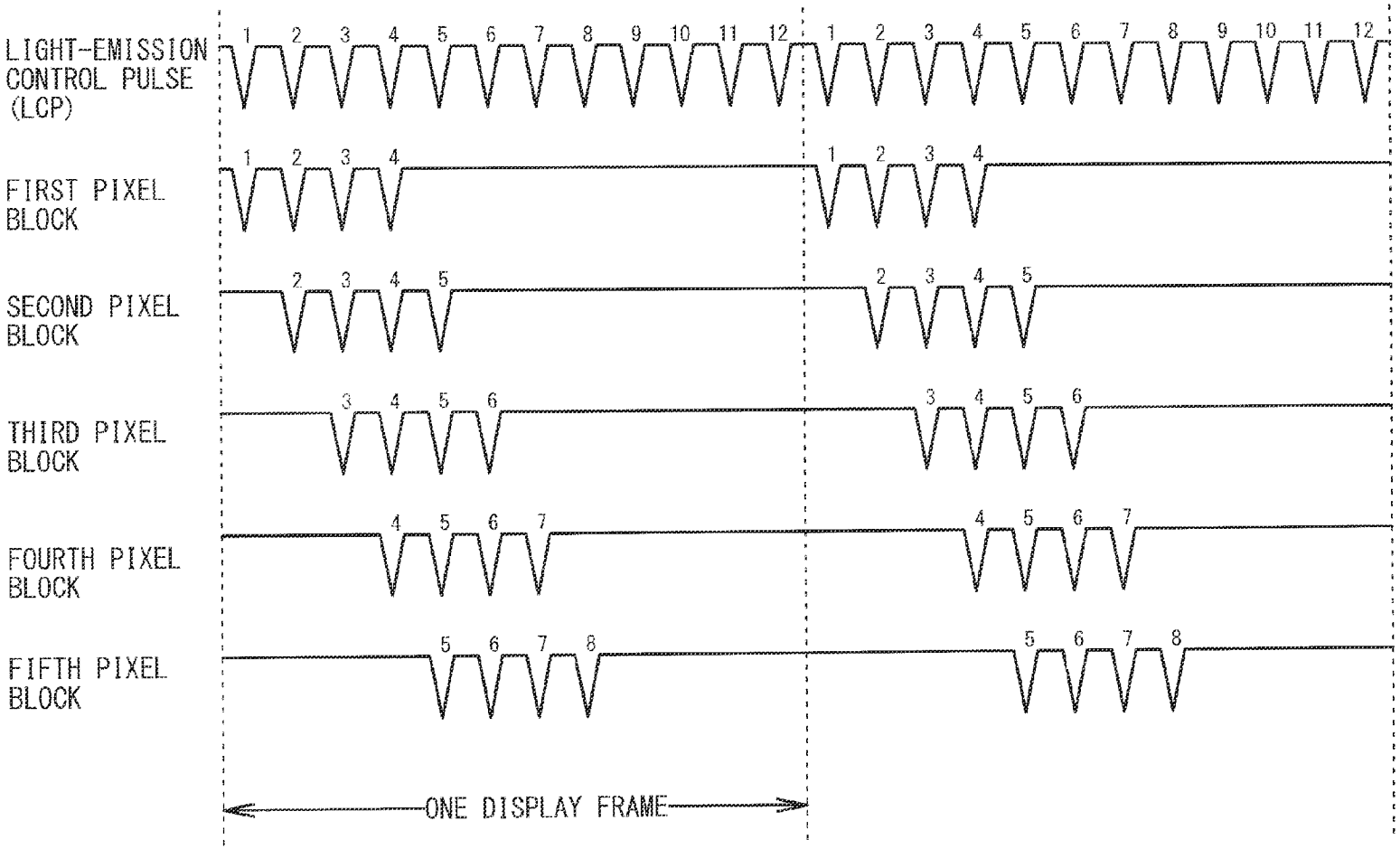
FIG. 3 is a diagram schematically illustrating supply of a plurality of control pulses to pixel blocks in a modification of the display unit according to the embodiment 1.
Figure 4:
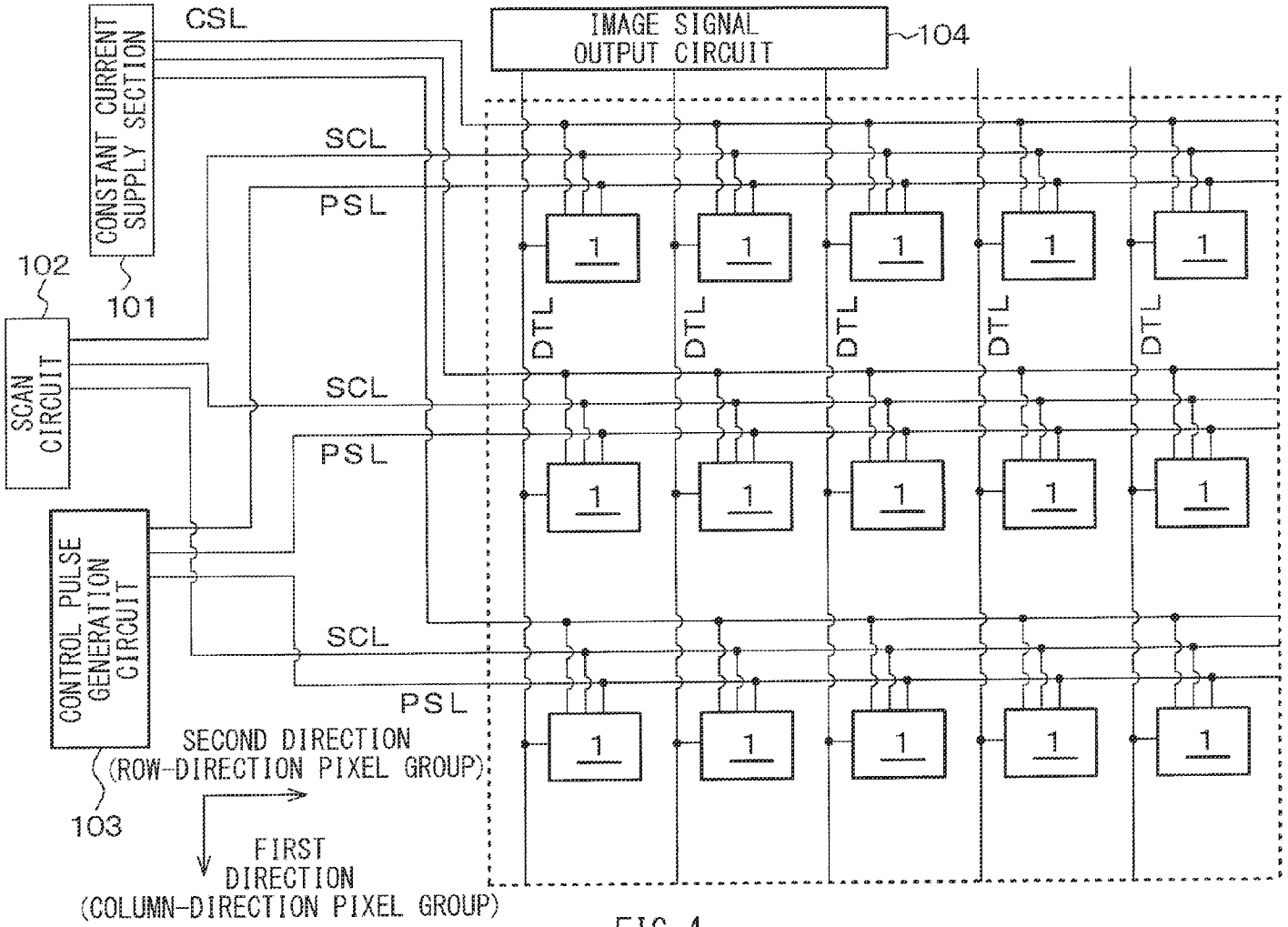
FIG. 4 is a conceptual diagram of a circuit configuring the display unit according to the embodiment 1.

FIG. 3 schematically illustrates supply of the plurality of control pulses LCP to the pixel blocks according to a modification of the display unit of the embodiment 1, where p is five in this example. Pixel groups from a pixel group in a first row to a pixel group in a 216th row are included in a first pixel group, pixel groups from a pixel group in 217th row to a pixel group in 432th row are included in a second pixel block, pixel groups from a pixel group in 433th row to a pixel group in 648th row are included in a third pixel block, pixel groups from a pixel group in 649th row to a pixel group in 864th row are included in a fourth pixel block, and pixel groups from a pixel group in 865th row to a pixel group in 1080th row are included in a fifth pixel block.

Also in the example illustrated in FIG. 3, during the pixel block emission period, four control pulses LCP are transmitted to all pixels 1 configuring the respective pixel blocks, and each of the pixels 1 emits light four times. In one display frame, twelve control pulses LCP are supplied to six pixel blocks. Further, the number of the control pulses LCP supplied to the drive circuit 11 in one display frame is smaller than the number of the control pulses LCP in the one display frame. Specifically, also in the example illustrated in FIG. 3, the number of the control pulses LCP in the one display frame is twelve, and the number of the control pulses LCP supplied to the drive circuit 11 in the one display frame is four. However, unlike the example illustrated in FIG. 2, in the one display frame, the pixel blocks not emitting light exist, or alternatively, the pixel blocks not emitting light are allowed to exist. Three control pulses LCP are overlapped with one another in adjacent pixel blocks. Light emission states are overlapped in up to four pixel blocks of the five pixel blocks. In this way, since the larger number of pixel blocks than that in the example illustrated in FIG. 2 are allowed to emit light together, it is possible to achieve further improvement in image display quality.

Embodiment 2

Embodiment 2 is a modification of the embodiment 1. The control pulse LCP may be transmitted and transferred through the control pulse line PSL that is a long distance wiring. The control pulse line PSL has impedance such as a resistance, a capacity, and a reactance component, and therefore waveform dullness occurs more easily as the transmission distance is longer. In particular, waveform dullness of the control pulse LCP easily occurs as the voltage thereof is lower as illustrated in FIG. 1B, and shading in which low grayscale is black-painted may occur at the pixel located father from the control pulse input end of the control pulse line PSL. To avoid such an issue, providing the control pulse line PSL having small impedance is an effective measure. However, restriction in manufacturing and in manufacturing cost is large, and thus performing such a measure is difficult as the screen size of the display unit is increased.

Figure 5:
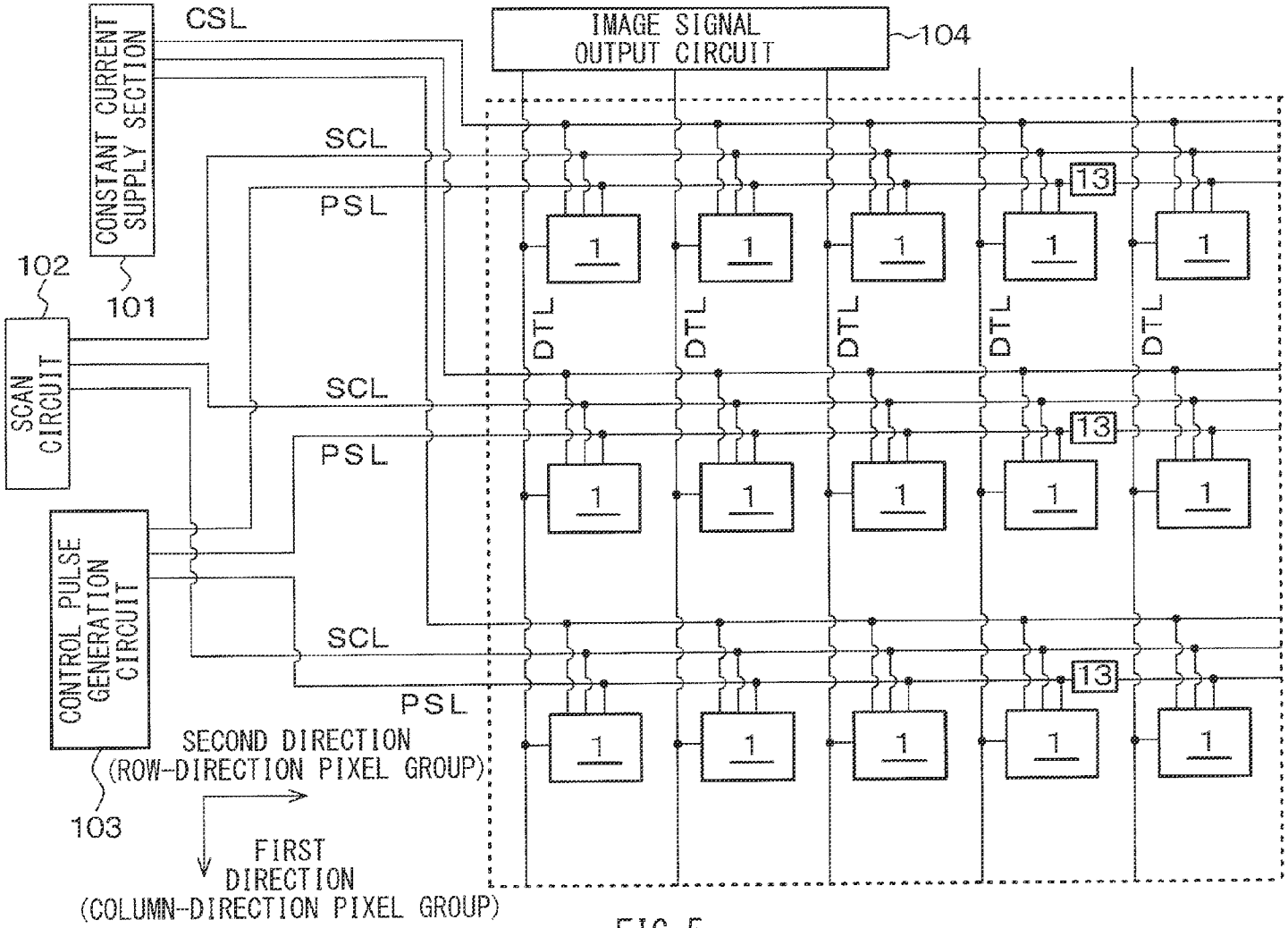
FIG. 5 is a conceptual diagram of a circuit configuring a display unit according to embodiment 2.
Figure 6A:
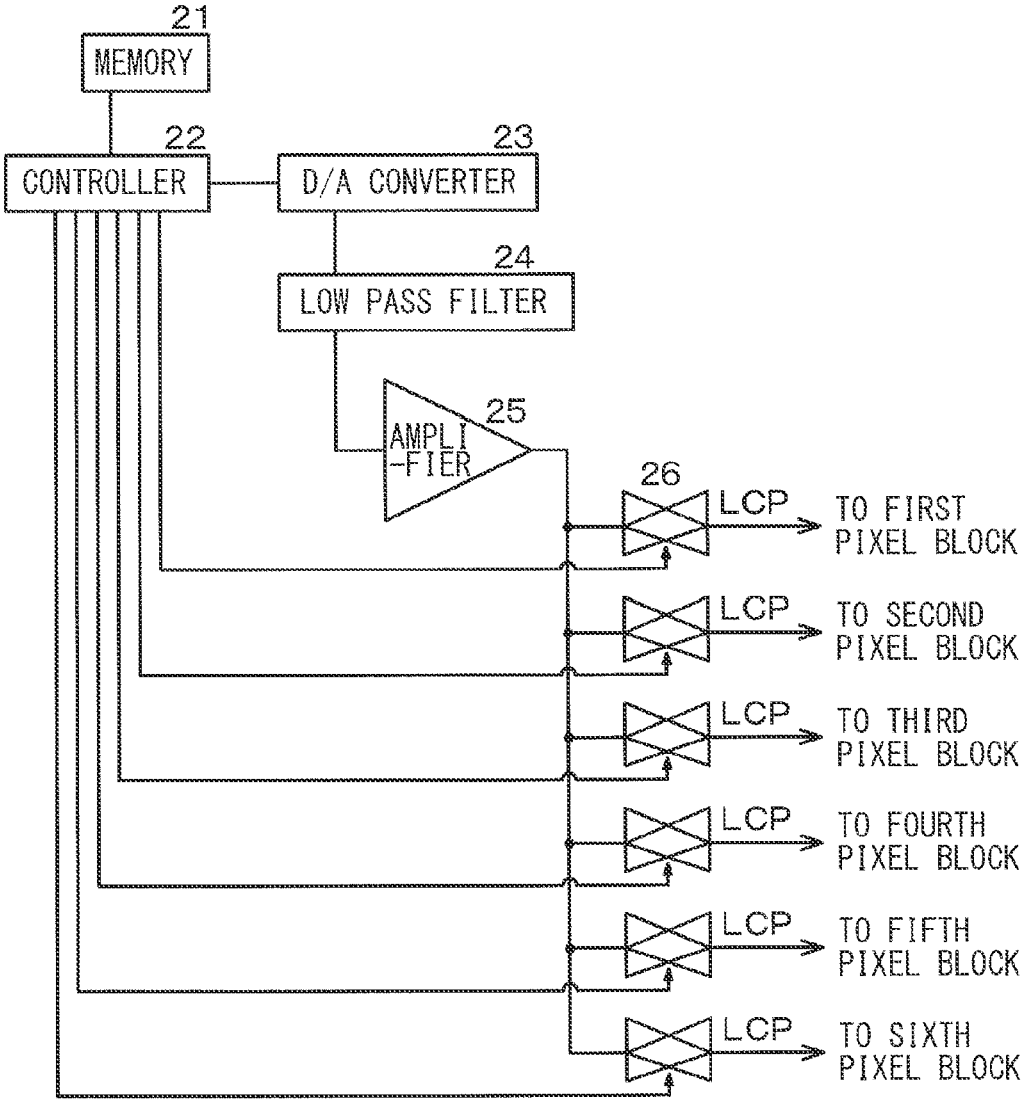
FIG. 6A is a conceptual diagram of a control pulse generation circuit in the display unit according to the embodiment 1.
Figure 6B:
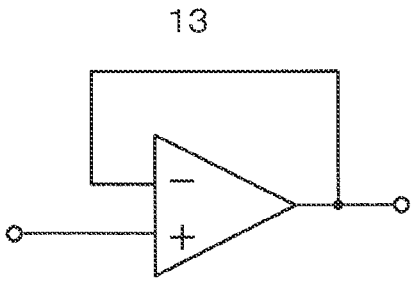
FIG. 6B is a circuit diagram of a voltage follower circuit (a buffer circuit) in the display unit according to the embodiment 2.

In the display unit of the embodiment 2, as illustrated by a conceptual diagram of a circuit configuring the display unit in FIG. 5, the control pulse line PSL is provided with voltage follower circuits (buffer circuits) 13 that are provided at predetermined intervals (for every predetermined number of pixels). Incidentally, all pixels in one line in the second direction are connected to the control pulse PSL. FIG. 6B illustrates a circuit diagram of the voltage follower circuit (the buffer circuit) 13. With this configuration, waveform shaping of the control pulse LCP to be transmitted through the control pulse line PSL is performed, thus making waveform dullness difficult to occur. In other words, it is possible to minimize deterioration of the sawtooth waveform caused by the impedance of the control pulse line PSL. For example, one voltage follower circuit 13 may be provided for every ten to twenty pixels (pixels arranged in the row direction) in one line in the second direction. Except for the above-described points, the configuration and the structure of the display unit of the embodiment 2 are similar to those of the display unit described in the embodiment 1, and thus detailed description thereof will be omitted.

Embodiment 3

Embodiment 3 is a modification of any of the embodiments 1 and 2.

Figure 7A:
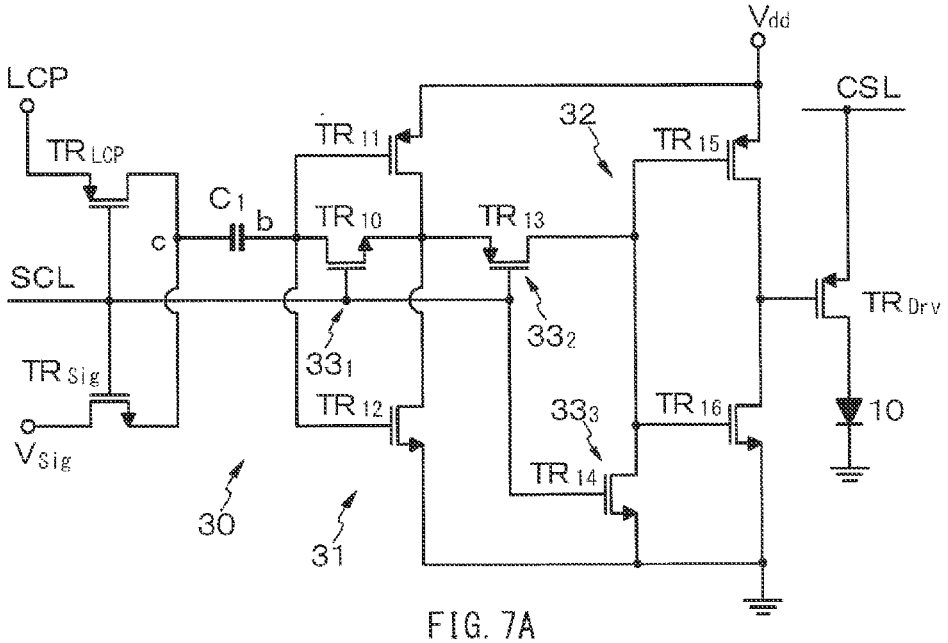
FIG. 7A and FIG. 7B are equivalent circuit diagrams of a pixel configured of a light emitting section and a drive circuit including a chopper type comparator device in a display unit according to embodiment 3 and embodiment 5, respectively.

In the embodiment 3, a comparator device is configured of the comparator device having the second configuration, and is a chopper type comparator device whose equivalent circuit diagram is illustrated in FIG. 7A.

As illustrated in FIG. 7A, the chopper type comparator device includes a comparison section that is configured of the signal write transistor $TR_{Sig}$, a control pulse transistor $TR_{LCP}$, a capacitor $C_1$, and an inverter circuit 30. The chopper type comparator device uses a power source $V_{dd}$ on a high potential side and a power source on a low potential side (in the embodiment 3, ground GND), as an operation power source.

As described above, the signal write transistor $TR_{Sig}$ is configured of an n-channel field effect transistor, and receives the signal voltage (the emission intensity signal) $V_{Sig}$. The control pulse transistor $TR_{LCP}$ is configured of a p-channel field effect transistor whose conductive type is opposite to that of the signal write transistor $TR_{Sig}$, and receives the control pulses LCP having a sawtooth voltage variation.

The signal write transistor $TR_{Sig}$ and the control pulse transistor $TR_{LCP}$ each perform ON-OFF operation according to a logic (level) of the scan signal that is supplied from the scan circuit 102 (see FIG. 1A) through the scan line SCL. As described above, the signal write transistor $TR_{Sig}$ and the control pulse transistor $TR_{LCP}$ are configured of transistors having conductive types opposite to each other, thereby performing ON-OFF operation with use of signals having inverse phases (inverse logic) from each other.

A first end of the capacitor $C_1$ is connected to a second end of the signal write transistor $TR_{SIG}$ and a second end of the control pulse transistor $TR_{LCP}$, namely, is connected to a source electrode of the n-channel signal write transistor $TR_{SIG}$ and a drain electrode of the p-channel control pulse transistor $TR_{LCP}$. The capacitor $C_1$ retains a potential based on the signal voltage $V_{Sig}$ in response to operation of the signal write transistor $TR_{Sig}$.

An input end (an input node) of the inverter circuit 30 is connected to a second end of the capacitor C1. The inverter circuit 30 has a configuration in which, for example, inverters are connected in two-stage cascade. An output end (an output node) of the inverter circuit 30 is connected to a gate electrode of the light emitting section driving transistor $TR_{Drv}$.

The first stage of the inverter circuit 30 is configured of a CMOS inverter 31. The CMOS inverter 31 in the first stage is configured of a p-channel field effect transistor $TR_{11}$ and an n-channel field effect transistor $TR_{12}$ that are connected in series between the power source $V_{dd}$ on the high potential side and the power source GND on the low potential side. Gate electrodes of the p-channel field effect transistor $TR_{11}$ and the n-channel field effect transistor $TR_{12}$ are commonly connected. For example, an n-channel field effect transistor $TR_{10}$ is provided between an input end (an input node) and an output end (an output node) of the CMOS inverter 31 in the first stage, as a first switch section $\mathbf{33}_1$ that selectively short-circuits or opens between the input end and the output end. The first switch $\mathbf{33}_1$ performs ON (short-circuit)-OFF (open) operation according to the logic (level) of the scan signal supplied through the scan line SCL.

A second stage of the inverter circuit 30 is configured of a CMOS inverter 32. The CMOS inverter 32 in the second stage is configured of a p-channel field effect transistor $TR_{15}$ and an n-channel field effect transistor $TR_{16}$ that are connected in series between the power source $V_{dd}$ on the high potential side and the power source GND on the low potential side. The gate electrodes of the p-channel field effect transistor $TR_{15}$ and the n-channel field effect transistor $TR_{16}$ are commonly connected.

For example, a p-channel field effect transistor $TR_{13}$ is provided between the output end of the CMOS inverter 31 in the first stage and an input end of the CMOS inverter 32 in the second stage, as a second switch section $\mathbf{33}_2$ that selectively short-circuits or opens between the output end of the CMOS inverter 31 and the input end of the CMOS inverter 32. The second switch section $\mathbf{33}_2$ performs ON (short-circuit)-OFF (open) operation according to the logic (level) of the scan signal supplied through the scan line SCL. The first switch section $\mathbf{33}_1$ and the second switch section $\mathbf{33}_2$ are configured of transistors having conductive types opposite to each other, thereby performing the ON-OFF operation with use of signals having inverse phases (inverse logic) from each other.

For example, an n-channel field effect transistor $TR_{14}$ is provided between the input end of the CMOS inverter 32 in the second stage and the power source GND on the low potential side, as a third switch section $\mathbf{33}_3$ that selectively grounds the input end of the CMOS inverter 32 in the second stage. The third switch section $\mathbf{33}_3$ performs ON (ground)-OFF (open) operation according to the logic (level) of the scan signal supplied through the scan line SCL. The second switch section $\mathbf{33}_2$ and the third switch section $\mathbf{33}_3$ are configured of transistors having conductive types opposite to each other, thereby performing ON-OFF operation with use of signals having inverse phases (inverse logic) from each other.

An output end of the CMOS inverter 32 in the second stage, namely, the output end of the inverter circuit 30 serves as the output end of the chopper type comparator device in the embodiment 3. This output end is connected with the gate electrode of the light emitting section drive transistor $TR_{Drv}$. When the first predetermined voltage (L) is output from the inverter circuit 30, the light emitting section drive transistor $TR_{Drv}$ is turned on and supplies a current to the light emitting section 10. The light emitting section 10 emits light by the drive of the light emitting section drive transistor $TR_{Drv}$.

Figure 9:
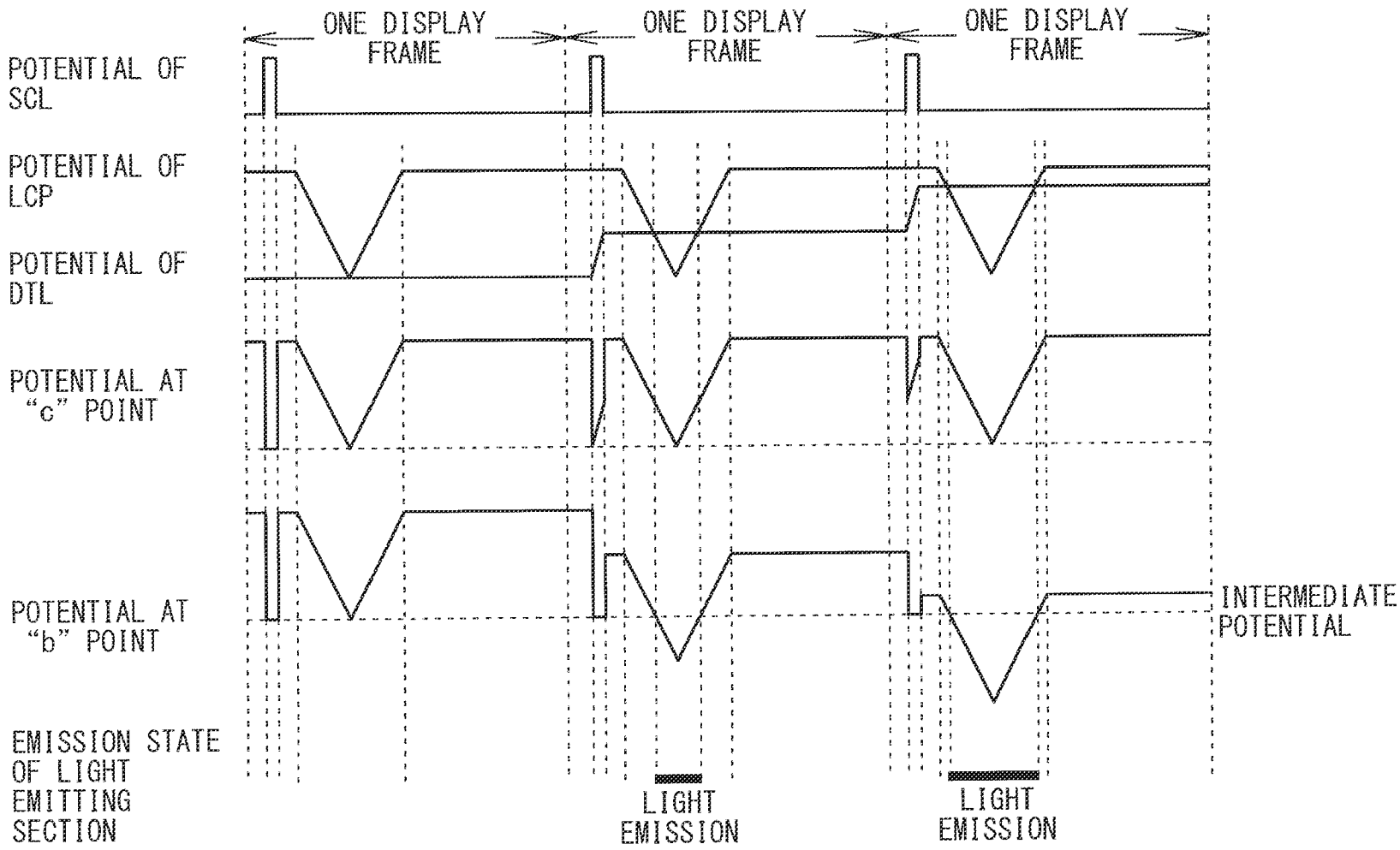
FIG. 9 is a timing waveform chart for explaining operation of the chopper type comparator device in the display unit according to the embodiment 3.
Figure 10:
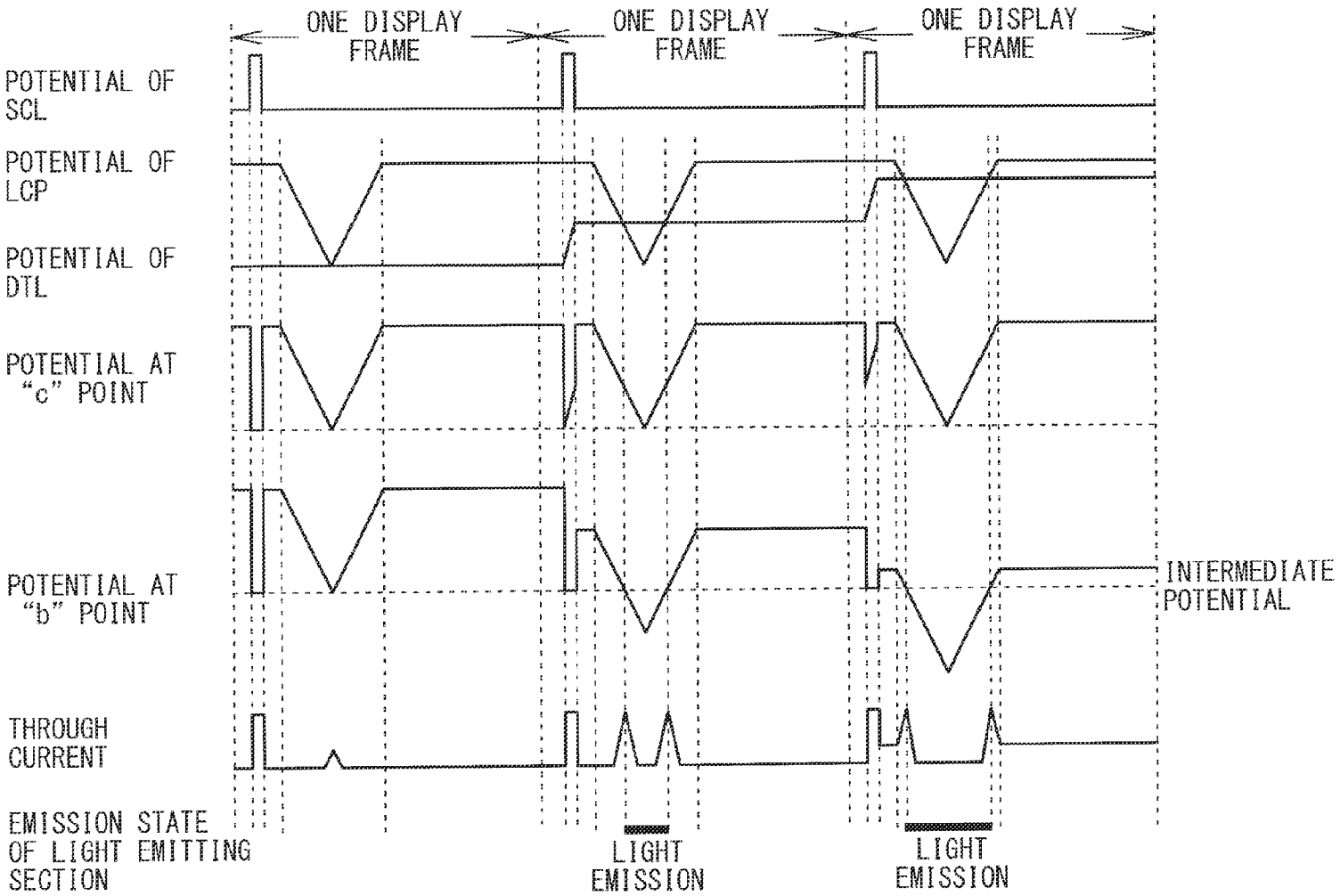
FIG. 10 is a timing waveform chart for explaining an issue of the chopper type comparator device in the display unit according to the embodiment 3.

The operation of the chopper type comparator device having the above-described configuration is described with use of a timing waveform chart in FIG. 9. FIG. 9 illustrates the potential of the scan line SCL (the potential of the scan signal), the potential of the control pulse LCP, the potential of the data line DTL (the potential of the signal voltage $V_{Sig}$), the potential at "c" point (the first end of the capacitor $C_1$), the potential at "b" point (the second end of the capacitor $C_1$), and the emission state of the light emitting section 10. For easier understanding, operation of one pixel in one pixel block is described. In addition, in FIG. 9, only one control pulse LCP is illustrated in one display frame for convenience.

First, during a period in which the potential of the scan line SCL is at high level, the signal write transistor $TR_{Sig}$, the first switch section $\mathbf{33}_1$, and the third switch section $\mathbf{33}_3$ are put into an ON state, and the control pulse transistor $TR_{LCP}$ and the second switch section $\mathbf{33}_2$ are put into an OFF state. Then, the potential of the data line DTL (the potential of the signal voltage $V_{Sig}$) is taken up by the signal write transistor $TR_{Sig}$ to be applied to the capacitor $C_1$, and therefore the potential at "c" point becomes the potential of the data line DTL. In addition, the input end and the output end of the CMOS inverter 31 in the first stage are short-circuited by the first switch section $\mathbf{33}_k$. Therefore, the potential at "b" point becomes the threshold (inversion level) of the CMOS inverter 31 in the first stage, namely, becomes an intermediate potential between the power source $V_{dd}$ on the high potential side and the power source GND on the low potential side. As a result, charge corresponding to the potential of the data line DTL, namely, charge corresponding to the potential based on the signal voltage $V_{Sig}$ is accumulated in the capacitor $C_1$.

Next, during a period in which the potential of the scan line SCL is at low level, the signal write transistor $TR_{Sig}$, the first switch section $\mathbf{33}_1$, and the third switch section $\mathbf{33}_3$ are put into the off state, and the control pulse transistor $TR_{LCP}$ and the second switch section $\mathbf{33}_2$ are put into the on state. Then, the potential of the control pulse LCP is taken up by the control pulse transistor $TR_{LCP}$ to be applied to the capacitor $C_1$, and thus the potential at "c" point becomes the potential of the control pulse LCP. At this time, the potential of the control pulse LCP is applied to the capacitor $C_1$ in which the charge corresponding to the potential based on the signal voltage $V_{Sig}$ has been accumulated so that the potential at "b" point, namely, the input voltage of the CMOS inverter 31 in the first stage becomes a differential voltage between the potential based on the signal voltage $V_{Sig}$ and the potential of the control pulse LCP.

The differential voltage between the potential based on the signal voltage $V_{Sig}$ and the potential of the control pulse LCP is inverted by the CMOS inverter 31 in the first stage, and is further inverted by the CMOS inverter 32 in the second stage due to the on-state of the second switch section $\mathbf{33}_2$. The resultant differential voltage is output as the first predetermined voltage (L) to be applied to the gate electrode of the light emitting section drive transistor $TR_{Drv}$. Then, drive of the light emitting section 10 is performed by the control of the light emitting section drive transistor $TR_{Drv}$ based on the first predetermined voltage. As a result, during a period in which the potential at "b" point is lower than the intermediate potential that is the threshold of the CMOS inverter 31 in the first stage, the light emitting section 10 emits light.

Embodiment 4

Embodiment 4 is also a modification of any of the embodiments 1 and 2. In the embodiment 4, a comparator device is configured of the comparator device having the third configuration, and is a differential comparator device whose equivalent circuit diagram is illustrated in FIG. 8A.

Figure 8A:
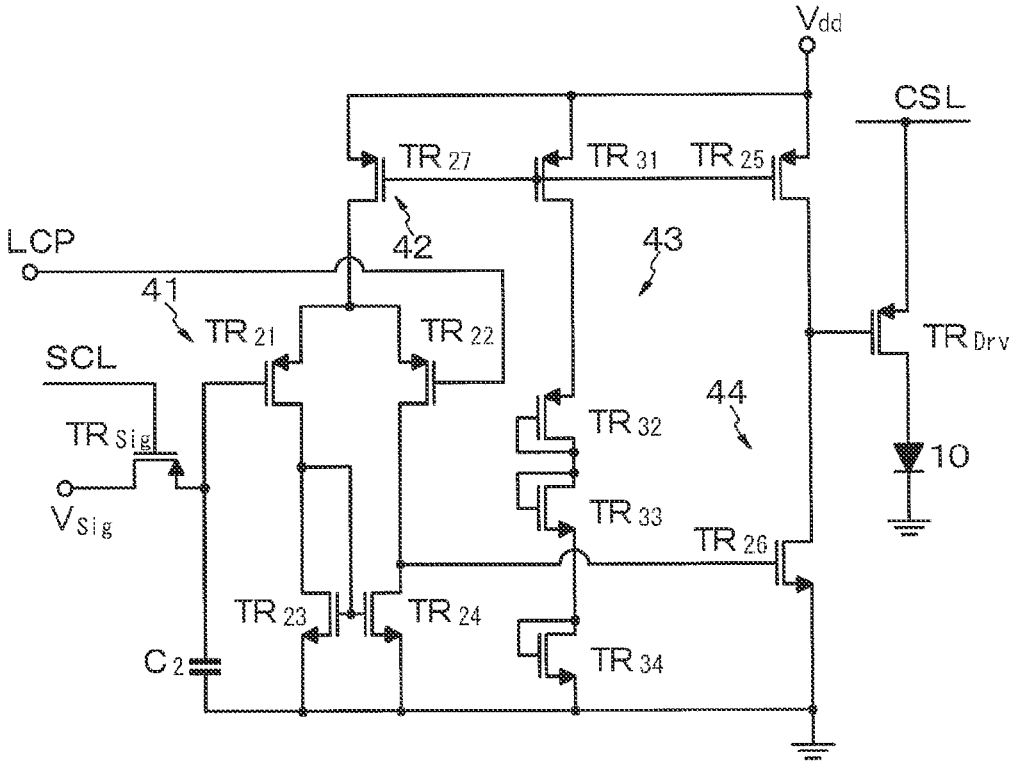
FIG. 8A and FIG. 8B are equivalent circuit diagrams of a pixel configured of a light emitting section and a drive circuit including a differential comparator device in a display unit according to embodiment 4 and the embodiment 5, respectively.

As illustrated in FIG. 8A, the differential comparator device in the embodiment 4 includes a comparison section that includes: the signal write transistor $TR_{Sig}$ that is configured to receive the signal voltage (the emission intensity signal) $V_{Sig}$; a capacitor $C_2$ that is connected to the signal write transistor $TR_{Sig}$ and configured to retain the potential based on the signal voltage $V_{Sig}$ in response to operation of the signal write transistor $TR_{Sig}$; a differential circuit 41 that is configured to receive, as two inputs, the signal voltage $V_{Sig}$ from the signal write transistor $TR_{Sig}$ and the control pulse LCP; and a constant current source 42 that is configured to supply a constant current to the differential circuit 41. The differential comparator device in the embodiment 4 uses the power source $V_{dd}$ on the high potential side and the power source on the low potential side (in the embodiment 4, the ground GND), as an operation power source.

The differential circuit 41 may be configured of, for example, p-channel field effect transistors (differential pair transistors) $TR_{21}$ and $TR_{22}$ whose respective source electrodes are commonly connected to perform differential operation, and n-channel field effect transistors $TR_{23}$ and $TR_{24}$ that configure a current mirror circuit as an active load.

The n-channel field effect transistor $TR_{23}$ has a drain electrode and a gate electrode that are connected to a drain electrode of the p-channel field effect transistor $TR_{21}$, and a source electrode connected to the power source GND on the low potential side. The n-channel field effect transistor $TR_{24}$ has a gate electrode connected to the gate electrode of the n-channel field effect transistor $TR_{23}$, a drain electrode connected to a drain electrode of the p-channel field effect transistor $TR_{22}$, and a source electrode connected to the power source GND on the low potential side.

The signal voltage $V_{Sig}$ is taken up by the signal write transistor $TR_{Sig}$ according to the scan signal supplied from the scan circuit 102 (see FIG. 1A) through the scan line SCL. In this case, the p-channel field effect transistor is used as the signal write transistor $TR_{Sig}$. The potential based on the signal voltage $V_{Sig}$ taken up by the signal write transistor $TR_{Sig}$ is retained in the capacitor $C_2$.

The capacitor $C_2$ is connected between the gate electrode of the p-channel field effect transistor $TR_{21}$ and the power source GND on the low potential side. The potential based on the signal voltage $V_{Sig}$ retained in the capacitor $C_2$ is applied to the gate electrode of the p-channel field effect transistor $TR_{21}$. In addition, the control pulses LCP having a sawtooth voltage variation is applied to the gate electrode of the p-channel field effect transistor $TR_{22}$.

The constant current source 42 may be configured of, for example, a p-channel field effect transistor $TR_{27}$. A constant voltage generated by a constant voltage circuit 43 is applied to a gate electrode of the p-channel field effect transistor $TR_{27}$ so that the constant current source 42 supplies a constant current to the differential circuit 41. For example, the constant voltage circuit 43 is configured of p-channel field effect transistors $TR_{31}$ and $TR_{32}$ and n-channel field effect transistors $TR_{33}$ and $TR_{34}$ that are connected in series between the power source $V_{dd}$ on the high potential side and the power source GND on the low potential side. Incidentally, the p-channel field effect transistor $TR_{32}$ and the n-channel field effect transistors $TR_{33}$ and $TR_{34}$ each have a diode connection configuration in which the gate electrode and the drain electrode are commonly connected.

In the differential circuit 41, a common connection point (node) of the drain electrode of the p-channel field effect transistor $TR_{22}$ and the drain electrode of the n-channel field effect transistor $TR_{24}$ serves as an output end (an output node). The output end of the differential circuit 41 is connected with an input end of a source grounding circuit 44. The source grounding circuit 44 is configured of a p-channel field effect transistor $TR_{25}$ and an n-channel field effect transistor $TR_{26}$ that are connected in series between the power source $V_{dd}$ on the high potential side and the power source GND on the low potential side. A constant voltage is applied from the constant voltage circuit to a gate electrode of the p-channel field effect transistor $TR_{25}$, and a gate electrode of the n-channel field effect transistor $TR_{26}$ is connected to the output end of the differential circuit 41.

A common connection point (node) of a drain electrode of the p-channel field effect transistor $TR_{25}$ and a drain electrode of the n-channel field effect transistor $TR_{26}$ serves as an output end (an output node) of the differential comparator device in the embodiment 4. The output end is connected with the gate electrode of the light emitting section drive transistor $TR_{Drv}$. When the first predetermined voltage (L) is output from the source grounding circuit 44, the light emitting section drive transistor $TR_{Drv}$ is turned on to supply a current to the light emitting section 10. The light emitting section 10 emits light by the drive of the light emitting section drive transistor $TR_{Drv}$.

Embodiment 5

Embodiment 5 is a modification of any of the embodiments 3 and 4. In the chopper type comparator device, as illustrated in a third display frame in a timing waveform chart of FIG. 10, the potential at "b" point during white display is constantly at near an inversion level (intermediate potential) of the CMOS inverter 31 in the first stage. Therefore, when it is unnecessary to operate the comparator device, namely, in a high level interval of the control pulse LCP (interval in which the sawtooth voltage exceeds the threshold voltage), a through current flows through the field effect transistors $TR_{11}$ and $TR_{12}$ that configure the CMOS inverter 31 in the first stage. Incidentally, in the timing waveform chart of FIG. 10, a first display frame indicates a potential relationship during black display. In addition, FIG. 10 or FIG. 11 described later each illustrate the potential of the scan line SCL (the potential of the scan signal), the potential of the control pulse LCP, the potential of the data line DTL (the potential of the signal voltage $V_{Sig}$), the potential at "c" point (the first end of the capacitor $C_1$), the potential at "b" point (the second end of the capacitor $C_1$), the through current, and the emission state of the light emitting section 10.

The issue about the through current may occur not only in the chopper type comparator device but also in the differential comparator device. In other words, in the case of the differential comparator device, the through current constantly flows because the constant current source 42 is used.

In the embodiment 5, operation and non-operation of the comparator device is controlled by the control pulses LCP. This makes it possible to reduce the dark current or the through current flowing through the drive circuit 11. Specifically, in the embodiment 5, as the comparator device, the chopper type comparator device whose equivalent circuit diagram is illustrated in FIG. 7B or the differential comparator device whose equivalent circuit diagram is illustrated in FIG. 8B is used.

Figure 7B:
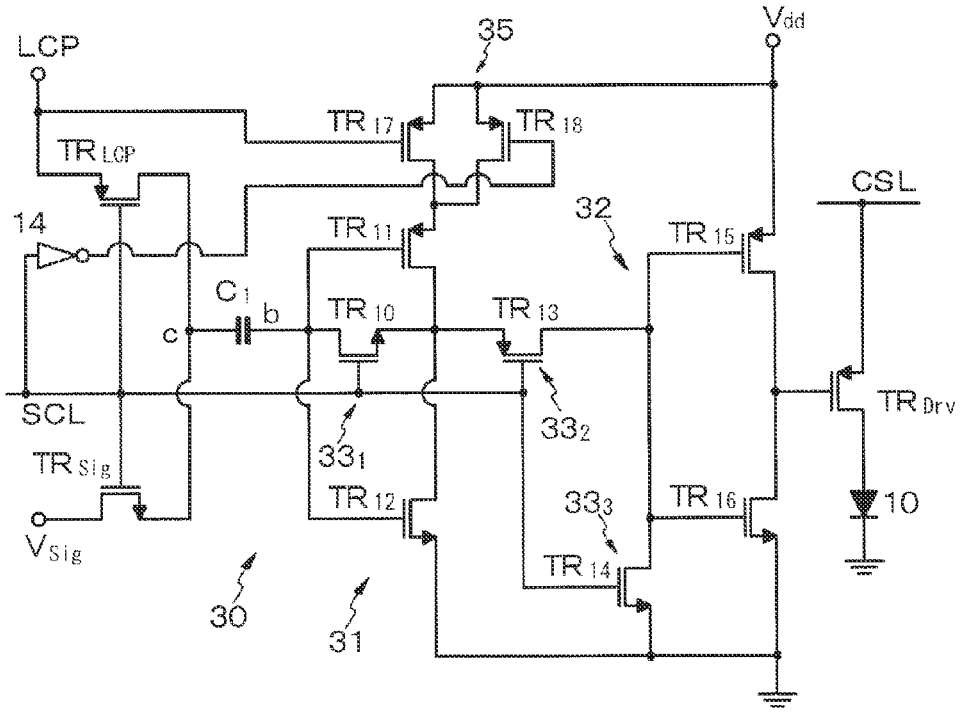
Figure 8B:
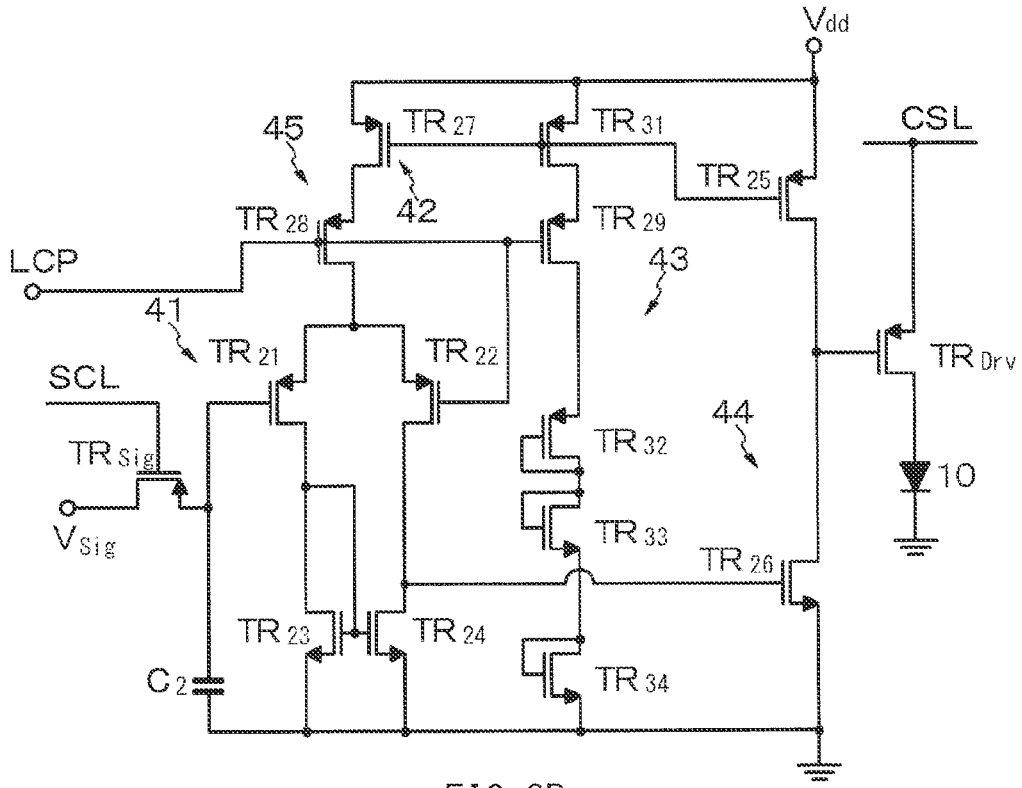

As illustrated in FIG. 7B, the chopper type comparator device in the embodiment 5 has a control section 35 that is configured to control operation and non-operation of the comparator device with use of the control pulses LCP, in addition to the components of the chopper type comparator device in the embodiment 3. The control section 35 controls operation and non-operation of the comparison section, in particular, of the inverter circuit 30, to control operation and non-operation of the comparator device.

The control section 35 may have, for example, a p-channel field effect transistor $TR_{17}$ as a switch circuit (for convenience, referred to as "first switch circuit"). The p-channel field effect transistor $TR_{17}$ is connected in series to the inverter circuit 30, more specifically, to the CMOS inverter 31 in the first stage, and performs ON-OFF operation according to a sawtooth voltage of the control pulses LCP. The p-channel field effect transistor $TR_{17}$ is turned off when it is unnecessary to operate the comparator device, namely, in a high level interval of the control pulses LCP (the interval in which the sawtooth voltage exceeds the threshold voltage). The p-channel field effect transistor $TR_{17}$ thus disconnects the CMOS converter 31 in the first stage from the power source $V_{dd}$ on the high potential side so as not to operate the comparator device.

In this case, it is sufficient for the amplitude of the sawtooth waveform of the control pulses LCP to be within a variable range of the signal voltage (the emission intensity signal) $V_{Sig}$, and an absolute value of the potential thereof is optional. Therefore, in the example illustrated in FIG. 7B, the potential in the high level interval of the control pulses LCP is set to be substantially the potential of the power source $V_{dd}$, and the p-channel field effect transistor $TR_{17}$ is turned off in the high level interval of the control pulses LCP to disconnect the CMOS inverter 31 in the first stage from the power source $V_{dd}$.

On the other hand, even in the high level interval of the control pulse LCP, it is necessary to operate the comparator device when the scan signal supplied through the scan line SCL is at high level. Therefore, the control section 35 may have, for example, a p-channel field effect transistor $TR_{18}$ as a second switch circuit, in addition to the p-channel field effect transistor $TR_{17}$. The p-channel field effect transistor $TR_{18}$ is connected in parallel to the p-channel field effect transistor $TR_{17}$ that configures the first switch circuit. The scan signal is applied to a gate electrode of the p-channel field effect transistor $TR_{18}$ through an inverter 14. As a result, the p-channel field effect transistor $TR_{18}$ configuring the second switch circuit is turned on to connect the CMOS inverter 31 in the first stage to the power source $V_{dd}$ when the scan signal becomes at high level.

Figure 11:
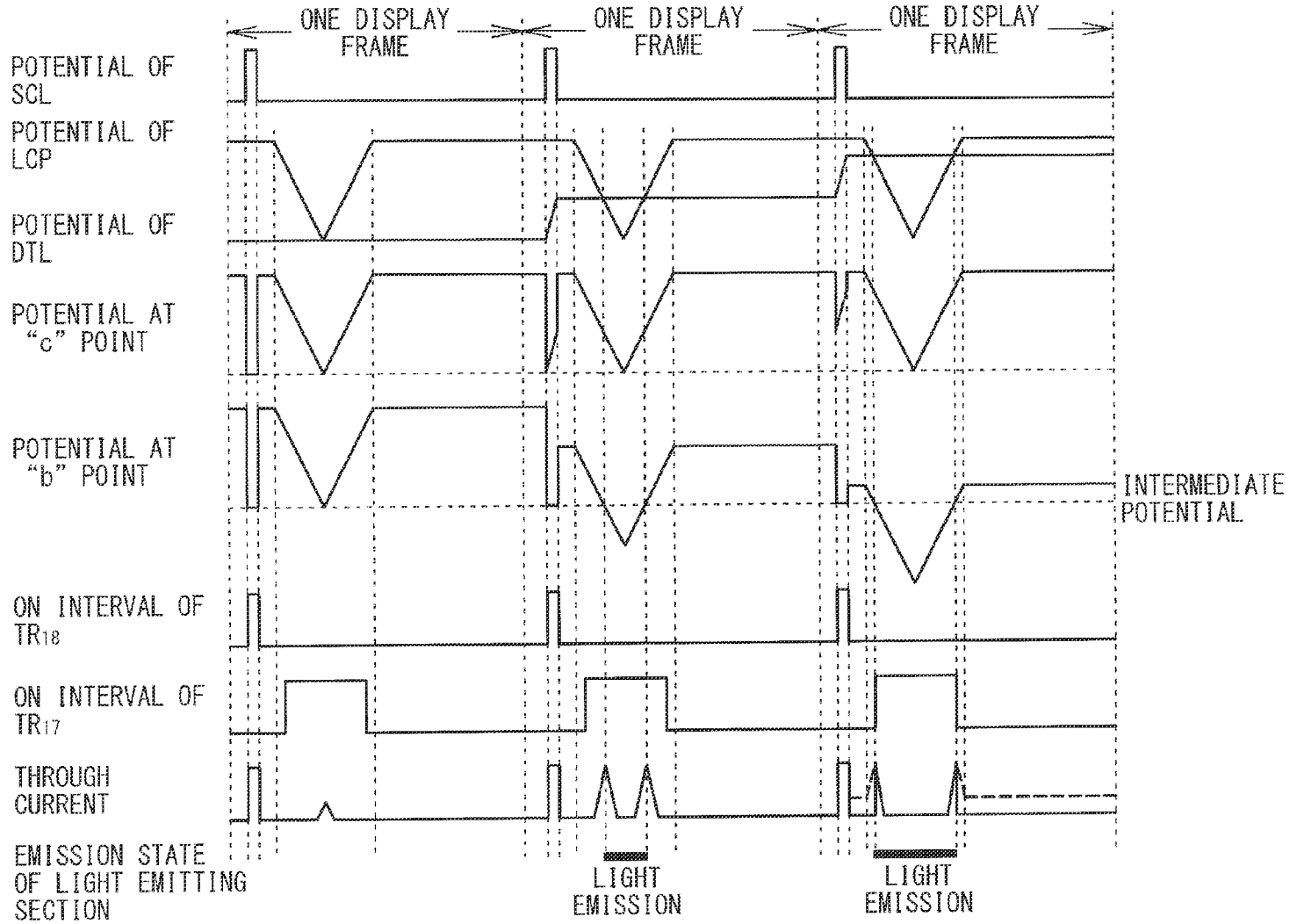
FIG. 11 is a timing waveform chart for explaining operation of the chopper type comparator device in the display unit according to the embodiment 5.

The operation of the chopper type comparator device having the above-described configuration in the embodiment 5 is described with use of a timing waveform chart of FIG. 11, focusing on a third display frame during white display.

As described above, the potential at "b" point during white display is constantly at near the inversion level (the intermediate potential) of the CMOS inverter 31 in the first stage. On the other hand, the first switch circuit (the p-channel field effect transistor $TR_{17}$) configuring the control section 35 is turned off in the interval where the sawtooth waveform voltage of the control pulses LCP exceeds the threshold voltage, to disconnect the CMOS inverter 31 in the first stage from the power source $V_{dd}$, thereby not operating the comparator device. As a result, when it is unnecessary to operate the comparator device, it is possible to prevent the through current from flowing through the CMOS inverter 31 in the first stage. Incidentally, in the case where the comparator device is not in the non-operation state, as denoted by a dashed line in FIG. 11, the through current flows through the field effect transistors $TR_{11}$ and $TR_{12}$ that configure the CMOS inverter 31 in the first stage.

When the scan signal supplied through the scan lien SCL becomes high level, the second switch circuit (the p-channel field effect transistor $TR_{18}$) configuring the control section 35 is turned on in response to the inversion signal of the scan signal through the inverter 14. Accordingly, the CMOS inverter 31 in the first stage is connected to the power source $V_{dd}$ on the high potential side through the second switch circuit (the p-channel field effect transistor $TR_{18}$), and thus the comparator device is put into an operation state. As a result, even in the high level interval of the control pulse LCP, it is possible to ensure that the comparator device is put into an operation state when it is necessary to operate the comparator device.

In the case where the differential comparator device is used as the comparator device, the differential comparator device has a control section 45 that is configured to control operation and non-operation of the comparison section including the differential circuit 41 and the constant current source 42, with use of the control pulse LCP as illustrated in FIG. 8B.

The control section 45 may include, for example, a p-channel field effect transistor $TR_{28}$ as a switch circuit (referred to as a "third switch circuit" in order to distinguish this switch circuit from the switch circuit configuring the control section 35, for convenience). The p-channel field effect transistor $TR_{28}$ is connected in series to the constant current source 42, and performs ON-OFF operation according to the sawtooth voltage of the control pulses LCP. The p-channel field effect transistor $TR_{28}$ configuring the third switch circuit is turned off to block the current supply path to the differential circuit 41 when it is unnecessary to operate the comparator device, namely, in the high level interval of the control pulses LCP.

In this case, although the configuration in which the p-channel field effect transistor $TR_{28}$ configuring the third switch circuit is inserted in series to the constant current source 42 on the differential circuit 41 side of the constant current source 42, the configuration in which the p-channel field effect transistor $TR_{28}$ is connected in series to the constant current source 42 on the power source $V_{dd}$ side of the constant current source 42 may be employed.

The control section 45 may further include, for example, a p-channel field effect transistor $TR_{29}$ as a second switch circuit (referred to as a "fourth switch circuit" in order to distinguish this second switch circuit from the second switch circuit configuring the control section 35, for convenience). The p-channel field effect transistor $TR_{29}$ is connected in series to the constant voltage circuit 43 that applies a constant voltage to the gate electrode of the p-channel field effect transistor $TR_{27}$ configuring the constant current source 42. In addition, the p-channel field effect transistor $TR_{29}$ performs ON-OFF operation according to the sawtooth voltage of the control pulses LCP. The p-channel field effect transistor $TR_{29}$ configuring the fourth switch circuit is turned off in the high level interval of the control pulse LCP, to block the current supply path of the constant voltage circuit 43, as with the p-channel field effect transistor $TR_{28}$ configuring the third switch circuit.

As described above, even in the case where the differential comparator device is used as the comparator device, the current supply path to the differential circuit 41 and the current supply path to the constant voltage circuit 43 are blocked in the high level interval of the control pulse LCP, to prevent the comparator device from operating, which makes it possible to ensure that the through current is prevented from flowing.

Embodiment 6

Figure 12:
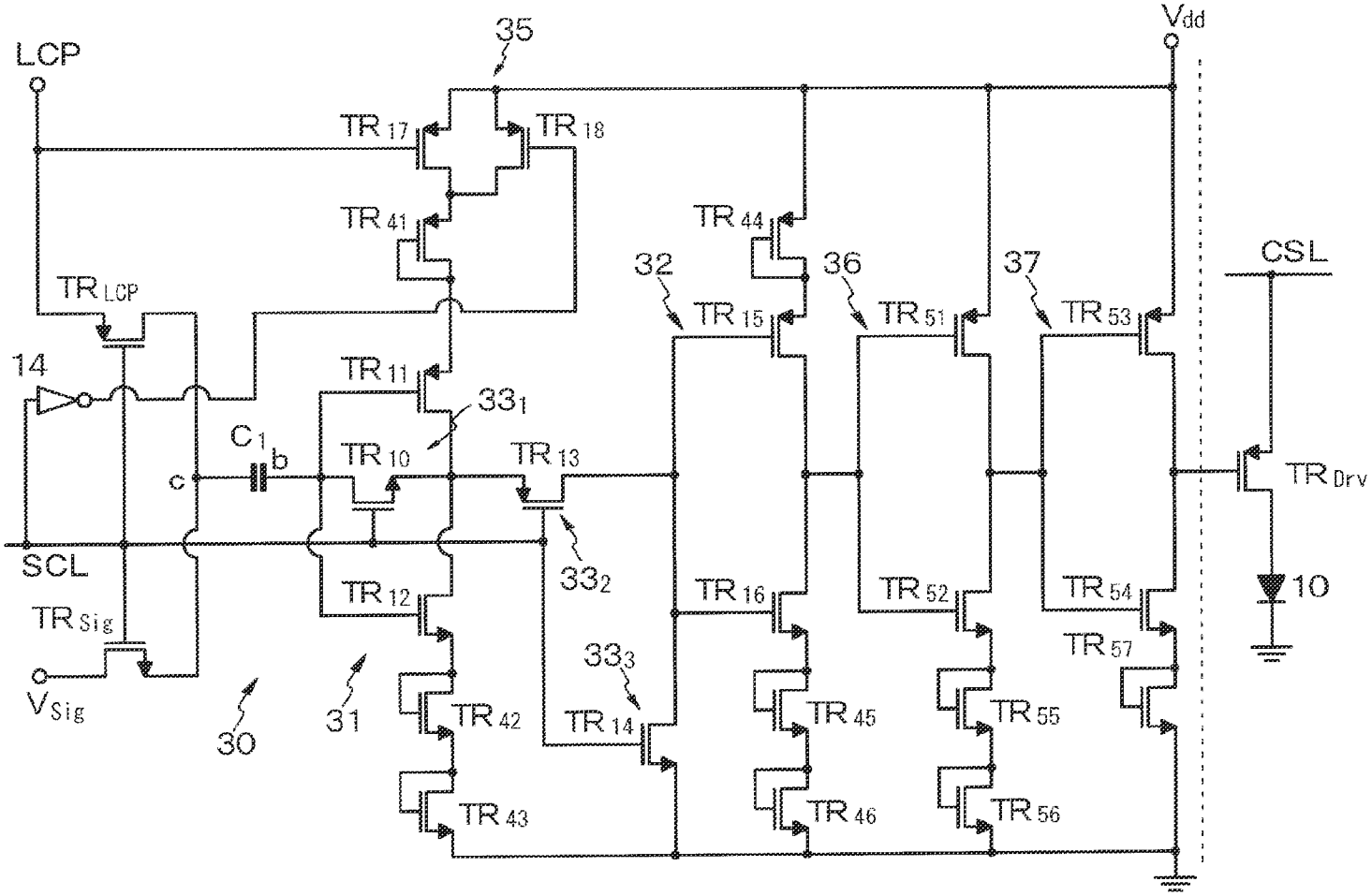
FIG. 12 is an equivalent circuit diagram of a pixel configured of a light emitting section and a drive circuit including a chopper type comparator device in a display unit according to embodiment 6.

Embodiment 6 is a modification of the embodiment 5. In the embodiment 6, a resistance element is connected in series to the inverter circuit 30 in the chopper type comparator device in the embodiment 5. As a result, it is possible to suppress the through current flowing in intervals other than the high level interval of the control pulse, thereby further reducing the dark current or the through current flowing through the drive circuit 11. Specifically, in the embodiment 6, a chopper type comparator device whose equivalent circuit diagram is illustrated in FIG. 12 is used as the comparator device.

In the chopper type comparator device in the embodiment 6, a field effect transistor having a diode-connected configuration in which a gate electrode and a drain electrode are commonly connected is used as the resistance element connected in series to the inverter circuit 30. As the resistance element, a diode device, a resistor, and the like may be used besides the field effect transistor having the diode-connected configuration.

In the inverter circuit 30, a p-channel field effect transistor $TR_{41}$ having the diode-connected configuration is connected in series to a side of the CMOS inverter 31 in the first stage closer to the power source $V_{dd}$ side on the high potential side, and n-channel field effect transistors $TR_{42}$ and $TR_{43}$ each having the diode-connected configuration are connected in series to a side thereof closer to the power source GND on the low potential side. A p-channel field effect transistor $TR_{44}$ having the diode-connected configuration and n-channel field effect transistors $TR_{45}$ and $TR_{46}$ each having the diode-connected configuration are also connected in series to the CMOS inverter 32 in the second stage, as with the CMOS inverter 31 in the first stage.

As described above, in the chopper type comparator device in the embodiment 6, it is possible to suppress the through current flowing in intervals other than the high level interval of the control pulse, in particular, during the inversion operation, in addition to achieving the functions and effects of the embodiment 5, by inserting the resistance element so as to be connected in series to the inverter circuit 30 to increase the resistance value of the circuit. However, when the resistance value of the circuit is increased, the output voltage of the inverter circuit 30 may not reach the power source $V_{dd}$ or the power source GND.

Therefore, in the chopper type comparator device in the embodiment 6, the inverter circuit 30 employs the configuration in which, for example, two stages of CMOS inverters 36 and 37 are added to the rear stage of the CMOS inverter 32 in the second stage. The CMOS inverter 36 in the third stage is configured of a p-channel field effect transistor $TR_{51}$ and an n-channel field effect transistor $TR_{52}$. The p-channel field effect transistor $TR_{51}$ and the n-channel field effect transistor $TR_{52}$ each have a gate electrode commonly connected, and are connected in series between the power source $V_{dd}$ on the high potential side and the power source GND on the low potential side. The CMOS inverter 37 in the fourth stage is also configured of a p-channel field effect transistor $TR_{53}$ and an n-channel field effect transistor $TR_{54}$. The p-channel field effect transistor $TR_{53}$ and the n-channel field effect transistor $TR_{54}$ each have a gate electrode commonly connected, and are connected in series between the power source $V_{dd}$ on the high potential side and the power source GND on the low potential side.

In the chopper type comparator device in the embodiment 6, a resistance element is connected in series to the CMOS inverter 36 in the third stage and the CMOS inverter 37 in the fourth stage. Therefore, the through current flowing through the CMOS inverter 36 in the third stage and the CMOS inverter 37 in the fourth stage is suppressed. More specifically, n-channel field effect transistors $TR_{55}$ and $TR_{56}$ each having the diode-connected configuration are connected, as resistance elements, in series to a side of the CMOS inverter 36 in the third stage closer to the power source GND on the low potential side. In addition, an n-channel field effect transistor $TR_{57}$ having the diode-connected configuration is connected, as a resistance element, in series to a side of the CMOS inverter 37 in the fourth stage closer to the power source GND on the low potential side.

Embodiment 7

Figure 13:
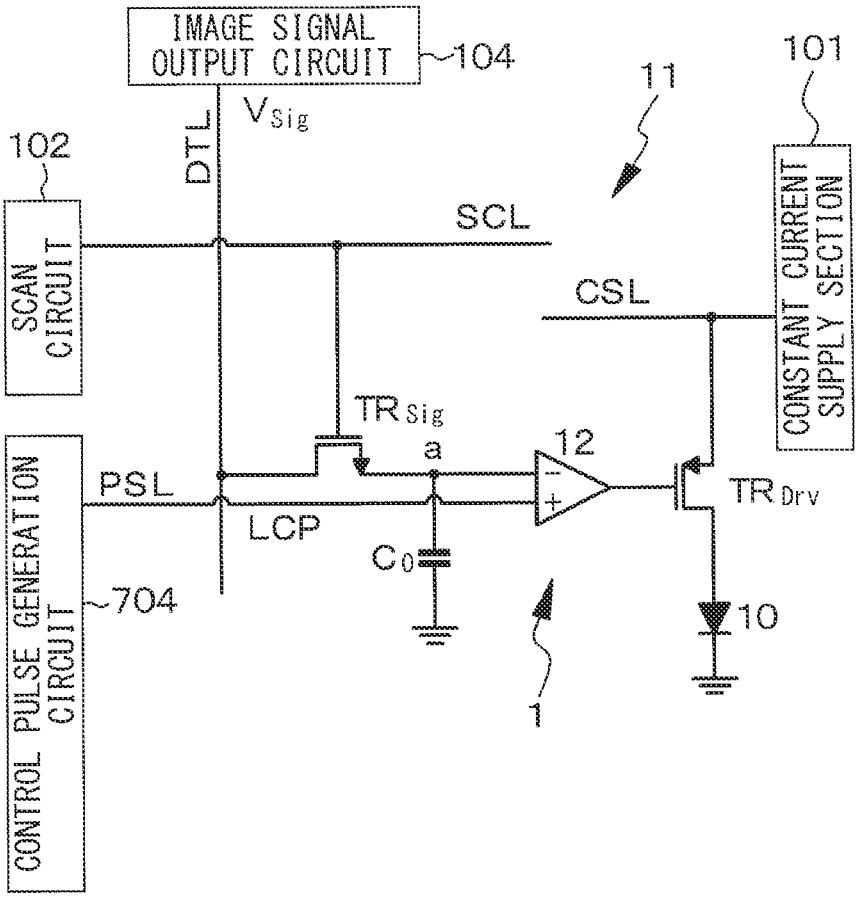
FIG. 13 is an equivalent circuit diagram of a pixel configured of a light emitting section and a drive circuit in a display unit according to embodiment 7.
Figure 14:
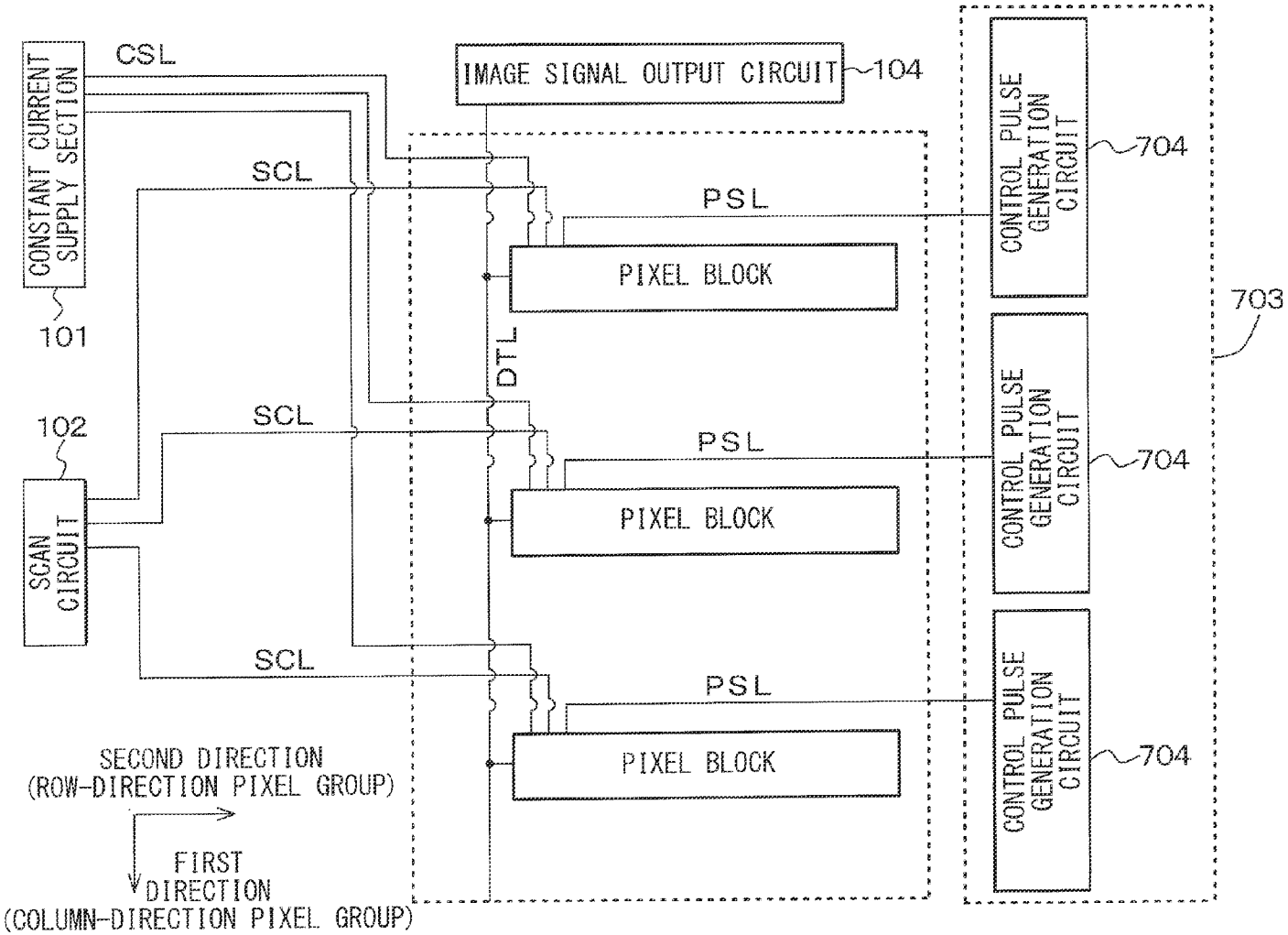
FIG. 14 is a conceptual diagram of a circuit configuring the display unit according to the embodiment 7.
Figure 15:
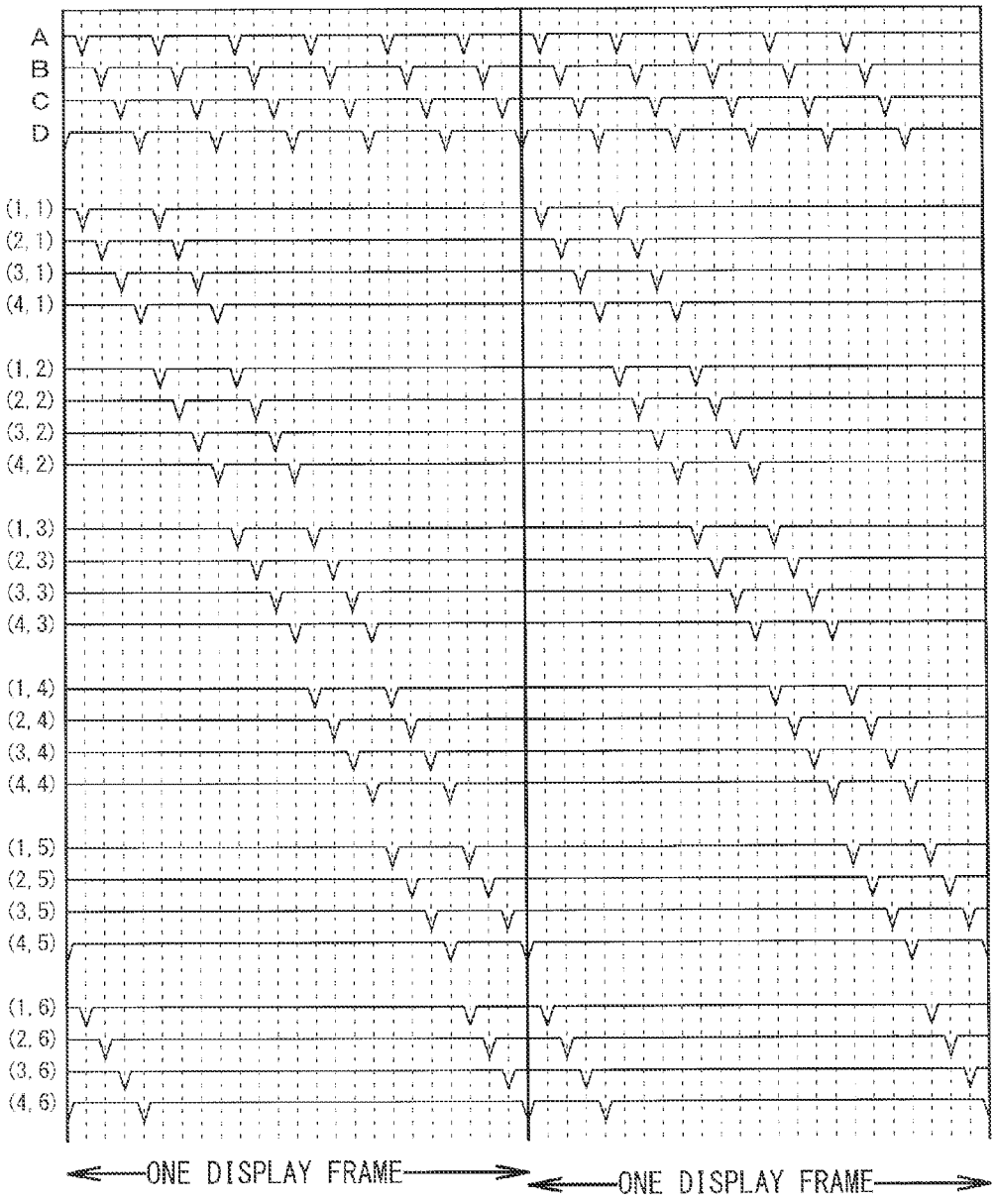
FIG. 15 is a diagram schematically illustrating supply of a plurality of control pulses to pixel blocks in the display unit according to the embodiment 7.
Figure 16:
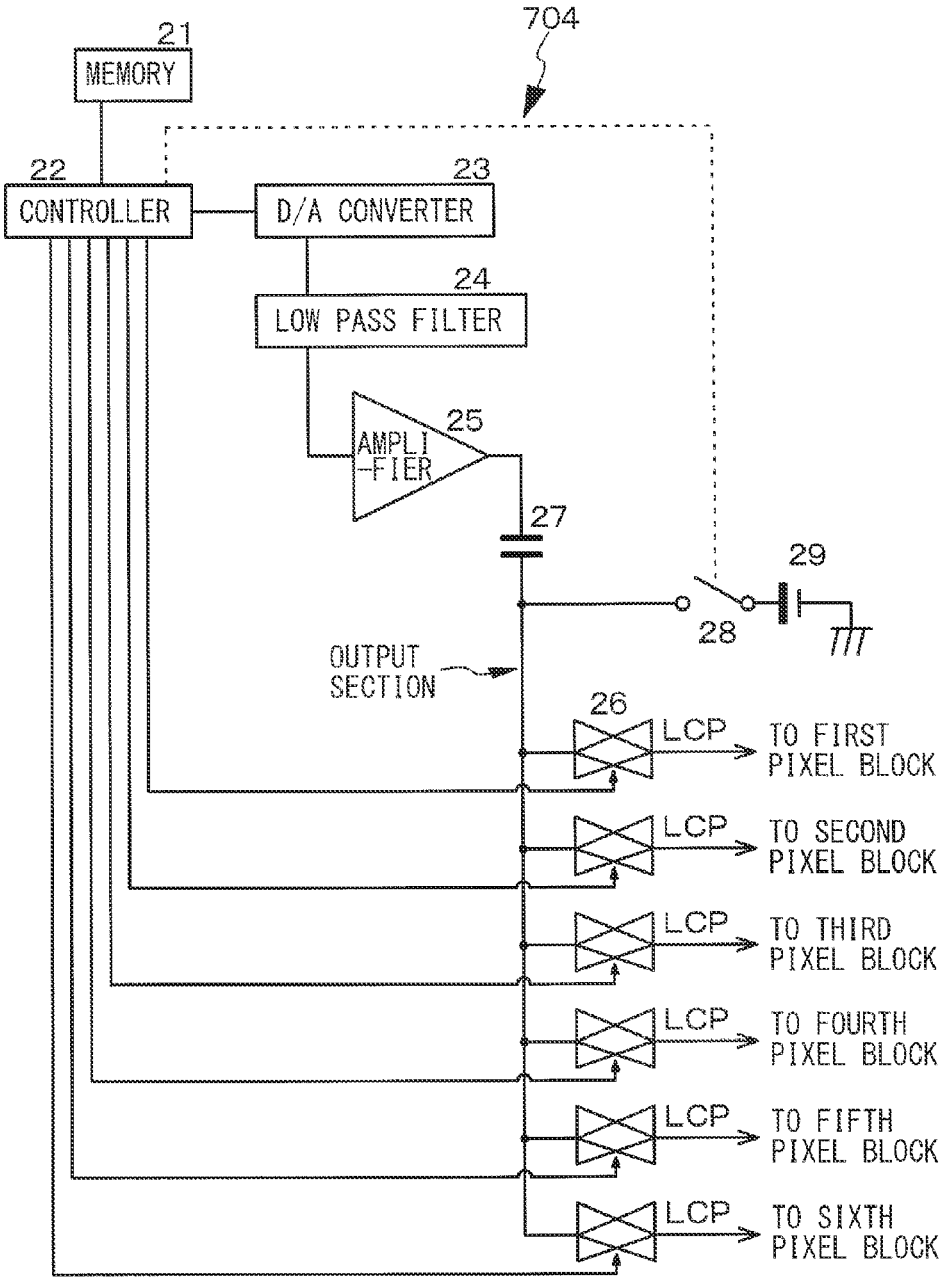
FIG. 16 is a conceptual diagram of a control pulse generation circuit in the display unit according to the embodiment 7.

Embodiment 7 relates to the display unit and the method of driving the display unit according to the second embodiment and the fourth embodiment (specifically, the fourth-A embodiment) of the present disclosure, and further relates to the control pulse generation device according to the second embodiment of the present disclosure. FIG. 13 is an equivalent circuit diagram of a pixel 1 configured of a light emitting section and a drive circuit in a display unit of the embodiment 7. In addition, FIG. 14 is a conceptual diagram of the circuit configuring the display unit of the embodiment 7. For simplification of the drawings, illustration of the pixel is omitted in FIG. 14, and three pixel blocks are illustrated. Further, FIG. 15 schematically illustrates supply of the plurality of control pulses to the pixel blocks in the display unit of the embodiment 7. FIG. 16 is a conceptual diagram of the control pulse generation circuit in the display unit of the embodiment 7.

To provide description based on the display unit or the method of driving the display unit according to the second embodiment of the present disclosure, the display unit of the embodiment 7, or the display unit in the method of driving the display unit of the embodiment 7 includes a pixel group having a plurality of pixels (more specifically, sub-pixels, and the same applies to the following) 1 arranged in a form of a two-dimensional matrix in the first direction and the second direction, and each of the pixels 1 includes the light emitting section 10 and the drive circuit 11 driving the light emitting section 10. The pixel group is divided into P pieces of pixel block groups along the first direction, and a p-th pixel block group is divided into $Q_p$ pieces of pixel blocks along the first direction, where $1 \leq p \leq P$.

Each drive circuit 11 includes: (a) the comparator device that is configured to compare the control pulses LCP with a potential that is based on the signal voltage $V_{Sig}$ to output a predetermined voltage based on a comparison result; and (b) the light emitting section drive transistor $TR_{Drv}$ that is configured to supply a current to the light emitting section 10 according to the predetermined voltage from the comparator device to allow the light emitting section 10 to emit light. Note that, specifically, the signal voltage $V_{Sig}$ is a picture signal voltage that controls emission state (luminance) of the pixel 1. Specifically, the comparator device has similar configuration and similar structure to the comparator device (the comparator device having the first configuration) described in the embodiment 1.

Further, the light emitting sections 10 from the light emitting sections 10 configuring the respective pixels 1 in a first pixel block of a first pixel block group to the light emitting sections 10 configuring the respective pixels 1 in $Q_P$-th pixel block of a P-th pixel block group are allowed to sequentially emit light together on a pixel block basis, and the light emitting sections 10 configuring the respective pixels 1 in some of the pixel blocks are allowed to emit light while the light emitting sections 10 configuring the respective pixels 1 in the remaining pixel blocks are not allowed to emit light.

In addition, to provide description based on the display unit or the method of driving the display unit according to the fourth embodiment of the present disclosure, the display unit of the embodiment 7, or the display unit in the method of driving the display unit of the embodiment 7 includes a pixel group having a plurality of pixels 1 arranged in a form of a two-dimensional matrix in the first direction and the second direction, and each of the pixels 1 includes the light emitting section 10 and the drive circuit 11 allowing the light emitting section 10 to emit light for a time corresponding to the potential based on the signal voltage $V_{Sig}$. The pixel group is divided into P pieces of pixel block groups along the first direction. A p-th pixel block group is divided into $Q_p$ pieces of pixel blocks along the first direction, where $1 \leq p \leq P$. In this case, for example, the drive circuit 11 may include the comparator device having the similar configuration and similar structure to that described in the embodiment 1.

Further, the light emitting sections 10 from the light emitting sections 10 configuring the respective pixels 1 in a first pixel block of a first pixel block group to the light emitting sections 10 configuring the respective pixels 1 in $Q_P$-th pixel block of a P-th pixel block group are allowed to sequentially emit light together on a pixel block basis, and the light emitting sections 10 configuring the respective pixels 1 in some of the pixel blocks are allowed to emit light while the light emitting sections 10 configuring the respective pixels 1 in the remaining pixel blocks are not allowed to emit light.

For example, an example is assumed here of a full high-definition (HD) full-color television in which the number of pixels in a horizontal direction (the second direction) of a screen is 1920, and the number of pixels in a vertical direction (the first direction) of the screen is 1080. The pixel group is divided into P pieces of pixel block groups along the first direction, and it is assumed that P is four. In this example, pixel groups from a pixel group in a first row to a pixel group in 270th row are included in a first pixel block group, pixel groups from a pixel group in 271th row to a pixel group in 540th row are included in a second pixel block group, pixel groups from a pixel group in 541th row to a pixel group in 810th row are included in a third pixel block group, and pixel groups from a pixel group in 811th row to a pixel group in 1080th row are included in a fourth pixel block group. In addition, each pixel block group is configured of six pixel blocks.

First Pixel Block Group

First pixel block: pixel group in 1st row to pixel group in 45th row

Second pixel block: pixel group in 46th row to pixel group in 90th row

Third pixel block: pixel group in 91st row to pixel group in 135th row

Fourth pixel block: pixel group in 136th row to pixel group in 180th row

Fifth pixel block: pixel group in 181st row to pixel group in 225th row

Sixth pixel block: pixel group in 226th row to pixel group in 270th row

Second Pixel Block Group

First pixel block: pixel group in 271st row to pixel group in 315th row

Second pixel block: pixel group in 316th row to pixel group in 360th row

Third pixel block: pixel group in 361st row to pixel group in 405th row

Fourth pixel block: pixel group in 406th row to pixel group in 450th row

Fifth pixel block: pixel group in 451st row to pixel group in 495th row

Sixth pixel block: pixel group in 496th row to pixel group in 540th row

Third Pixel Block Group

First pixel block: pixel group in 541st row to pixel group in 585th row

Second pixel block: pixel group in 586th row to pixel group in 630th row

Third pixel block: pixel group in 631st row to pixel group in 675th row

Fourth pixel block: pixel group in 676th row to pixel group in 720th row

Fifth pixel block: pixel group in 721st row to pixel group in 765th row

Sixth pixel block: pixel group in 766th row to pixel group in 810th row

Fourth Pixel Block Group

First pixel block: pixel group in 811th row to pixel group in 855th row

Second pixel block: pixel group in 856th row to pixel group in 900th row

Third pixel block: pixel group in 901st row to pixel group in 945th row

Fourth pixel block: pixel group in 946th row to pixel group in 990th row

Fifth pixel block: pixel group in 991st row to pixel group in 1035th row

Sixth pixel block: pixel group in 1036th row to pixel group in 1080th row

In the embodiment 7, one control pulse generation circuit 704 is provided in each pixel block. In other words, each pixel block includes one control pulse generation circuit 704 that generates the control pulses LCP having the sawtooth voltage variation, and a control pulse generation device 703 is configured of a group of the control pulse generation circuits 704 (specifically, in the embodiment 7, four control pulse generation circuits 704).

Specifically, the control pulse generation device 703 in the embodiment 7 includes a pixel group having a plurality of pixels 1 arranged in a form of a two-dimensional matrix in the first direction and the second direction, and each of the pixels 1 includes the light emitting section 10 and the drive circuit 11 allowing the light emitting section 10 to emit light for a time corresponding to the potential based on the signal voltage $V_{Sig}$. The pixel group is divided into P pieces of pixel block groups along the first direction, and each of the pixel block groups includes the control pulse generation circuit 704. The control pulse generation circuit 704 provided in p-th pixel block group generates the control pulses LCP having the sawtooth voltage variation to control the drive circuit 11 in the display unit divided into $Q_p$ pieces of pixel blocks along the first direction, where $1 \leq p \leq P$. Further, the control pulse generation circuit in each pixel block group supplies the control pulses sequentially to the drive circuits 11 from the drive circuits 11 configuring the respective pixels 1 in a first pixel block of a first pixel block group to the drive circuits 11 configuring the respective pixels 1 in $Q_P$-th pixel block of the P-th pixel block group, together on the pixel block basis, and the control pulse generation circuit supplies the control pulses to the drive circuits 11 configuring the respective pixels 1 in some of the pixel blocks while not supplying the control pulses to the drive circuits 11 configuring the respective pixels 1 in the remaining pixel blocks. In this case, when the control pulse generation circuit 704 generates the plurality of control pulses LCP in one display frame, and the light emitting sections 10 configuring respective pixels 1 in one of the pixel blocks are not allowed to emit light, a part of the plurality of control pulses LCP is masked so as not to supply the control pulses LCP to the drive circuits 11 configuring the respective pixels 1 in the one of the pixel blocks.

Operation of each pixel in each pixel block of each pixel block group (specifically, "signal voltage write period" and "pixel block emission period") is virtually similar to that described in the embodiment 1.

In the display unit or the method of driving the display unit of the embodiment 7, the light emitting section 10 emits light multiple times based on the plurality of control pulses LCP. Alternatively, the light emitting section 10 emits light multiple times based on the plurality of control pulses LCP having the sawtooth voltage variation supplied to the drive circuit 11 and the potential based on the signal voltage $V_{Sig}$. Still alternatively, the control pulse generation circuit 704 allows the light emitting section 10 to emit light multiple times based on the plurality of control pulses LCP. Time intervals between the plurality of control pulses are fixed. Specifically, in the embodiment 7, during a pixel block group emission period, two control pulses LCP are transmitted to all pixels 1 configuring each pixel block group, and the respective pixels 1 emit light two times.

As schematically illustrated in FIG. 15, in the display unit or the method of driving the display unit in the embodiment 7, in one display frame, six control pulses LCP are generated in one pixel block group, and a total of 24 control pulses LCP are supplied to 24 pixel blocks. The control pulses generated by P number of control pulse generation circuits are shifted in phase (have the phase difference). Incidentally, in FIG. 15, the control pulses from the respective four control pulse generation circuits 704 are denoted by "A", "B", "C", and "D", a left number in parentheses indicates a pixel block group number, and a right number in the parentheses indicates a pixel block number. Specifically, (3, 4) indicates the fourth pixel block in the third pixel block group. Furthermore, a triangle facing downward in each pixel block indicates that the pixel emits light during the period. The number of control pulses LCP supplied to the drive circuit 11 in one display frame is smaller than the number of the control pulses LCP in the one display frame. Alternatively, in the control pulse generation device 703, the number of control pulses LCP supplied to the drive circuit 11 in one display frame is smaller than the number of control pulses LCP in the one display frame. More specifically, in the example illustrated in FIG. 15, the number of control pulses LCP in one display frame is 24, and the number of control pulses LCP supplied to the drive circuit 11 in the one display frame is two. In two adjacent pixel blocks, control pulses LCP are overlapped. In other words, two pixel blocks emit light at the same time. In one display frame, any of the pixel blocks emit light constantly, and at the same time, in the one display frame, any of the pixel blocks do not emit light. Such an embodiment may be achieved in such a way that when the plurality of control pulses LCP are generated in one display frame, and the light emitting sections 10 configuring the respective pixels 1 in one of the pixel blocks do not emit light, a part of the plurality of control pulses LCP is masked so as not to supply the control pulses LCP to the drive circuits 11 configuring the respective pixels 1 in the one of the pixel blocks. More specifically, for example, a part (two consecutive control pulses LCP) of the control pulses LCP in one display frame may be extracted to be supplied to the drive circuit 11, with use of a multiplexer.

As schematically illustrated in FIG. 1B, the voltage of the control pulses LCP is rapidly varied at low grayscale part (low voltage part), and is sensitive particularly to waveform quality of the control pulse waveform at this part. Therefore, it is necessary to consider variation of the control pulses LCP generated by the control pulse generation circuit. In the display unit of the embodiment 7, since occurrence of variation of the control pulses LCP is suppressed by each control pulse generation circuit 704 based on the following method, it is possible to prevent occurrence of variation in light emission state.

More specifically, as illustrated in the conceptual diagram of FIG. 16, in the control pulse generation circuit 704, waveform signal data of the control pulses stored in the memory 21 is read out by the controller 22, the read waveform signal data is transmitted to the D/A converter 23, the waveform signal data is converted into a voltage by the D/A converter 23, and the voltage is integrated by the low pass filter 24 to generate control pulses having (1/γ) powered curve. Further, the control pulses are distributed to a plurality of (six in the embodiment 7) multiplexers 26 through the amplifier 25. Under the control of the controller 22, each of the multiplexers 26 allows necessary part of the control pulses LCP to pass therethrough and masks the remaining part to generate a desired control pulse group (specifically, six control pulse groups each configured of six consecutive control pulses LCP). Note that, as will be described later, the memory 21 and the controller 22 may be disposed in the control pulse generation device 703. In other words, the memory 21 and the controller 22 may be regarded as one pair.

The above is similar to the control pulse generation circuit 103 described in the embodiment 1. In the embodiment 7, the control pulse generation circuit 704 includes a capacitor 27 between a control pulse generation section and an output section, and a DC power source 29 common to the control pulse generation circuits 704 is connected between the capacitor 27 and the output section through a switch 28. Specifically, disposing the capacitor 27 between the control pulse generation section (source signal generator) and the output section enables separation of the control pulse generation section and the output section (namely, prevents transmission of a DC component), and the capacitor 27 is charged by the DC power source 29 common to the control pulse generation circuits 704 during a period from one control pulse LCP to the subsequent control pulse LCP, thereby eliminating DC potential difference between the one control pulse LCP and the subsequent control pulse LCP. Specifically, the capacitor 27 is disposed between the amplifier 25 and the multiplexer 26, and a voltage is supplied between the capacitor 27 and the multiplexer 26 through the switch 28 from the DC power source 29 that is common to the control pulse generation circuits 704. ON and OFF of the switch 28 are controlled by the controller 22.

Figure 17:
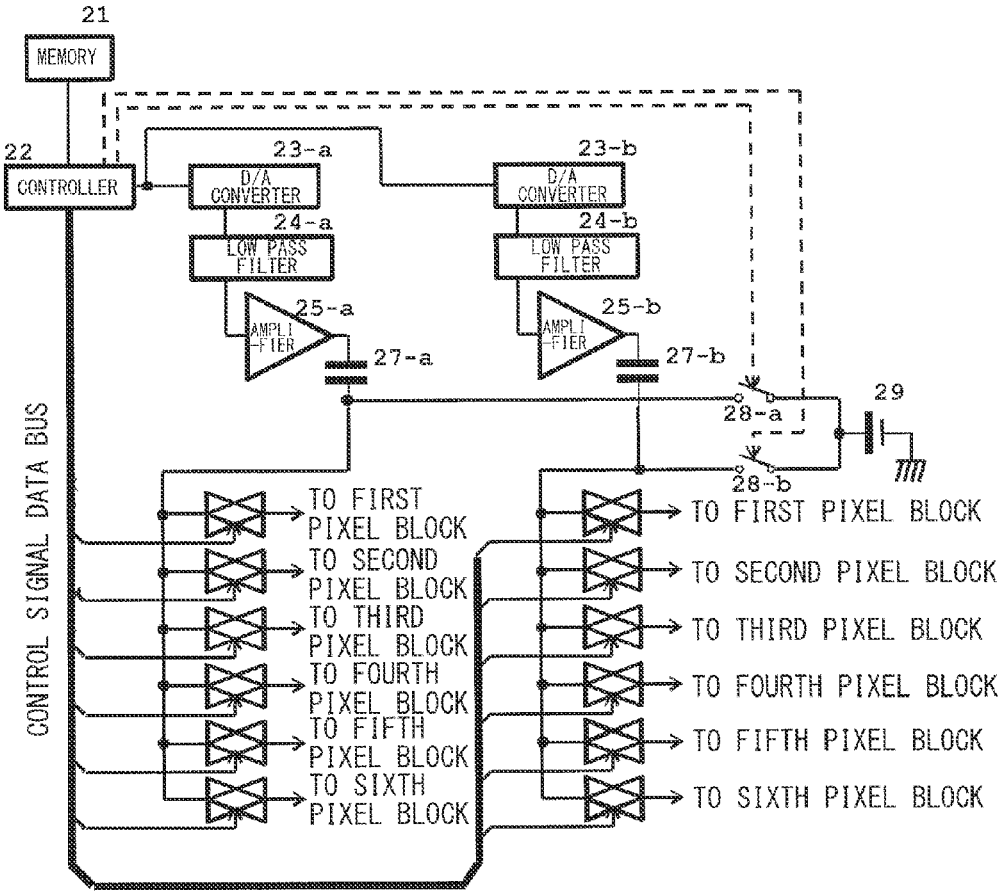
FIG. 17 is a conceptual diagram of a modification of the control pulse generation circuit in the display unit according to the embodiment 7.

In the above-described display unit of the embodiment 7 whose conceptual diagram is illustrated in FIG. 16, each pixel block group includes the control pulse generation circuit 704, and each control pulse generation circuit 704 includes the memory 21 and the controller 22. However, the memory 21 and the controller 22 may be shared by each control pulse generation circuit. FIG. 17 illustrates a conceptual diagram of such a control pulse generation circuit. FIG. 17 illustrates two D/A converters (D/A converters 23-*a* and 23-*b*), two low pass filters (low pass filters 24-*a* and 24-*b*), two amplifiers (amplifiers 25-*a* and 25-*b*), two capacitors (capacitors 27-*a* and 27-*b*), and two switches (switches 28-*a* and 28-*b*). In this case, actually, in the embodiment 7, since four control pulse generation circuit are provided, one memory 21 and one controller 22 may be shared by the four control pulse generation circuits, or for example, one memory 21 and one controller 22 may be shared by two control pulse generation circuits.

Figure 18:
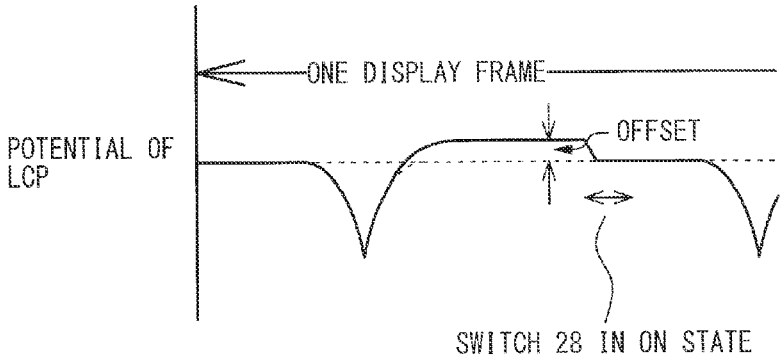
FIG. 18 is a diagram for explaining the fact that an offset in a voltage of the control pulses is allowed to be eliminated by the control pulse generation circuit in the display unit according to the embodiment 7.

By employing such a configuration, it is possible to eliminate offset in the voltage of the control pulses LCP with use of the DC power source 29 common to the control pulse generation circuits 704 even when the offset (variation) occurs in the voltage of the control pulses LCP having the sawtooth voltage variation as illustrated in the schematic diagram of FIG. 18. In other words, it is possible to eliminate DC potential difference between one control pulse LCP and the subsequent control pulse LCP, and therefore it is possible to ensure that occurrence of variation in generation of the control pulses LCP by each of the control pulse generation circuits 704 is suppressed efficiently.

Figure 19:
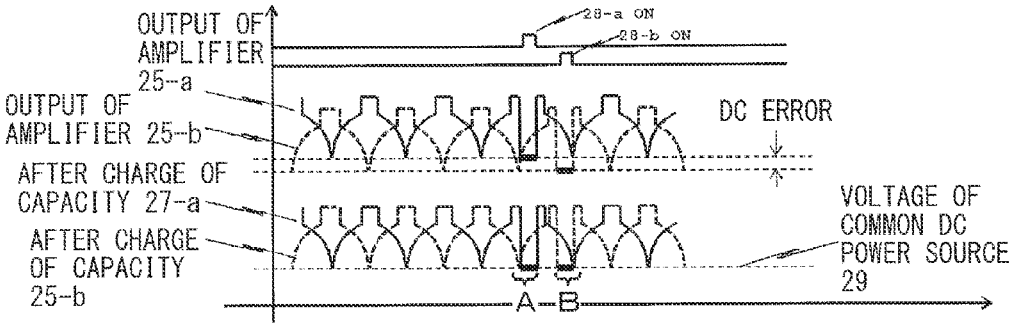
FIG. 19 is a diagram for explaining the fact that an offset of the voltage of the control pulses between the control pulse generation circuits is allowed to be eliminated by the control pulse generation circuit in the display unit according to the embodiment 7.

Furthermore, it is possible to occurrence of variation in generation of the control pulses LCP between the control pulse generation circuits is suppressed efficiently. Specifically, charging the capacitors 27 configuring the respective control pulse generation circuits 704 by the DC power source 29 common to the plurality of control pulse generation circuits 704 eliminates DC potential difference (offset, DC error) between the control pulse LCP from a control pulse generation circuit 704 and the control pulse LCP from another control pulse generation circuit 704. Specifically, as illustrated in the middle part of FIG. 19, for example, an example is assumed here where there is a DC potential difference (DC error) between an output from the amplifier 25-*a* configuring the first control pulse generation circuit in the first pixel block group and an output from the amplifier 25-*b* configuring the second control pulse generation circuit in the second pixel block group. In this case, the switch 28-*a* configuring the first control pulse generation circuit in the first pixel block group and the switch 28-*b* configuring the second control pulse generation circuit in the second pixel block group are sequentially put into ON state (see the upper part of FIG. 19), which makes it possible to eliminate the DC potential difference between the control pulse LCP from the first control pulse generation circuit 704 in the first pixel block group and the control pulse LCP from the second control pulse generation circuit 704 in the second pixel block group, as illustrated in the lower part of FIG. 19. Note that, in FIG. 19, to prevent complication of illustration of the drawing, one operation of the switches 28 is illustrated with respect to generation of the plurality of control pulses LCP. However, one operation of the switches 28 may be performed with respect to generation of one control pulse LCP. In addition, during the charging period of the capacitors 27 (indicated by "A" and "B" in the lower part of FIG. 19), masking the control pulses prevents supply of the control pulses to the pixel blocks.

Further, operation during the signal voltage write period and during the pixel block emission period is performed sequentially on pixel blocks from the first pixel block of the first pixel block group to the sixth pixel block of the fourth pixel block group, namely, on 24 pixel blocks. In other words, as illustrated in FIG. 15, the light emitting sections 10 from the light emitting sections 10 configuring the respective pixels 1 in the first pixel block of the first pixel block group to the light emitting sections 10 configuring the respective pixels 1 in the $Q_P$-th pixel block of the P-th pixel block group are allowed to emit light sequentially for each pixel block together. In addition, when the light emitting sections 10 configuring the respective pixels 1 in some of the pixel blocks are allowed to emit light, the light emitting sections 10 configuring the respective pixels 1 in the remaining pixel blocks are not allowed to emit light. Incidentally, in one display frame, any of the pixel blocks emit light constantly.

In the embodiment 7, when the light emitting sections 10 configuring the pixels in some of the pixel blocks (for example, the second and third pixel blocks of the first pixel block group) are allowed to emit light, the light emitting sections 10 configuring the pixels in remaining pixel blocks are not allowed to emit light. Accordingly, in driving the display unit based on a PWM driving method, emission period is allowed to be lengthened, which makes it possible to improve emission efficiency. In addition, it is unnecessary to write the picture signal transmitted over one display frame to all the pixels together within a certain period, namely, it is possible to sequentially write, for each row-direction pixel group, the picture signal transmitted over one display frame, similarly to the existing display unit. Therefore, it is unnecessary to prepare a large signal buffer, and it is also unnecessary to give much consideration to the signal transmission circuit such that the picture signal is transmitted to all the pixels at a rate equal to or higher than a transfer rate of the picture signal. Furthermore, all the pixels do not have to emit light together during pixel emission period, i.e., for example, when the light emitting sections 10 configuring the respective pixels in the second and third pixel blocks of the first pixel block group emit light, the light emitting sections 10 configuring the respective pixels in the remaining pixel blocks do not emit light. Therefore, power necessary for light emission is not concentrated for a short time, which makes it easier to design a power source.

Obviously, the various kinds of configurations and structures described in the embodiments 2 to 6 are applicable in any combination to the embodiment 7.

Embodiment 8

In the embodiments 1 to 7, the crest values of the voltage variation of the control pulses LCP are the same, and the voltage variation patterns of the control pulses LCP are also the same. Therefore, in the case where such control pulses LCP are used, a proportion of the emission period in which the brightest grayscale is expressed to the emission period in which darkest grayscale is expressed is primarily determined by the voltage variation pattern of the control pulses LCP.

Figure 21A:
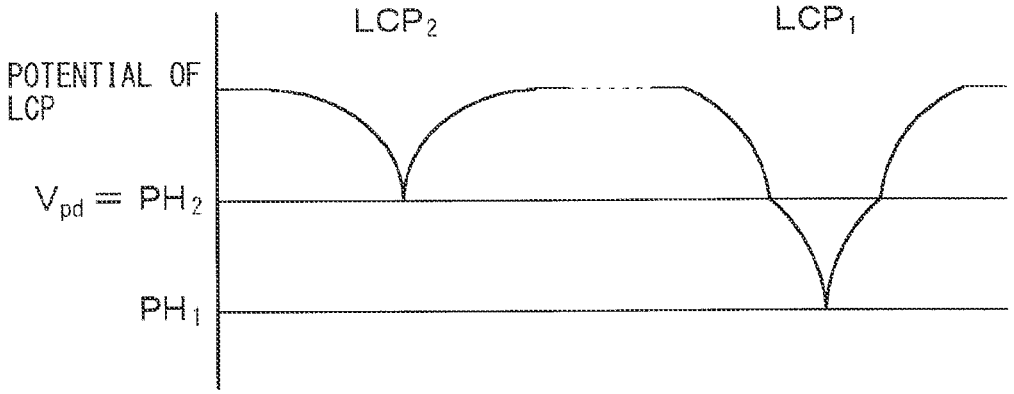
FIGS. 21A and 21B are schematic diagrams illustrating a part of the control pulses according to the embodiment 8 in an enlarged manner.
Figure 21B:
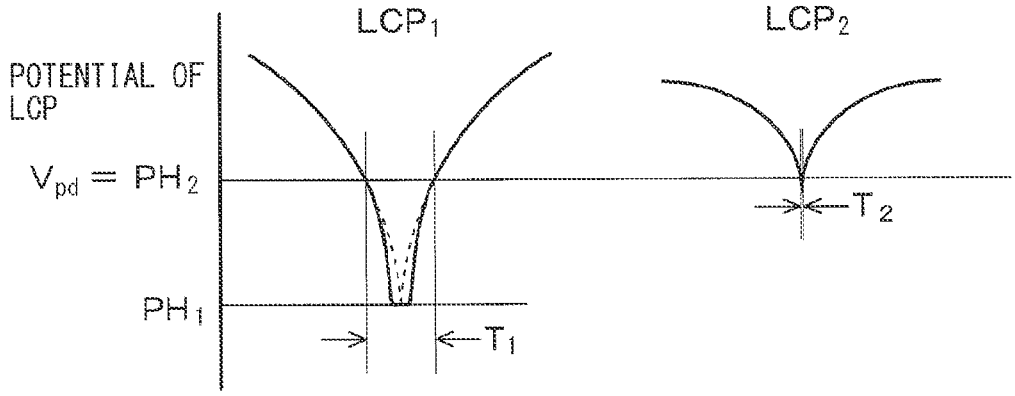
Figure 22:
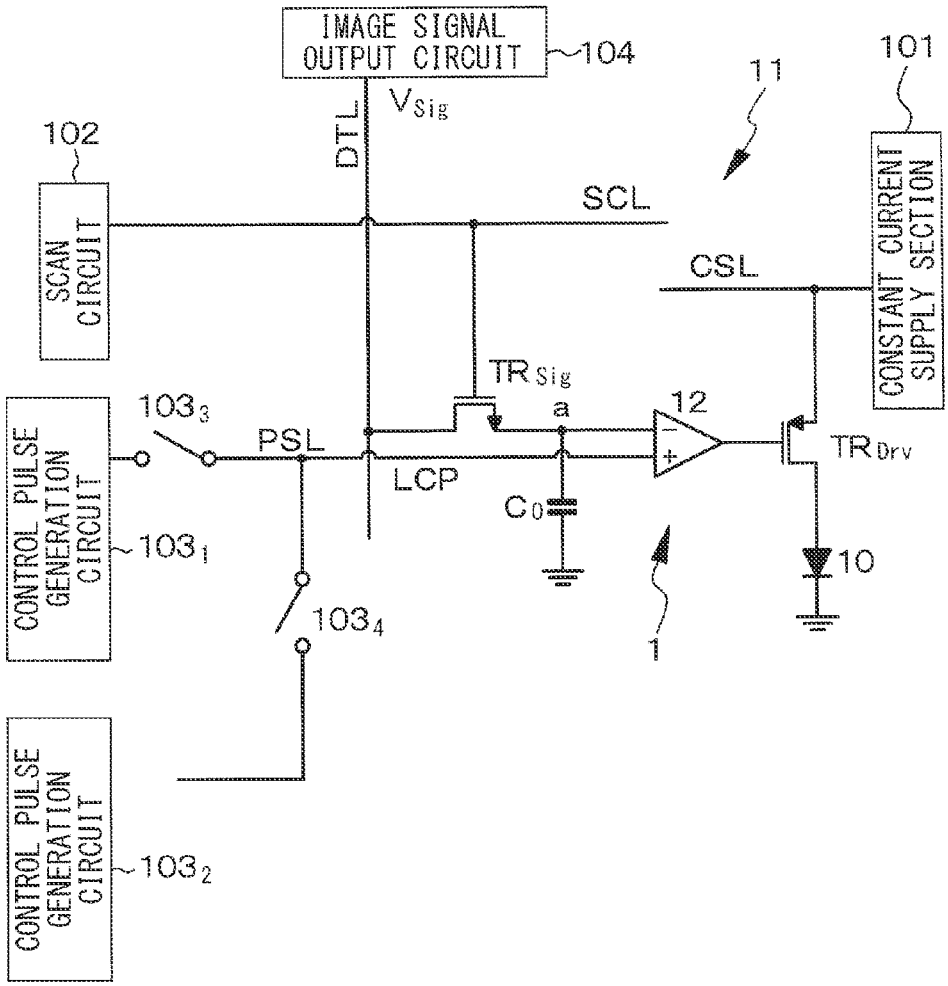
FIG. 22 is an equivalent circuit diagram of a pixel configured of a light emitting section and a drive circuit in a display unit according to the embodiment 8.

Embodiment 8 is a modification of the embodiments 1 to 6, and relates to the display unit and the method of driving the display unit according to the third-B embodiment of the present disclosure. FIG. 22 is an equivalent circuit diagram of the pixel 1 configured of the light emitting section and the drive circuit of the display unit in the embodiment 1, FIGS. 20A and 20B are schematic diagrams each illustrating the control pulses and the like for explaining operation of one pixel, and FIGS. 21A and 21B are schematic diagrams each illustrating a part of the control pulses in an enlarged manner.

In the embodiment 8, similarly to the embodiments 1 to 6, the light emitting section 10 emits light multiple times based on the plurality of control pulses LCP having the sawtooth voltage variation supplied to the drive circuit 11 and the potential based on the signal voltage $V_{Sig}$. In the embodiment 8, however, the plurality of control pulses include two or more kinds (specifically, in the embodiment 8, two kinds) of control pulses $LCP_1$ and $LCP_2$ whose crest values of the voltage variation are different from each other, and the same number of (specifically, two in the embodiment 8) control pulse generation circuits $\mathbf{103}_1$ and $\mathbf{103}_2$ (see FIG. 22) as (specifically, in the embodiment 8, two kinds of) the control pulses $LCP_1$ and $LCP_2$ are provided. Transmission of the control pulses $LCP_1$ and $LCP_2$ from the control pulse generation circuits $\mathbf{103}_1$ and $\mathbf{103}_2$ to the drive circuit 11 is switched by changeover switches $\mathbf{103}_3$ and $\mathbf{103}_4$ under the control of the controller 22.

In addition, the voltage variation patterns of the two or more kinds (in the embodiment 8, two kinds) of control pulses $LCP_1$ and $LCP_2$ are different from each other. Furthermore, the number of emission times of the light emitting section 10 is dependent on the potential based on the signal voltage $V_{Sig}$. Moreover, the number of emission times of the light emitting section 10 may be varied between a case where the potential based on the predetermined signal voltage is lower than a predetermined potential and a case where the potential is equal to or higher than the predetermined potential.

Figure 20A:
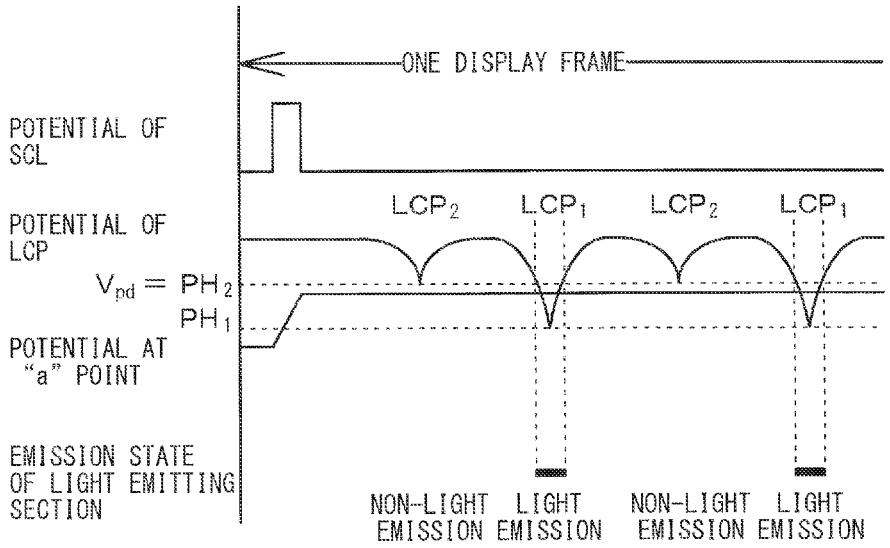
FIGS. 20A and 20B are schematic diagrams each illustrating control pulses and the like for explaining operation of one pixel according to embodiment 8.
Figure 20B:
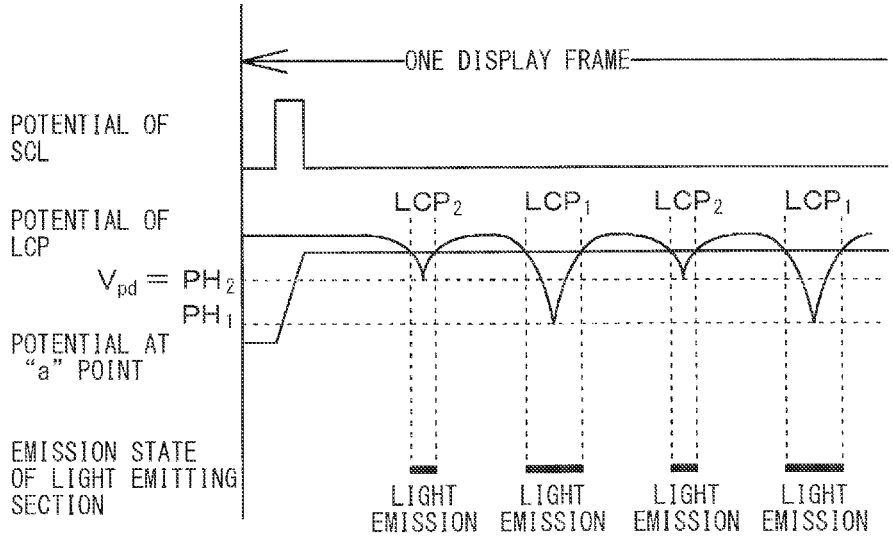

Specifically, as illustrated in the schematic diagrams of the two kinds of control pulses $LCP_1$ and $LCP_2$ of FIGS. 20A and 20B, an absolute value of the voltage of each of the control pulses $LCP_1$ and $LCP_2$ is increased and then decreased with lapse of time. In this case, a control pulse in which an absolute value $|PH_1|$ of the crest value of the voltage variation is large is defined as a first control pulse $LCP_1$, and a control pulse in which an absolute value $|PH_2|$ of the crest value of the voltage variation is small is defined as a second control pulse $LCP_2$. As illustrated in FIG. 20A, in the case where the absolute value $|V_{Sig}|$ of the signal voltage $V_{Sig}$ is larger than $|PH_2|$ and equal to or smaller than $|PH_1|$, the light emitting section 10 emits light as a total of two times under the control of the first control pulse $LCP_1$. On the other hand, as illustrated in FIG. 20B, in the case where the absolute value $|V_{Sig}|$ of the signal voltage $V_{Sig}$ is equal to or smaller than $|PH_2|$, the light emitting section 10 emits light as a total of four times under the control of the first control pulse $LCP_1$ and the second control pulse $LCP_2$. Accordingly, the proportion of the emission period in which the brightest grayscale is expressed to the emission period in which darkest grayscale is expressed is allowed to be larger than that in each of the embodiments 1 to 6. Incidentally, the control pulses are supplied to the drive circuit 11 in ascending order of the absolute value of the crest value of the voltage variation. The odd-numbered control pulses illustrated in FIG. 2 and FIG. 3 correspond to the second control pulse $LCP_2$, and the even-numbered control pulses correspond to the first control pulse $LCP_1$.

In the embodiment 8, the waveform of the first control pulse $LCP_1$ changes discontinuously at the voltage of the first control pulse $LCP_1$ equal to the predetermined voltage $V_{pd}$ of the second control pulse $LCP_2$. Specifically, $$|V_{pd}|=|PH_2|$$

is established. Specifically, as illustrated in the schematic diagram of FIG. 21A, in a region where the absolute value $|V_{Sig}|$ of the signal voltage $V_{Sig}$ is larger than $|PH_2|$ and equal to or smaller than $|PH_1|$, the voltage of the first control pulse $LCP_1$ follows the above-described expressions (1-1) and (1-2). On the other hand, in a region where the absolute value $|V_{Sig}|$ of the signal voltage $V_{Sig}$ is equal to or smaller than $|PH_2|$, although the value of $V_0$ is different, the sum of the voltage of the first control pulse $LCP_1$ and the voltage of the second control pulse $LCP_2$ also follows the above-described expressions (1-1) and (1-2). In other words, the voltage of the first control pulse $LCP_1$ exceeding the absolute value of the predetermined voltage $V_{pd}$ of the second control pulse $LCP_2$ and a voltage of a synthesized pulse of the first control pulse $LCP_1$ equal to or smaller than the absolute value of the predetermined voltage $V_{pd}$ and the second control pulse $LCP_2$ follow the expressions (1-1) and (1-2). In such a way, the gamma correction is performed based on the voltages of the control pulses $LCP_1$ and $LCP_2$ varied with lapse of time. The same applies to embodiment 9 described later.

Incidentally, as described above, the voltage of the control pulses LCP is rapidly varied at the low grayscale part (low voltage part), and is sensitive particularly to waveform quality of the control pulse waveform at this part, as schematically illustrated in FIG. 1B. In other words, the voltage (the voltage $PH_2$ or close to the voltage $PH_2$) at or near the edge of the voltage variation pattern of the second control pulse $LCP_2$ likely becomes unstable in some cases.

Figures 23A, 23B:
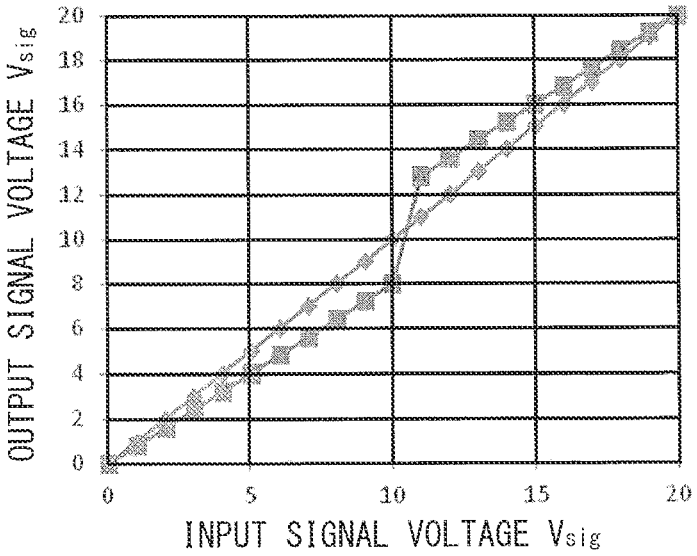
FIGS. 23A and 23B are a table and a graph, respectively, each illustrating an example of a relationship between an input signal voltage and an output signal voltage in a case where the input signal voltage is converted and transmitted to the drive circuit as the output signal voltage according to the embodiment 8.

In such a case, preferably, the input signal voltage $V_{Sig}$ that is equal to or close to the voltage $PH_2$ and is input to the image output signal circuit 104 may be converted by the image output signal circuit 104, and may be transmitted to the drive circuit 11 as the converted signal voltage (hereinafter, for convenience, may be referred to as "output signal voltage $V_{Sig}$" in some cases). FIG. 23A illustrates an example of a relationship between the input signal voltage $V_{Sig}$ and the output signal voltage $V_{Sig}$, and FIG. 23B illustrates a graph of the relationship. Note that the value of each of the input signal voltage $V_{Sig}$ and the output signal voltage $V_{Sig}$ does not represent an actual voltage. In addition, it is assumed that the edge of the voltage variation pattern of the second control pulse $LCP_2$ becomes unstable in a range where the value of the input signal voltage $V_{Sig}$ is 9 to 12 both inclusive. In FIG. 23B, a graph with square marks indicates the output signal voltage $V_{Sig}$, and a graph with rhomboid marks indicates the output signal voltage $V_{Sig}$ that is output without any conversion of the input signal voltage $V_{Sig}$. The relationship between the input signal voltage $V_{Sig}$ and the output signal voltage $V_{Sig}$ may be determined through various examinations, and may be stored in a form of a table in the image output signal circuit 104. Then, the image output signal circuit 104 may determine the output signal voltage $V_{Sig}$ from the input signal voltage $V_{Sig}$, based on the relationship between the input signal voltage $V_{Sig}$ and the output signal voltage $V_{Sig}$ in a form of a table. The same applies to the embodiment 9 described later.

Alternatively, as illustrated in a schematic diagram of FIG. 21B, the waveform shape of the edge of the first control pulse $LCP_1$ may be preferably a rectangular shape or a rounded shape. Such a shape of the waveform shape of the edge of the first control pulse $LCP_1$ enables stabilization of emission state (emission time) of the light emitting section based on the input signal voltage $V_{Sig}$ having a voltage equal to the voltage near the edge of the first control pulse $LCP_1$. In this case, when a time width of the second control pulse at the predetermined voltage $V_{pd}$ (or close to the voltage $V_{pd}$) of the second control pulse $LCP_2$ is defined as $T_2$, and a time width of the first control pulse at the voltage of the first control pulse equal to the predetermined voltage $V_{pd}$ of the second control pulse is defined as $T_1$, an expression $20 \leq T_1/T_2 \leq 100$ may be preferably satisfied. In addition, the value of $T_1$ may be 5 microseconds to 10 microseconds both inclusive, without limitation. The same applies to the embodiment 9 described later.

Then, the voltage of the first control pulse $LCP_1$ higher than the absolute value of the predetermined voltage $V_{pd}$ may be varied in a first variation pattern, the voltage of the first control pulse $LCP_1$ equal to or lower than the absolute value of the predetermined voltage $V_{pd}$ may be varied in a second variation pattern, and the voltage of the second control pulse $LCP_2$ equal to or lower than the absolute value of the predetermined voltage $V_{pd}$ may be varied in a third variation pattern. In this case, the second variation pattern may be the same as the third variation pattern, and alternatively, the second variation pattern may be different from the third variation pattern. As the former case, the following expression is exemplified.

The value of γ in the expressions (1-1) and (1-2) in the first variation pattern=the value of γ in the expressions (1-1) and (1-2) in the second variation pattern=the value of γ in the expressions (1-1) and (1-2) in the third variation pattern=2.2

As the latter case, the following expression is exemplified.

The value of γ in the expressions (1-1) and (1-2) in the first variation pattern=the value of γ in the expressions (1-1) and (1-2) in the second variation pattern=2.2 the value of γ in the expressions (1-1) and (1-2) in the third variation pattern=2.0

In addition, the voltage variation of the second control pulse $LCP_2$ near the predetermined voltage $V_{pd}$ may be made different from that in the third variation pattern (for example, the absolute value of the voltage of the edge of the second control pulse may be made larger than the absolute value of the predetermined voltage $V_{pd}$). The same applies to the embodiment 9 described later.

Figures 24A, 24B:
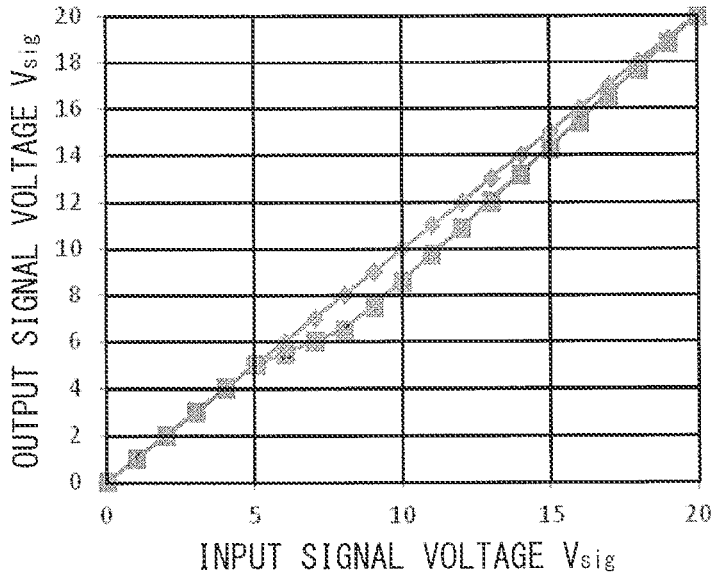
FIGS. 24A and 24B are a table and a graph, respectively, each illustrating another example of the relationship between the input signal voltage and the output signal voltage in the case where the input signal voltage is converted and transmitted to the drive circuit as the output signal voltage according to the embodiment 8.

Even in the case where the expressions: the value of γ in the expressions (1-1) and (1-2) in the first variation pattern=the value of γ in the expressions (1-1) and (1-2) in the second variation pattern=2.2; and the value of γ in the expressions (1-1) and (1-2) in the third variation pattern=2.0 are established, similarly to the above, the voltage at or near the edge of the voltage variation pattern of the second control pulse $LCP_2$ (the voltage $PH_2$ or close to the voltage $PH_2$) likely becomes unstable in some cases. In such a case, preferably the input signal voltage $V_{Sig}$ equal to or close to the voltage $PH_2$ may be converted by the image output signal circuit 104, and may be transmitted to the drive circuit 11 as the output signal voltage $V_{Sig}$. FIG. 24A illustrates an example of a relationship between the input signal voltage $V_{Sig}$ and the output signal voltage $V_{Sig}$, and FIG. 24B illustrates a graph of the relationship. Incidentally, the value of each of the input signal voltage $V_{Sig}$ and the output signal voltage $V_{Sig}$ does not represent an actual voltage. The relationship between the input signal voltage $V_{Sig}$ and the output signal voltage $V_{Sig}$ may be determined through various examinations, and may be stored in a form of a table in the image output signal circuit 104. Then, the image output signal circuit 104 may determine the output signal voltage $V_{Sig}$ from the input signal voltage $V_{Sig}$, based on the relationship between the input signal voltage $V_{Sig}$ and the output signal voltage $V_{Sig}$ in a form of a table. In FIG. 24B, a graph with square marks represents the output signal voltage $V_{Sig}$, and a graph with rhomboid marks represents the output signal $V_{Sig}$ that is output without any conversion of the input signal voltage $V_{Sig}$.

The display unit and the method of driving the display unit of the embodiment 8 are similar to those in the embodiments 1 to 6 except for the above-described points. Therefore, detailed description will be omitted.

Embodiment 9

Embodiment 9 is a modification of the embodiment 7, and relates to the display unit and the method of driving the display unit according to the fourth-B embodiment of the present disclosure. Also in the embodiment 9, similarly to the embodiment 7, the light emitting section 10 emits light multiple times, based on the plurality of control pulses LCP having the sawtooth voltage variation supplied to the drive circuit 11 and the potential based on the signal voltage $V_{Sig}$. In the embodiment 9, however, the plurality of control pulses include two or more kinds (specifically, in the embodiment 9, two kinds) of control pulses $LCP_1$ and $LCP_2$ whose crest values of the voltage variation are different from each other, and each pixel block group includes the same number of (specifically, two in the embodiment 9) control pulse generation circuits as (specifically, in the embodiment 9, two kinds of) the control pulses $LCP_1$ and $LCP_2$. Transmission of the control pulses $LCP_1$ and $LCP_2$ from the control pulse generation circuits to the drive circuit 11 is switched by changeover switches under the control of the controller 22.

Further, similarly to the embodiment 8, the voltage variation patterns of the two or more kinds (in the embodiment 9, two kinds) of control pulses $LCP_1$ and $LCP_2$ are different from each other. Furthermore, the number of emission times of the light emitting section 10 is dependent on the potential based on the signal voltage $V_{Sig}$. The number of emission times of the light emitting section 10 may be varied between a case where the potential based on the predetermined signal voltage is lower than a predetermined potential and a case where the potential is equal to or higher than the predetermined potential. Specifically, as with the case illustrated in FIGS. 20A and 20B, the absolute value of the voltage of each of the control pulses $LCP_1$ and $LCP_2$ is increased and then decreased with lapse of time.

In FIG. 15, the control pulses from the control pulses generation circuits are denoted by a series of "A", "B", "C", and "D". However, the odd-numbered control pulses in each series of control pulses correspond to the second control pulse $LCP_2$ and the even-numbered control pulses correspond to the first control pulse $LCP_1$. In addition, two control pulse generation circuits are provided in each series (in each of the four pixel block groups). Specifically, as illustrated in FIG. 20A, in the case where the absolute value $|V_{Sig}|$ of the signal voltage $V_{Sig}$ is larger than $|PH_2|$ and equal to or smaller than $|PH_1|$, the light emitting section 10 emits light once under the control of the first control pulse $LCP_1$. On the other hand, in the case where the absolute value $|V_{Sig}|$ of the signal voltage $V_{Sig}$ is equal to or smaller than $|PH_2|$, the light emitting section 10 emits light as a total of two times under the control of the first control pulse $LCP_1$ and the second control pulse $LCP_2$. Accordingly, the proportion of the emission period in which the brightest grayscale is expressed to the emission period in which darkest grayscale is expressed is allowed to be larger than that in the embodiment 7. Incidentally, the control pulses are supplied to the drive circuit 11 in ascending order of the absolute value of the crest value of the voltage variation.

The display unit and the method of driving the display unit of the embodiment 9 are similar to those in the embodiment 7 except for the above-described points. Therefore, detailed description will be omitted.

Figure 25:
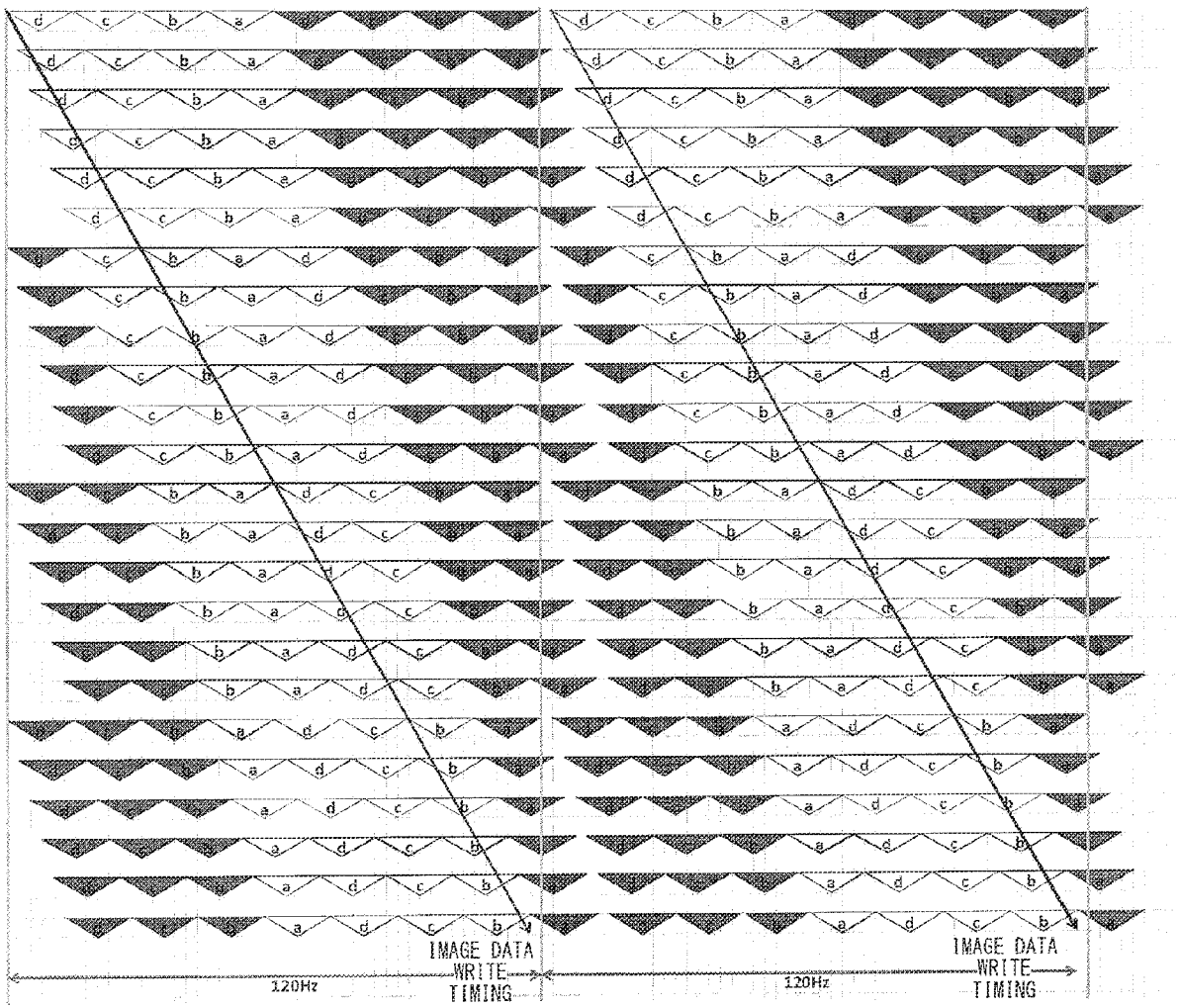
FIG. 25 is a diagram schematically illustrating supply of a plurality of control pulses to pixel blocks in a display unit according to embodiment 9.
Figure 26:
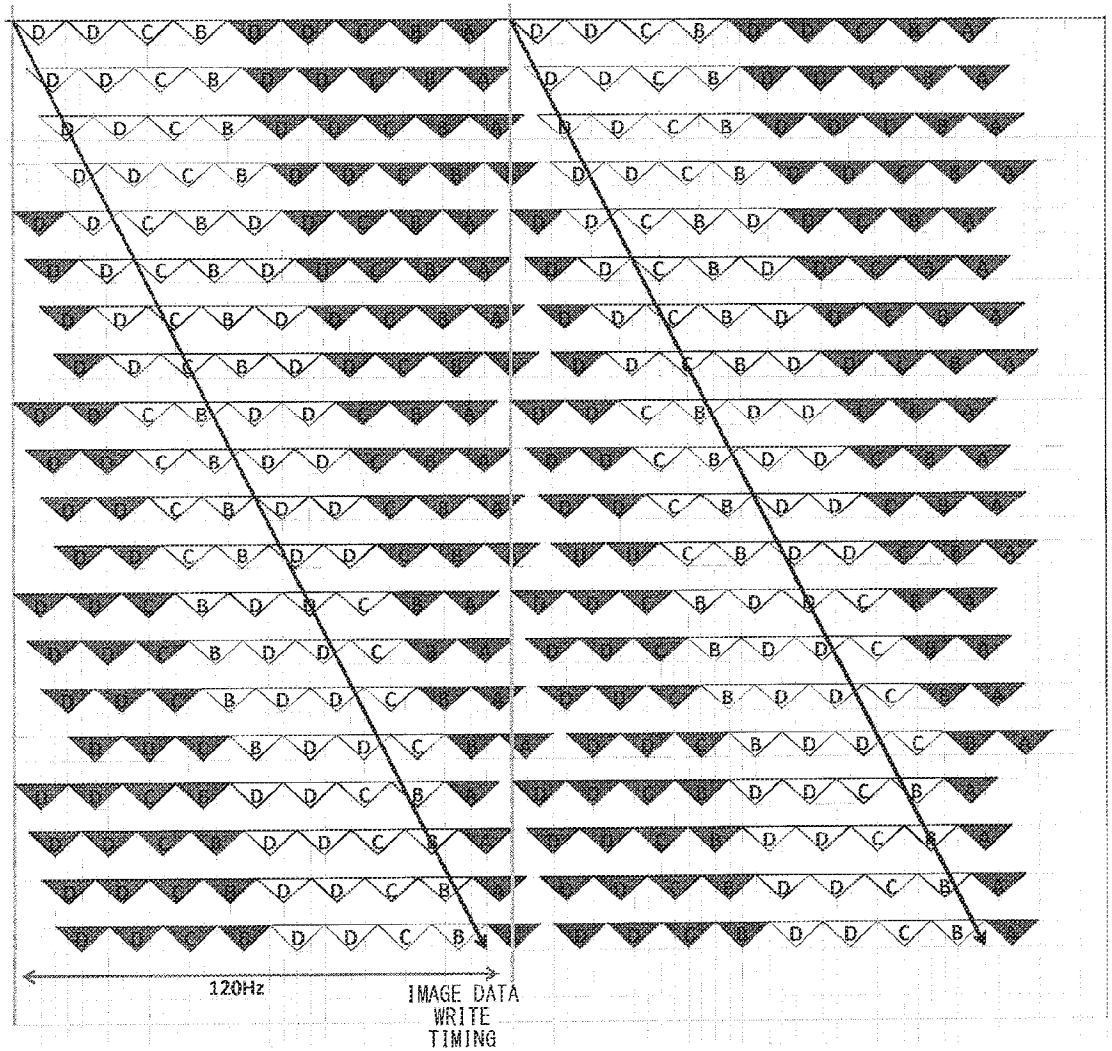
FIG. 26 is a diagram schematically illustrating the supply of the plurality of control pulses to the pixel blocks in the display unit according to the embodiment 9.

FIG. 25 and FIG. 26 each illustrate a modification of the embodiment 9. Note that FIG. 25 and FIG. 26 are diagrams each schematically illustrating supply of the plurality of control pulses to pixel block groups in the display unit of the embodiment 9, similarly to the case illustrated in FIG. 15.

In FIG. 25, the pixel group is divided into P=4 pieces of pixel block groups along the first direction, and p-th pixel block group is divided into $Q_p$=6 pieces of pixel blocks along the first direction, where $1 \leq p \leq P$. The plurality of control pulses include two or more kinds of, specifically, four kinds of control pulses whose crest values of the voltage variation are different from one another. Each of the pixel block groups includes the same number of control pulse generation circuits as the plurality of control pulses. A control pulse "d" is a control pulse in which an absolute value of the crest value of the voltage variation is smallest, a control pulse "c" is a control pulse in which an absolute value of the crest value of the voltage variation is smallest next to that of the control pulse "d", a control pulse "b" is a control pulse in which an absolute value of the crest value of the voltage variation is smallest next to that of the control pulse "c", and a control pulse "a" is a control pulse in which an absolute value of the crest value of the voltage variation is largest. In one frame period, the control pulses are transmitted to the drive circuit 11 in order of the control pulse "d", the control pulse "c", the control pulse "b", the control pulse "a", the control pulse "d", the control pulse "c", the control pulse "b", and the control pulse "a". Even in the case where light is emitted by the control pulse "a" with dark grayscale, discomfort such as flicker is difficult to be perceived because emission time is not largely shifted.

Moreover, in FIG. 26, the pixel group is divided into P=5 pieces of pixel block groups along the first direction, and p-th pixel block group is divided into $Q_p$=4 pieces of pixel blocks along the first direction, where $1 \leq p \leq P$. The plurality of control pulses include two or more kinds of, specifically, four kinds of control pulses whose crest values of the voltage variation are different from one another. Each of the pixel block groups includes the same number of control pulse generation circuits as the plurality of control pulses. A control pulse "D" is a control pulse in which an absolute value of the crest value of the voltage variation is smallest, a control pulse "C" is a control pulse in which an absolute value of the crest value of the voltage variation is smallest next to that of the control pulse "D", a control pulse "B" is a control pulse in which an absolute value of the crest value of the voltage variation is smallest next to that of the control pulse "C", and a control pulse "A" is a control pulse in which an absolute value of the crest value of the voltage variation is largest. In one frame period, the control pulses are transmitted to the drive circuit 11 in order of the control pulse "D", the control pulse "D", the control pulse "C", the control pulse "B", the control pulse "D", the control pulse "D", the control pulse "C", the control pulse "B", and the control pulse "A". Even in this case, and even when light is emitted by the control pulse "A" with dark grayscale, discomfort such as flicker is difficult to be perceived because emission time is not largely shifted.

As described above, although the present disclosure has been described with referring to some embodiments, the present disclosure is not limited to the embodiments. The configuration and the structure of the display unit, various kinds of circuits that are provided in the light emitting section, in the drive circuit, and in the display unit described in the embodiments are merely exemplified, and may be modified as appropriate.

In the embodiments described above, the signal write transistor is of the n-channel type, and the light emitting section drive transistor is of the p-channel type. However, the conductive type of the channel forming region of each transistor is not limited thereto, and the waveform of the control pulse is also not limited to the waveforms described in the embodiments. In addition, in the embodiments, the n-channel transistor or the p-channel transistor is used as the switch section and the switch circuit. However, the conductive types of the channel forming regions of the respective transistors used as the switch sections and the switch circuits may be inverted, or may be a transfer switch that is configured by connecting an n-channel transistor and a p-channel transistor in parallel.

In the embodiments 1 to 6, although the display unit includes one control pulse generation circuit, the display unit may include a plurality of control pulse generation circuits. In this case, the shapes of the control pulses generated by the plurality of control pulse generation circuits may be preferably the same as much as possible, and the control pulses generated by the plurality of control pulse generation circuits may be preferably shifted in phase (may preferably have phase difference). Specifically, the control pulse generation circuit described in the embodiment 7 may be employed therefor. This further increases the number (P) of pixel block groups, and further improves the image display quality. Moreover, the control pulse generation circuit may be provided on both ends of the control pulse line. In the embodiments, the technology of the present disclosure is applied to the comparator device configuring the drive circuit of each of the pixels in the display unit. However, this is not limitative, and the comparator devices according to the respective embodiments of the present disclosure are applicable to any of comparator devices (comparator circuits) that compare a signal voltage with a sawtooth voltage of the control pulses having a sawtooth voltage variation, and to various kinds of electronic apparatuses in general. In this case, examples of electronic apparatuses may include illumination devices, projectors, head-mounted displays (HMDs), head-up displays (HUDs), advertising media, mobile phones, mobile devices, robots, personal computers, on-vehicle apparatuses, and various home appliances. In application to the electronic apparatuses, "pixel" in the display unit, the method of driving the display unit, and the control pulse generation device may be replaced by "light emitting element", "pixel group" may be replaced by "light emitting element group", and "pixel block" may be replaced by "light emitting element block".

In the embodiments, the value of P has been set to six, five, or four. However, the value of the P is not limited thereto, and alternatively, for example, may be 12, 18, 24, 30, . . . or multiples of six.

Note that the present disclosure may be configured as follows.

(A01) <Display Unit . . . Embodiment [1]>

A display unit including a pixel group having a plurality of pixels that are arranged in a form of a two-dimensional matrix in a first direction and a second direction, each of the pixels including a light emitting section and a drive circuit configured to drive the light emitting section, the pixel group being divided into P pieces of pixel blocks along the first direction, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light, wherein the display unit is configured to allow the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and when the light emitting sections configuring the respective pixels in pixel blocks of the P pieces of pixel blocks emit light, configured to allow the light emitting sections configuring the respective pixels in remaining pixel blocks of the P pieces of pixel blocks not to emit light.

(A02) <Display Unit . . . Embodiment [2]>

A display unit including a pixel group having a plurality of pixels that are arranged in a form of a two-dimensional matrix in a first direction and a second direction, each of the pixels including a light emitting section and a drive circuit configured to drive the light emitting section, the pixel group being divided into P pieces of pixel block groups along the first direction where P is an integer of two or more, a p-th pixel block group of the P pieces of pixel block groups being divided into $Q_p$ pieces of pixel blocks along the first direction where $1 \leq p \leq P$, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light, wherein the display unit is configured to allow the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of pixel block groups to sequentially emit light together on a pixel block basis, and when the light emitting sections configuring the respective pixels in pixel blocks of the $Q_p$ pieces of pixel blocks emit light, configured to allow the light emitting sections configuring the respective pixels in remaining pixel blocks of the $Q_p$ pieces of pixel blocks not to emit light.

(A03) The display unit according to (A01), further including a control pulse generation circuit configured to generate the control pulses having a sawtooth voltage variation.

(A04) The display unit according to (A02), wherein each of the pixel block groups includes a control pulse generation circuit configured to generate the control pulses having a sawtooth voltage variation.

(B01) The display unit according to (A01), wherein each of the light emitting sections emits light multiple times based on the control pulses.

(B02) The display unit according to (B01), wherein time intervals between the plurality of control pulses are fixed.

(B03) The display unit according to any one of (A01) to (B02), wherein the number of control pulses supplied to the drive circuit in one display frame is smaller than the number of control pulses in the one display frame.

(B04) The display unit according to any one of (A01) to (B03), wherein any of the pixel blocks constantly emit light in one display frame.

(B05) The display unit according to any one of (A01) to (B03), wherein a pixel block not emitting light exists in one display frame.

(B06) The display unit according to any one of (A01) to (B05), wherein an absolute value of a voltage of each of the control pulses is increased and then decreased with lapse of time.

(B07) The display unit according to (B06), wherein a gamma correction is performed based on the voltage of the control pulses varied with lapse of time.

(B08) The display unit according to (B07), wherein the voltage of the control pulses is represented by following expressions (1-1) and (1-2):

$$V=V_0[1-(2t/T_0)]^{1/\gamma} \quad (1\text{-}1)$$

$$V=V_0[(2t/T_0)-1]^{1/\gamma} \quad (1\text{-}2)$$

where t is a time, $V_0$ is an absolute value of a crest value, $T_0$ is a time length from start of the voltage variation of one control pulse until end of the voltage variation, and when $0\leq(t/T_0)\leq0.5$ is established, the voltage of the control pulse is represented by the expression (1-1), and when $0.5\leq(t/T_0)\leq1.0$ is established, the voltage of the control pulse is represented by the expression (1-2).

(B09) The display unit according to any one of (A01) to (B08), wherein operation and non-operation of the comparator device is controlled by the control pulse.

(B10) The display unit according to any one of (A01) to (B08), wherein the comparator device includes a signal write transistor configured to receive the signal voltage, and a capacitor connected to the signal write transistor and configured to retain a potential based on the signal voltage in response to operation of the signal write transistor.

(B11) The display unit according to any one of (A01) to (B08), wherein the comparator device includes: a signal write transistor that is configured to receive the signal voltage; a capacitor that is connected to the signal write transistor and is configured to retain a potential based on the signal voltage in response to operation of the signal write transistor; and a comparator circuit that includes a first input section connected to a control pulse line, a second input section connected to the capacitor, and an output section, and the light emitting section drive transistor is connected to the output section of the comparator device, is operated with use of an output of the predetermined voltage from the comparator circuit based on a comparison result between the potential based on the signal voltage retained by the capacitor and a sawtooth voltage of the control pulses, and thus supplies a current to the light emitting section through a current supply line, to allow the light emitting section to emit light.

(B12) The display unit according to (B10) or (B11), wherein operation and non-operation of the comparator circuit is controlled by the control pulses.

(B13) The display unit according to any one of (A01) to (B08), wherein the comparator device includes a comparison section that includes:

a signal write transistor configured to receive the signal voltage;

a control pulse transistor configured to receive the control pulses and to perform ON-OFF operation based on a signal having a reversed phase from a phase of the signal write transistor;

an inverter circuit; and a capacitor that has a first end connected to the signal write transistor and the control pulse transistor, and a second end connected to the inverter circuit, and is configured to retain a potential based on the signal voltage in response to operation of the signal write transistor.

(B14) The display unit according to (B13), wherein the comparator device further includes a control section that is configured to control operation and non-operation of the comparison section with use of the control pulses.

(B15) The display unit according to (B14), wherein the control section includes a switch circuit that is connected in series to the inverter circuit and is configured to perform ON-OFF operation based on the sawtooth voltage of the control pulse.

(B16) The display unit according to (B15), wherein the control section includes a second switch circuit that is connected in parallel to the switch circuit, and is turned on during operation period of the comparator device.

(B17) The display unit according to any one of (B13) to (B16), wherein the control section includes a resistance element that is connected in series to the inverter circuit.

(B18) The display unit according to any one of (B13) to (B17), wherein the inverter circuit have a configuration in which inverters are connected in two or more-stage cascade.

(B19) The display unit according to any one of (A01) to (B08), wherein the comparator device includes a comparison section that includes:

a signal write transistor configured to receive a signal voltage;

a capacitor that is connected to the signal write transistor and is configured to retain a potential based on the signal voltage in response to operation of the signal write transistor;

a differential circuit configured to receive, as two inputs, the signal voltage from the signal write transistor and the control pulses; and a constant current source configured to supply a constant current to the differential circuit.

(B20) The display unit according to (B19), wherein the comparator device further includes a control section that is configured to control operation and non-operation of the comparison section with use of the control pulses.

(B21) The display unit according to (B20), wherein the control section includes a switch circuit that is connected in series to the constant current source, and is configured to perform ON-OFF operation based on the sawtooth voltage of the control pulses.

(B22) The display unit according to (B21), wherein the control section includes a second switch circuit that is connected in series to the constant voltage circuit, and is configured to perform ON-OFF operation based on the sawtooth voltage of the control pulses, the constant voltage circuit being configured to apply a constant voltage to a gate electrode of the transistor configuring the constant current source.

(B23) The display unit according to any one of (B10) to (B22), wherein, in each pixel block, the signal write transistors of all pixels in one line in the second direction are put into an operation state together.

(B24) The display unit according to (B23), wherein, in each pixel block, the operation in which the signal write transistors of all the pixels in one line in the second direction are put into an operation state together is sequentially performed on the signal drive transistors from the signal write transistors in all pixels in a first row to the signal write transistors in all pixels in a last row in the first direction.

(B25) The display unit according to (B24), wherein, in each pixel block, the operation in which the signal write transistors in all the pixels in one line in the second direction are put into the operation state together is sequentially performed on the signal write transistors from the signal write transistors in all the pixels in the first row in the first direction to the signal write transistors in all the pixels in the last row, and then the control pulses are supplied to the pixel block in which the operation has been performed.

(B26) The display unit according to any one of (A01) to (B25), wherein the light emitting section is configured of a light emitting diode.

(B27) The display unit according to any one of (A01) to (B26), wherein the pixels in one line in the second direction are connected to a control pulse line, and voltage follower circuits (buffer circuits) are disposed with predetermined intervals on the control pulse line.

(C01) <Display Unit . . . Embodiment [3]>

A display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel blocks along the first direction where P is an integer of two or more, wherein the display unit is configured to allow the light emitting sections from the light emitting sections configuring the respective pixels in a first pixel block of the P pieces of pixel blocks to the light emitting sections configuring the respective pixels in P-th pixel block of the P pieces of pixel blocks to sequentially emit light together on a pixel block basis, and when the light emitting sections configuring the respective pixels in pixel blocks of the P pieces of pixel blocks emit light, configured to allow the light emitting sections configuring the respective pixels in remaining pixel blocks of the P pieces of pixel blocks not to emit light.

(C02) <Display Unit . . . Embodiment [4]>

A display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel block groups along the first direction where P is an integer of two or more, a p-th pixel block group of the P pieces of pixel block groups being divided into $Q_p$ pieces of pixel blocks along the first direction where $1 \le p \le P$, wherein the display unit is configured to allow the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of the pixel block groups to sequentially emit light together on a pixel block basis, and when the light emitting sections configuring the respective pixels in pixel blocks of the $Q_p$ pieces of pixel blocks emit light, configured to allow the light emitting sections configuring the respective pixels in remaining pixel blocks of the $Q_p$ pieces of pixel blocks not to emit light.

(C03) The display unit according to (C01) or (C02), wherein the light emitting section emits light multiple times based on the control pulses and the potential that is based on the signal voltage, the control pulses having a sawtooth voltage variation and being supplied to the drive circuit.

(C04) The display unit according to (C01) or (C03), further including a control pulse generation circuit configured to generate control pulses having a sawtooth voltage variation.

(C05) The display unit according to (C02) or (C03), wherein each of the pixel block groups includes a control pulse generation circuit configured to generate control pulses having a sawtooth voltage variation.

(C06) The display unit according to (C04) or (C05), wherein the control pulses have the same crest value of the voltage variation with one another.

(C07) The display unit according to any one of (C01) to (C06), wherein an absolute value of a voltage of each of the control pulses is increased and then decreased with lapse of time.

(C08) The display unit according to (C07), wherein a gamma correction is performed based on the voltage of the control pulses varied with lapse of time.

(C09) The display unit according to (C08), wherein the voltage of the control pulses is represented by following expressions (1-1) and (1-2):

$$V = V_0[1-(2t/T_0)]^{1/\gamma} \quad (1\text{-}1)$$

$$V = V_0[(2t/T_0)-1]^{1/\gamma} \quad (1\text{-}2)$$

where t is a time, $V_0$ is an absolute value of a crest value, $T_0$ is a time length from start of the voltage variation of one control pulse until end of the voltage variation, and when $0 \le (t/T_0) \le 0.5$ is established, the voltage of the control pulses is represented by the expression (1-1), and when $0.5 \le (t/T_0) \le 1.0$ is established, the voltage of the control pulses is represented by the expression (1-2).

(C10) The display unit according to (C01), wherein the light emitting section emits light multiple times based on the control pulses and the potential that is based on the signal voltage, the control pulses having a sawtooth voltage variation and being supplied to the drive circuit, the control pulses include two or more kinds of control pulses having different crest values of the voltage variation from one another, and the display unit includes the same number of control pulse generation circuits as the control pulses.

(C11) The display unit according to (C02), wherein the light emitting section emits light multiple times based on the control pulses and the potential that is based on the signal voltage, the control pulses having a sawtooth voltage variation and being supplied to the drive circuit, the control pulses include two or more kinds of control pulses having different crest values of the voltage variation from one another, and each of the pixel block groups includes the same number of control pulse generation circuits as the control pulses.

(C12) The display unit according to (C10) or (C11), wherein the two or more kinds of control pulses have different voltage variation patterns from one another.

(C13) The display unit according to any one of (C10) to (C12), wherein the number of emission times of the light emitting section is dependent on the potential based on the signal voltage.

(C14) The display unit according to (C13), wherein the number of emission times of the light emitting section is varied between a case where the potential based on the predetermined signal voltage is lower than a predetermined potential and a case where the potential is equal to or higher than the predetermined potential.

(C15) The display unit according to any one of (C10) to (C14), wherein when a control pulse having a large absolute value of the crest value of the voltage variation is defined as a first control pulse and a control pulse having a small absolute value of the crest value of the voltage variation is defined as a second control pulse, a waveform of the first control pulse changes discontinuously at a voltage of the first control pulse equal to a predetermined voltage $V_{pd}$ of the second control pulse.

(C16) The display unit according to any one of (C10) to (C14), wherein when a control pulse having a large absolute value of the crest value of the voltage variation is defined as a first control pulse and a control pulse having a small absolute value of the crest value of the voltage variation is defined as a second control pulse, a voltage of the first control pulse exceeding an absolute value of a predetermined voltage $V_{pd}$ of the second control pulse and a voltage of a synthesized pulse of the first control pulse and the second control pulse equal to or lower than the absolute value of the predetermined voltage $V_{pd}$ are represented by following expressions (1-1) and (1-2):

$$V=V_0[1-(2t/T_0)]^{1/\gamma} \quad (1\text{-}1)$$

$$V=V_0[(2t/T_0)-1]^{1/\gamma} \quad (1\text{-}2)$$

where t is a time, $V_0$ is the absolute value of the crest value, $T_0$ is a time length from start of the voltage variation of one control pulse until end of the voltage variation, and when $0 \leq (t/T_0) \leq 0.5$ is established, the voltage of the control pulses is represented by the expression (1-1), and when $0.5 \leq (t/T_0) \leq 1.0$ is established, the voltage of the control pulses is represented by the expression (1-2).

(C17) The display unit according to (C16), wherein the voltage of the first control pulse exceeding the absolute value of the predetermined voltage $V_{pd}$ is varied in a first variation pattern, the voltage of the first control pulse equal to or lower than the absolute value of the predetermined voltage $V_{pd}$ is varied in a second variation pattern, and the voltage of the second control pulse equal to or lower than the absolute value of the predetermined voltage $V_{pd}$ is varied in a third variation pattern.

(C18) The display unit according to (C17), wherein a value of the second variation pattern is equal to a value of the third variation pattern.

(C19) The display unit according to (C17), wherein the second variation pattern is different from the third variation pattern.

(C20) The display unit according to any one of (C10) to (C19), wherein when a control pulse having a large absolute value of the crest value of the voltage variation is defined as a first control pulse and a control pulse having a small absolute value of the crest value of the voltage variation is defined as a second control pulse, a waveform shape of an edge of the first control pulse is a rectangular shape or a rounded shape.

(C21) The display unit according to any one of (C10) to (C20), wherein when a control pulse having a large absolute value of the crest value of the voltage variation is defined as a first control pulse and a control pulse having a small absolute value of the crest value of the voltage variation is defined as a second control pulse, following expression is satisfied:

$$20 \leq T_1/T_2 \leq 100$$

where $T_2$ is a time width of the second control pulse at the predetermined voltage $V_{pd}$ of the second control pulse, and $T_1$ is a time width of the first control pulse at a voltage of the first control pulse equal to the predetermined voltage $V_{pd}$ of the second control pulse.

(C22) The display unit according to (C21), wherein the value of $T_1$ is 5 microseconds to 10 microseconds both inclusive.

(C23) The display unit according to any one of (C10) to (C22), wherein the control pulses are supplied to the drive circuit in ascending order of the absolute value of the crest value of the voltage variation.

(D01) The display unit according to any one of (C01) to (C23), wherein time intervals between the plurality of control pulses are fixed.

(D02) The display unit according to any one of (C01) to (D01), wherein the number of control pulses supplied to the drive circuit in one display frame is smaller than the number of control pulses in the one display frame.

(D03) The display unit according to any one of (C01) to (D02), wherein any of the pixel blocks constantly emit light in one display frame.

(D04) The display unit according to any one of (C01) to (D03), wherein a pixel block not emitting light exists in one display frame.

(D05) The display unit according to any one of (C01) to (D04), wherein the drive circuit includes a comparator device, the control pulses and the signal voltage are input to the comparator device, and the light emitting section is operated by an output of the comparator device based on a comparison result between the sawtooth voltage of the control pulses and the potential based on the signal voltage.

(D06) The display unit according to (D05), wherein operation and non-operation of the comparator device is controlled by the control pulses.

(D07) The display unit according to any one of (C01) to (D06), wherein the light emitting section is configured of a light emitting diode.

(E01) <Method of Driving Display Unit . . . Embodiment [1]>

A method of driving a display unit, the method including:

preparing the display unit, the display unit including a pixel group having a plurality of pixels that are arranged in a form of a two-dimensional matrix in a first direction and a second direction, each of the pixels including a light emitting section and a drive circuit configured to drive the light emitting section, the pixel group being divided into P pieces of pixel blocks along the first direction where P is an integer of two or more, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light;

allowing the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and allowing, when the light emitting sections configuring the respective pixels in pixel blocks of the P pieces of pixel blocks emit light, the light emitting sections configuring the respective pixels in remaining pixel blocks of the P pieces of pixel blocks not to emit light.

(F01) <Method of Driving Display Unit . . . Embodiment [2]>

A method of driving a display unit, the method including:

preparing the display unit, the display unit including a pixel group having a plurality of pixels that are arranged in a form of a two-dimensional matrix in a first direction and a second direction, each of the pixels including a light emitting section and a drive circuit configured to drive the light emitting section, the pixel group being divided into P pieces of pixel block groups along the first direction where P is an integer of two or more, a p-th pixel block group of the P pieces of pixel block groups being divided into $Q_p$ pieces of pixel blocks along the first direction where $1 \leq p \leq P$, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light;

allowing the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of pixel block groups to sequentially emit light together on a pixel block basis, and allowing, when the light emitting sections configuring the respective pixels in pixel blocks of the $Q_p$ pieces of pixel blocks emit light, the light emitting sections configuring the respective pixels in remaining pixel blocks of the $Q_p$ pieces of pixel blocks not to emit light.

(G01) <Method of Driving Display Unit . . . Embodiment [3]>

A method of driving a display unit, the method including:

preparing the display unit, the display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel blocks along the first direction where P is an integer of two or more;

allowing the light emitting sections from the light emitting sections configuring the respective pixels in a first pixel block of the P pieces of pixel blocks to the light emitting sections configuring the respective pixels in a P-th pixel block of the P pieces of pixel blocks to sequentially emit light together on a pixel block basis, and allowing, when the light emitting sections configuring the respective pixels in pixel blocks of the P pieces of pixel blocks emit light, the light emitting sections configuring the respective pixels in remaining pixel blocks of the P pieces of pixel blocks not to emit light.

(H01) <Method of Driving Display Unit . . . Embodiment [4]>

A method of driving a display unit, the method including:

preparing the display unit, the display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel block groups along the first direction where P is an integer of two or more, a p-th pixel block group of the P pieces of pixel block groups being divided into $Q_p$ pieces of pixel blocks along the first direction where $1 \leq p \leq P$;

allowing the light emitting sections from the light emitting sections configuring the respective pixels in a first pixel block in a first pixel block group of the P pieces of pixel block groups to the light emitting sections configuring the respective pixels in a $Q_P$-th pixel block in a P-th pixel block group of the P pieces of pixel block groups to sequentially emit light together on a pixel block basis, and allowing, when the light emitting sections configuring the respective pixels in pixel blocks of the $Q_p$ pieces of pixel blocks emit light, the light emitting sections configuring the respective pixels in remaining pixel blocks of the $Q_p$ pieces of pixel blocks not to emit light.

(J01) <Control Pulse Generation Device . . . Embodiment [1]>

A control pulse generation device including a control pulse generation circuit configured to generate control pulses having a sawtooth voltage variation to control a drive circuit in a display unit, the display unit including a pixel group having a plurality of pixels that are arranged in a form of a two-dimensional matrix in a first direction and a second direction, each of the pixels including a light emitting section and the drive circuit configured to allow the light emitting section to emit light for a time corresponding to a potential that is based on a signal voltage, the pixel group being divided into P pieces of pixel blocks along the first direction where P is an integer of two or more, wherein the control pulse generation circuit sequentially supplies the control pulses to the drive circuits from the drive circuits configuring the respective pixels in a first pixel block of the P pieces of pixel blocks to the drive circuits configuring the respective pixels in a P-th pixel block of the P pieces of pixel blocks on a pixel block basis, and when the control pulse generation circuit supplies the control pulses to the drive circuits configuring the respective pixels in pixel blocks of the P pieces of pixel blocks, the control pulse generation circuit does not supply the control pulses to the drive circuits configuring the respective pixels in remaining pixel blocks of the P pieces of pixel blocks.

(J02) <Control Pulse Generation Device . . . Embodiment [2]>

A control pulse generation device, the control pulse generation device being configured to generate control pulses having a sawtooth voltage variation to control a drive circuit in a display unit, the display unit including a pixel group having a plurality of pixels that are arranged in a form of a two-dimensional matrix in a first direction and a second direction, each of the pixels including a light emitting section and a drive circuit configured to allow the light emitting section to emit light for a time corresponding to a potential that is based on a signal voltage, the pixel group being divided into P pieces of pixel block groups along the first direction where P is an integer of two or more, the control pulse generation circuit being provided in each of the pixel block groups, a p-th pixel block group of the P pieces of pixel block groups being divided into $Q_p$ pieces of pixel blocks along the first direction where $1 \leq p \leq P$, wherein the control pulse generation circuit in each of the pixel block groups supplies the control pulses sequentially to the drive circuits from the drive circuits configuring the respective pixels in a first pixel block in a first pixel block group of the P pieces of pixel block groups to the drive circuits configuring the respective pixels in a $Q_p$-th pixel block in a P-th pixel block group of the P pieces of pixel block groups on a pixel block basis, and when the control pulse generation circuit supplies the control pulses to the drive circuits configuring the respective pixels in pixel blocks of the $Q_p$ pieces of pixel blocks, the control pulse generation circuit does not supply the control pulses to the drive circuits configuring the respective pixels in remaining pixel blocks of the $Q_p$ pieces of pixel blocks.

(J03) The control pulse generation device according to (J02), wherein the control pulse generation circuit includes a capacitor between a control pulse generation section and an output section, and a DC power source common to the control pulse generation circuits is connected between the capacitor and the output section through a switch.

(J04) The control pulse generation device according to (J02) or (J03), wherein phases of the control pulses generated by P number of control pulse generation circuits are shifted.

(K01) The control pulse generation device according to (J01), wherein when the control pulses are generated in one display frame and when the light emitting sections configuring respective pixels in one of the pixel blocks are not allowed to emit light, a part of the control pulses is masked to allow the control pulses not to be supplied to the drive circuits configuring the respective pixels in the one of the pixel blocks.

(K02) The control pulse generation device according to (K01), wherein each of the light emitting sections emits light multiple times based on the control pulses.

(K03) The control pulse generation device according to (K01) or (K02), wherein time intervals between the plurality of control pulses are fixed.

(K04) The control pulse generation device according to any one of (K01) to (K03), wherein the number of control pulses supplied to the drive circuit in one display frame is smaller than the number of control pulses in the one display frame.

(K05) The control pulse generation device according to any one of (J01) to (K04), wherein any of the pixel blocks constantly emit light in one display frame.

(K06) The control pulse generation device according to any one of (J01) to (K05), wherein a pixel block not emitting light exists in one display frame.

(K07) The control pulse generation device according to any one of (J01) to (K06), wherein an absolute value of a voltage of each of the control pulses is increased and then decreased with lapse of time.

(K08) The control pulse generation device according to (K07), wherein a gamma correction is performed based on the voltage of the control pulses varied with lapse of time.

(K09) The control pulse generation device according to (K08), wherein the voltage of the control pulses is represented by following expressions (1-1) and (1-2):

$$V = V_0[1-(2t/T_0)]^{1/\gamma} \quad (1\text{-}1)$$

$$V = V_0[(2t/T_0)-1]^{1/\gamma} \quad (1\text{-}2)$$

where t is a time, $V_0$ is an absolute value of a crest value, $T_0$ is a time length from start of the voltage variation of one control pulse until end of the voltage variation, and when $0 \leq (t/T_0) \leq 0.5$ is established, the voltage of the control pulses is represented by the expression (1-1), and when $0.5 \leq (t/T_0) \leq 1.0$ is established, the voltage of the control pulses is represented by the expression (1-2).

(K10) The control pulse generation device according to any one of (J01) to (K09), wherein, in each pixel block, the drive circuits of all pixels in one line in the second direction are put into an operation state together.

(K11) The control pulse generation device according to (K10), wherein, in each pixel block, the operation in which the signal write transistors of all the pixels in one line in the second direction are put into an operation state together is sequentially performed on the drive circuits from the drive circuits in all pixels in a first row to the drive circuits in all pixels in a last row in the first direction.

(K12) The control pulse generation device according to (K11), wherein, in each pixel block, the operation in which the drive circuits in all the pixels in one line in the second direction are put into the operation state together is sequentially performed on the drive circuits from the drive circuits in all the pixels in the first row in the first direction to the drive circuits in all the pixels in the last row, and then the control pulses are supplied to the pixel block in which the operation has been performed.

(K13) The control pulse generation device according to any one of (J01) to (K12), wherein the light emitting section is configured of a light emitting diode.

(L01) <Electronic Apparatus . . . Embodiment [1]>

An electronic apparatus including a light emitting element group having a plurality of light emitting elements that are arranged in a form of a two-dimensional matrix in a first direction and a second direction, each of the light emitting elements including a light emitting section and a drive circuit configured to drive the light emitting section, the light emitting element group being divided into P pieces of light emitting element blocks along the first direction, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light, wherein the electronic apparatus is configured to allow the light emitting sections from the light emitting sections configuring the respective light emitting elements in a first light emitting element block of the P pieces of light emitting element blocks to the light emitting sections configuring the respective light emitting elements in a P-th light emitting element block of the P pieces of light emitting element blocks to sequentially emit light together on a light emitting element block basis, and when the light emitting sections configuring the respective light emitting elements in light emitting element blocks of the P pieces of light emitting element blocks emit light, configured to allow the light emitting sections configuring the respective light emitting elements in remaining light emitting element blocks of the P pieces of light emitting element blocks not to emit light.

(L02) <Electronic Apparatus . . . Embodiment [2]>

An electronic apparatus including a light emitting element group having a plurality of light emitting elements that are arranged in a form of a two-dimensional matrix in a first direction and a second direction, each of the light emitting elements including a light emitting section and a drive circuit configured to drive the light emitting section, the light emitting element group being divided into P pieces of light emitting element block groups along the first direction where P is an integer of two or more, a p-th light emitting element block group of the P pieces of light emitting element block groups being divided into $Q_p$ pieces of light emitting element blocks along the first direction where $1 \leq p \leq P$, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light, wherein the electronic apparatus is configured to allow the light emitting sections from the light emitting sections configuring the respective light emitting elements in a first light emitting element block in a first light emitting element block group of the P pieces of light emitting element block groups to the light emitting sections configuring the respective light emitting elements in a $Q_P$-th light emitting element block in a P-th light emitting element block group of the P pieces of light emitting element block groups to sequentially emit light together on a light emitting element block basis, and when the light emitting sections configuring the respective light emitting elements in light emitting element blocks of the $Q_p$ pieces of light emitting element blocks emit light, configured to allow the light emitting sections configuring the respective light emitting elements in remaining light emitting element blocks of the $Q_p$ pieces of light emitting element blocks not to emit light.

(L03) The electronic apparatus according to (L01), further including a control pulse generation circuit configured to generate the control pulses having a sawtooth voltage variation.

(L04) The electronic apparatus according to (L02), wherein each of the light emitting element block groups includes a control pulse generation circuit configured to generate the control pulses having a sawtooth voltage variation.

(M01) The electronic apparatus according to (L01), wherein each of the light emitting sections emits light multiple times based on the control pulses.

(M02) The electronic apparatus according to (M01), wherein time intervals between the plurality of control pulses are fixed.

(M03) The electronic apparatus according to any one of (L01) to (M02), wherein the number of control pulses supplied to the drive circuit in one display frame is smaller than the number of control pulses in the one display frame.

(M04) The electronic apparatus according to any one of (L01) to (M03), wherein any of the light emitting element blocks constantly emit light in one display frame.

(M05) The electronic apparatus according to any one of (L01) to (M03), wherein a light emitting element block not emitting light exists in one display frame.

(M06) The electronic apparatus according to any one of (L01) to (M05), wherein an absolute value of a voltage of each of the control pulses is increased and then decreased with lapse of time.

(M07) The electronic apparatus according to (M06), wherein a gamma correction is performed based on the voltage of the control pulses varied with lapse of time.

(M08) The electronic apparatus according to (M07), wherein the voltage of the control pulses is represented by following expressions (1-1) and (1-2):

$$V=V_0[1-(2t/T_0)]^{1/\gamma} \quad (1\text{-}1)$$

$$V=V_0[(2t/T_0)-1]^{1/\gamma} \quad (1\text{-}2)$$

where t is a time, $V_0$ is an absolute value of a crest value, $T_0$ is a time length from start of the voltage variation of one control pulse until end of the voltage variation, and when $0 \leq (t/T_0) \leq 0.5$ is established, the voltage of the control pulse is represented by the expression (1-1), and when $0.5 \leq (t/T_0) \leq 1.0$ is established, the voltage of the control pulse is represented by the expression (1-2).

(M09) The electronic apparatus according to any one of (L01) to (M08), wherein operation and non-operation of the comparator device is controlled by the control pulse.

(M10) The electronic apparatus according to any one of (L01) to (M08), wherein the comparator device includes a signal write transistor configured to receive the signal voltage, and a capacitor connected to the signal write transistor and configured to retain a potential based on the signal voltage in response to operation of the signal write transistor.

(M11) The electronic apparatus according to any one of (L01) to (M08), wherein the comparator device includes: a signal write transistor that is configured to receive the signal voltage; a capacitor that is connected to the signal write transistor and is configured to retain a potential based on the signal voltage in response to operation of the signal write transistor; and a comparator circuit that includes a first input section connected to a control pulse line, a second input section connected to the capacitor, and an output section, and the light emitting section drive transistor is connected to the output section of the comparator device, is operated with use of an output of the predetermined voltage from the comparator circuit based on a comparison result between the potential based on the signal voltage retained by the capacitor and a sawtooth voltage of the control pulses, and thus supplies a current to the light emitting section through a current supply line, to allow the light emitting section to emit light.

(M12) The electronic apparatus according to (M10) or (M11), wherein operation and non-operation of the comparator circuit is controlled by the control pulses.

(M13) The electronic apparatus according to any one of (L01) to (M08), wherein the comparator device includes a comparison section that includes:

a signal write transistor configured to receive the signal voltage;

a control pulse transistor configured to receive the control pulses and to perform ON-OFF operation based on a signal having a reversed phase from a phase of the signal write transistor;

an inverter circuit; and a capacitor that has a first end connected to the signal write transistor and the control pulse transistor, and a second end connected to the inverter circuit, and is configured to retain a potential based on the signal voltage in response to operation of the signal write transistor.

(M14) The electronic apparatus according to (M13), wherein the comparator device further includes a control section that is configured to control operation and non-operation of the comparison section with use of the control pulses.

(M15) The electronic apparatus according to (M14), wherein the control section includes a switch circuit that is connected in series to the inverter circuit and is configured to perform ON-OFF operation based on the sawtooth voltage of the control pulse.

(M16) The electronic apparatus according to (M15), wherein the control section includes a second switch circuit that is connected in parallel to the switch circuit, and is turned on during operation period of the comparator device.

(M17) The electronic apparatus according to any one of (M13) to (M16), wherein the control section includes a resistance element that is connected in series to the inverter circuit.

(M18) The electronic apparatus according to any one of (M13) to (M17), wherein the inverter circuit have a configuration in which inverters are connected in two or more-stage cascade.

(M19) The electronic apparatus according to any one of (L01) to (M08), wherein the comparator device includes a comparison section that includes:

a signal write transistor configured to receive a signal voltage;

a capacitor that is connected to the signal write transistor and is configured to retain a potential based on the signal voltage in response to operation of the signal write transistor;

a differential circuit configured to receive, as two inputs, the signal voltage from the signal write transistor and the control pulses; and a constant current source configured to supply a constant current to the differential circuit.

(M20) The electronic apparatus according to (M19), wherein the comparator device further includes a control section that is configured to control operation and non-operation of the comparison section with use of the control pulses.

(M21) The electronic apparatus according to (M20), wherein the control section includes a switch circuit that is connected in series to the constant current source, and is configured to perform ON-OFF operation based on the sawtooth voltage of the control pulses.

(M22) The electronic apparatus according to (M21), wherein the control section includes a second switch circuit that is connected in series to the constant voltage circuit, and is configured to perform ON-OFF operation based on the sawtooth voltage of the control pulses, the constant voltage circuit being configured to apply a constant voltage to a gate electrode of the transistor configuring the constant current source.

(M23) The electronic apparatus according to any one of (M10) to (M22), wherein, in each light emitting element block, the signal write transistors of all light emitting elements in one line in the second direction are put into an operation state together.

(M24) The electronic apparatus according to (M23), wherein, in each light emitting element block, the operation in which the signal write transistors of all the light emitting elements in one line in the second direction are put into an operation state together is sequentially performed on the signal drive transistors from the signal write transistors in all light emitting elements in a first row to the signal write transistors in all light emitting elements in a last row in the first direction.

(M25) The electronic apparatus according to (M24), wherein, in each light emitting element block, the operation in which the signal write transistors in all the light emitting elements in one line in the second direction are put into the operation state together is sequentially performed on the signal write transistors from the signal write transistors in all the light emitting elements in the first row in the first direction to the signal write transistors in all the light emitting elements in the last row, and then the control pulses are supplied to the light emitting element block in which the operation has been performed.

(M26) The electronic apparatus according to any one of (L01) to (M25), wherein the light emitting section is configured of a light emitting diode.

(M27) The electronic apparatus according to any one of (L01) to (M26), wherein the light emitting elements in one line in the second direction are connected to a control pulse line, and voltage follower circuits (buffer circuits) are disposed with predetermined intervals on the control pulse line.

(N01) <Electronic Apparatus . . . Embodiment [3]>

An electronic apparatus including a light emitting element group having a plurality of light emitting elements that are arranged in a form of a two-dimensional matrix in a first direction and a second direction, each of the light emitting elements including a light emitting section and a drive circuit configured to allow the light emitting section to emit light for a time corresponding to a potential that is based on a signal voltage, the light emitting element group being divided into P pieces of light emitting element blocks along the first direction where P is an integer of two or more, wherein the electronic apparatus is configured to allow the light emitting sections from the light emitting sections configuring the respective light emitting elements in a first light emitting element block of the P pieces of light emitting element blocks to the light emitting sections configuring the respective light emitting elements in P-th light emitting element block of the P pieces of light emitting element blocks to sequentially emit light together on a light emitting element block basis, and when the light emitting sections configuring the respective light emitting elements in light emitting element blocks of the P pieces of light emitting element blocks emit light, configured to allow the light emitting sections configuring the respective light emitting elements in remaining light emitting element blocks of the P pieces of light emitting element blocks not to emit light.

(N02) <Electronic Apparatus . . . Embodiment [4]>

An electronic apparatus including a light emitting element group having a plurality of light emitting elements that are arranged in a form of a two-dimensional matrix in a first direction and a second direction, each of the light emitting elements including a light emitting section and a drive circuit configured to allow the light emitting section to emit light for a time corresponding to a potential that is based on a signal voltage, the light emitting element group being divided into P pieces of light emitting element block groups along the first direction where P is an integer of two or more, a p-th light emitting element block group of the P pieces of light emitting element block groups being divided into $Q_p$ pieces of light emitting element blocks along the first direction where $1 \leq p \leq P$, wherein the electronic apparatus is configured to allow the light emitting sections from the light emitting sections configuring the respective light emitting elements in a first light emitting element block in a first light emitting element block group of the P pieces of light emitting element block groups to the light emitting sections configuring the respective light emitting elements in a $Q_P$-th light emitting element block in a P-th light emitting element block group of the P pieces of the light emitting element block groups to sequentially emit light together on a light emitting element block basis, and when the light emitting sections configuring the respective light emitting elements in light emitting element blocks of the $Q_p$ pieces of light emitting element blocks emit light, configured to allow the light emitting sections configuring the respective light emitting elements in remaining light emitting element blocks of the $Q_p$ pieces of light emitting element blocks not to emit light.

(N03) The electronic apparatus according to (N01) or (N02), wherein the light emitting section emits light multiple times based on the control pulses and the potential that is based on the signal voltage, the control pulses having a sawtooth voltage variation and being supplied to the drive circuit.

(N04) The electronic apparatus according to (N01) or (N03), further including a control pulse generation circuit configured to generate control pulses having a sawtooth voltage variation.

(N05) The electronic apparatus according to (N02) or (N03), wherein each of the light emitting element block groups includes a control pulse generation circuit configured to generate control pulses having a sawtooth voltage variation.

(N06) The electronic apparatus according to (N04) or (N05), wherein the control pulses have the same crest value of the voltage variation with one another.

(N07) The electronic apparatus according to any one of (N01) to (N06), wherein an absolute value of a voltage of each of the control pulses is increased and then decreased with lapse of time.

(N08) The electronic apparatus according to (N07), wherein a gamma correction is performed based on the voltage of the control pulses varied with lapse of time.

(N09) The electronic apparatus according to (N08), wherein the voltage of the control pulses is represented by following expressions (1-1) and (1-2):

$$V=V_0[1-(2t/T_0)]^{1/\gamma} \quad (1\text{-}1)$$

$$V=V_0[(2t/T_0)-1]^{1/\gamma} \quad (1\text{-}2)$$

where t is a time, $V_0$ is an absolute value of a crest value, $T_0$ is a time length from start of the voltage variation of one control pulse until end of the voltage variation, and when $0 \leq (t/T_0) \leq 0.5$ is established, the voltage of the control pulses is represented by the expression (1-1), and when $0.5 \leq (t/T_0) \leq 1.0$ is established, the voltage of the control pulses is represented by the expression (1-2).

(N10) The electronic apparatus according to (N01), wherein the light emitting section emits light multiple times based on the control pulses and the potential that is based on the signal voltage, the control pulses having a sawtooth voltage variation and being supplied to the drive circuit, the control pulses include two or more kinds of control pulses having different crest values of the voltage variation from one another, and the electronic apparatus includes the same number of control pulse generation circuits as the control pulses.

(N11) The electronic apparatus according to (N02), wherein the light emitting section emits light multiple times based on the control pulses and the potential that is based on the signal voltage, the control pulses having a sawtooth voltage variation and being supplied to the drive circuit, the control pulses include two or more kinds of control pulses having different crest values of the voltage variation from one another, and each of the light emitting element block groups includes the same number of control pulse generation circuits as the control pulses.

(N12) The electronic apparatus according to (N10) or (N11), wherein the two or more kinds of control pulses have different voltage variation patterns from one another.

(N13) The electronic apparatus according to any one of (N10) to (N12), wherein the number of emission times of the light emitting section is dependent on the potential based on the signal voltage.

(N14) The electronic apparatus according to (N13), wherein the number of emission times of the light emitting section is varied between a case where the potential based on the predetermined signal voltage is lower than a predetermined potential and a case where the potential is equal to or higher than the predetermined potential.

(N15) The electronic apparatus according to any one of (N10) to (N14), wherein when a control pulse having a large absolute value of the crest value of the voltage variation is defined as a first control pulse and a control pulse having a small absolute value of the crest value of the voltage variation is defined as a second control pulse, a waveform of the first control pulse changes discontinuously at a voltage of the first control pulse equal to a predetermined voltage $V_{pd}$ of the second control pulse.

(N16) The electronic apparatus according to any one of (N10) to (N14), wherein when a control pulse having a large absolute value of the crest value of the voltage variation is defined as a first control pulse and a control pulse having a small absolute value of the crest value of the voltage variation is defined as a second control pulse, a voltage of the first control pulse exceeding an absolute value of a predetermined voltage $V_{pd}$ of the second control pulse and a voltage of a synthesized pulse of the first control pulse and the second control pulse equal to or lower than the absolute value of the predetermined voltage $V_{pd}$ are represented by following expressions (1-1) and (1-2):

$$V=V_0[1-(2t/T_0)]^{1/\gamma} \quad (1\text{-}1)$$

$$V=V_0[(2t/T_0)-1]^{1/\gamma} \quad (1\text{-}2)$$

where t is a time, $V_0$ is the absolute value of the crest value, $T_0$ is a time length from start of the voltage variation of one control pulse until end of the voltage variation, and when $0 \leq (t/T_0) \leq 0.5$ is established, the voltage of the control pulses is represented by the expression (1-1), and when $0.5 \leq (t/T_0) \leq 1.0$ is established, the voltage of the control pulses is represented by the expression (1-2).

(N17) The electronic apparatus according to (N16), wherein the voltage of the first control pulse exceeding the absolute value of the predetermined voltage $V_{pd}$ is varied in a first variation pattern, the voltage of the first control pulse equal to or lower than the absolute value of the predetermined voltage $V_{pd}$ is varied in a second variation pattern, and the voltage of the second control pulse equal to or lower than the absolute value of the predetermined voltage $V_{pd}$ is varied in a third variation pattern.

(N18) The electronic apparatus according to (N17), wherein a value of the second variation pattern is equal to a value of the third variation pattern.

(N19) The electronic apparatus according to (N17), wherein the second variation pattern is different from the third variation pattern.

(N20) The electronic apparatus according to any one of (N10) to (N19), wherein when a control pulse having a large absolute value of the crest value of the voltage variation is defined as a first control pulse and a control pulse having a small absolute value of the crest value of the voltage variation is defined as a second control pulse, a waveform shape of an edge of the first control pulse is a rectangular shape or a rounded shape.

(N21) The electronic apparatus according to any one of (N10) to (N20), wherein when a control pulse having a large absolute value of the crest value of the voltage variation is defined as a first control pulse and a control pulse having a small absolute value of the crest value of the voltage variation is defined as a second control pulse, following expression is satisfied:

$$20 \leq T_1/T_2 \leq 100$$

where $T_2$ is a time width of the second control pulse at the predetermined voltage $V_{pd}$ of the second control pulse, and $T_1$ is a time width of the first control pulse at a voltage of the first control pulse equal to the predetermined voltage $V_{pd}$ of the second control pulse.

(N22) The electronic apparatus according to (N21), wherein the value of $T_1$ is 5 microseconds to 10 microseconds both inclusive.

(N23) The electronic apparatus according to any one of (N10) to (N22), wherein the control pulses are supplied to the drive circuit in ascending order of the absolute value of the crest value of the voltage variation.

(P01) The electronic apparatus according to any one of (N01) to (N23), wherein time intervals between the plurality of control pulses are fixed.

(P02) The electronic apparatus according to any one of (N01) to (P01), wherein the number of control pulses supplied to the drive circuit in one display frame is smaller than the number of control pulses in the one display frame.

(P03) The electronic apparatus according to any one of (N01) to (P02), wherein any of the light emitting element blocks constantly emit light in one display frame.

(P04) The electronic apparatus according to any one of (N01) to (P03), wherein a light emitting element block not emitting light exists in one display frame.

(P05) The electronic apparatus according to any one of (N01) to (P04), wherein the drive circuit includes a comparator device, the control pulses and the signal voltage are input to the comparator device, and the light emitting section is operated by an output of the comparator device based on a comparison result between the sawtooth voltage of the control pulses and the potential based on the signal voltage.

(P06) The electronic apparatus according to (P05), wherein operation and non-operation of the comparator device is controlled by the control pulses.

(P07) The electronic apparatus according to any one of (N01) to (P06), wherein the light emitting section is configured of a light emitting diode.

(Q01) <Method of Driving Electronic Apparatus . . . Embodiment [1]>

A method of driving an electronic apparatus, the method including:

preparing the electronic apparatus, the electronic apparatus including a light emitting element group having a plurality of light emitting elements that are arranged in a form of a two-dimensional matrix in a first direction and a second direction, each of the light emitting elements including a light emitting section and a drive circuit configured to drive the light emitting section, the light emitting element group being divided into P pieces of light emitting element blocks along the first direction where P is an integer of two or more, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light;

allowing the light emitting sections from the light emitting sections configuring the respective light emitting elements in a first light emitting element block of the P pieces of light emitting element blocks to the light emitting sections configuring the respective light emitting elements in a P-th light emitting element block of the P pieces of light emitting element blocks to sequentially emit light together on a light emitting element block basis, and allowing, when the light emitting sections configuring the respective light emitting elements in light emitting element blocks of the P pieces of light emitting element blocks emit light, the light emitting sections configuring the respective light emitting elements in remaining light emitting element blocks of the P pieces of light emitting element blocks not to emit light.

(R01) <Method of Driving Electronic Apparatus . . . Embodiment [2]>

A method of driving an electronic apparatus, the method including:

preparing the electronic apparatus, the electronic apparatus including a light emitting element group having a plurality of light emitting elements that are arranged in a form of a two-dimensional matrix in a first direction and a second direction, each of the light emitting elements including a light emitting section and a drive circuit configured to drive the light emitting section, the light emitting element group being divided into P pieces of light emitting element block groups along the first direction where P is an integer of two or more, a p-th light emitting element block group of the P pieces of light emitting element block groups being divided into $Q_p$ pieces of light emitting element blocks along the first direction where $1 \leq p \leq P$, each of the drive circuits including a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light;

allowing the light emitting sections from the light emitting sections configuring the respective light emitting elements in a first light emitting element block in a first light emitting element block group of the P pieces of light emitting element block groups to the light emitting sections configuring the respective light emitting elements in a $Q_P$-th light emitting element block in a P-th light emitting element block group of the P pieces of light emitting element block groups to sequentially emit light together on a light emitting element block basis, and allowing, when the light emitting sections configuring the respective light emitting elements in light emitting element blocks of the $Q_p$ pieces of light emitting element blocks emit light, the light emitting sections configuring the respective light emitting elements in remaining light emitting element blocks of the $Q_p$ pieces of light emitting element blocks not to emit light.

(S01) <Method of Driving Electronic Apparatus . . . Embodiment [3]>

A method of driving an electronic apparatus, the method including:

preparing the electronic apparatus, the electronic apparatus including a light emitting element group having a plurality of light emitting elements that are arranged in a form of a two-dimensional matrix in a first direction and a second direction, each of the light emitting elements including a light emitting section and a drive circuit configured to allow the light emitting section to emit light for a time corresponding to a potential that is based on a signal voltage, the light emitting element group being divided into P pieces of light emitting element blocks along the first direction where P is an integer of two or more;

allowing the light emitting sections from the light emitting sections configuring the respective light emitting elements in a first light emitting element block of the P pieces of light emitting element blocks to the light emitting sections configuring the respective light emitting elements in a P-th light emitting element block of the P pieces of light emitting element blocks to sequentially emit light together on a light emitting element block basis, and allowing, when the light emitting sections configuring the respective light emitting elements in light emitting element blocks of the P pieces of light emitting element blocks emit light, the light emitting sections configuring the respective light emitting elements in remaining light emitting element blocks of the P pieces of light emitting element blocks not to emit light.

(T01) <Method of Driving Electronic Apparatus . . . Embodiment [4]>

A method of driving an electronic apparatus, the method including:

preparing the electronic apparatus, the electronic apparatus including a light emitting element group having a plurality of light emitting elements that are arranged in a form of a two-dimensional matrix in a first direction and a second direction, each of the light emitting elements including a light emitting section and a drive circuit configured to allow the light emitting section to emit light for a time corresponding to a potential that is based on a signal voltage, the light emitting element group being divided into P pieces of light emitting element block groups along the first direction where P is an integer of two or more, a p-th light emitting element block group of the P pieces of light emitting element block groups being divided into $Q_p$ pieces of light emitting element blocks along the first direction where $1 \leq p \leq P$;

allowing the light emitting sections from the light emitting sections configuring the respective light emitting elements in a first light emitting element block in a first light emitting element block group of the P pieces of light emitting element block groups to the light emitting sections configuring the respective light emitting elements in a $Q_P$-th light emitting element block in a P-th light emitting element block group of the P pieces of light emitting element block groups to sequentially emit light together on a light emitting element block basis, and allowing, when the light emitting sections configuring the respective light emitting elements in light emitting element blocks of the $Q_p$ pieces of light emitting element blocks emit light, the light emitting sections configuring the respective light emitting elements in remaining light emitting element blocks of the $Q_p$ pieces of light emitting element blocks not to emit light.

(U01) <Control Pulse Generation Device . . . Embodiment [1]>

A control pulse generation device including a control pulse generation circuit configured to generate control pulses having a sawtooth voltage variation to control a drive circuit in an electronic apparatus, the electronic apparatus including a light emitting element group having a plurality of light emitting elements that are arranged in a form of a two-dimensional matrix in a first direction and a second direction, each of the light emitting elements including a light emitting section and the drive circuit configured to allow the light emitting section to emit light for a time corresponding to a potential that is based on a signal voltage, the light emitting element group being divided into P pieces of light emitting element blocks along the first direction where P is an integer of two or more, wherein the control pulse generation circuit sequentially supplies the control pulses to the drive circuits from the drive circuits configuring the respective light emitting elements in a first light emitting element block of the P pieces of light emitting element blocks to the drive circuits configuring the respective light emitting elements in a P-th light emitting element block of the P pieces of light emitting element blocks on a light emitting element block basis, and when the control pulse generation circuit supplies the control pulses to the drive circuits configuring the respective light emitting elements in light emitting element blocks of the P pieces of light emitting element blocks, the control pulse generation circuit does not supply the control pulses to the drive circuits configuring the respective light emitting elements in remaining light emitting element blocks of the P pieces of light emitting element blocks.

(U02) <Control Pulse Generation Device . . . Embodiment [2]>

A control pulse generation device, the control pulse generation device being configured to generate control pulses having a sawtooth voltage variation to control a drive circuit in an electronic apparatus, the electronic apparatus including a light emitting element group having a plurality of light emitting elements that are arranged in a form of a two-dimensional matrix in a first direction and a second direction, each of the light emitting elements including a light emitting section and a drive circuit configured to allow the light emitting section to emit light for a time corresponding to a potential that is based on a signal voltage, the light emitting element group being divided into P pieces of light emitting element block groups along the first direction where P is an integer of two or more, the control pulse generation circuit being provided in each of the light emitting element block groups, a p-th light emitting element block group of the P pieces of light emitting element block groups being divided into $Q_p$ pieces of light emitting element blocks along the first direction where $1 \leq p \leq P$, wherein the control pulse generation circuit in each of the light emitting element block groups supplies the control pulses sequentially to the drive circuits from the drive circuits configuring the respective light emitting elements in a first light emitting element block in a first light emitting element block group of the P pieces of light emitting element block groups to the drive circuits configuring the respective light emitting elements in a $Q_P$-th light emitting element block in a P-th light emitting element block group of the P pieces of light emitting element block groups on a light emitting element block basis, and when the control pulse generation circuit supplies the control pulses to the drive circuits configuring the respective light emitting elements in light emitting element blocks of the $Q_p$ pieces of light emitting element blocks, the control pulse generation circuit does not supply the control pulses to the drive circuits configuring the respective light emitting elements in remaining light emitting element blocks of the $Q_p$ pieces of light emitting element blocks.

(U03) The control pulse generation device according to (U02), wherein the control pulse generation circuit includes a capacitor between a control pulse generation section and an output section, and a DC power source common to the control pulse generation circuits is connected between the capacitor and the output section through a switch.

(U04) The control pulse generation device according to (U02) or (U03), wherein phases of the control pulses generated by P number of control pulse generation circuits are shifted.

(V01) The control pulse generation device according to (U01), wherein when the control pulses are generated in one display frame and when the light emitting sections configuring respective light emitting elements in one of the light emitting element blocks are not allowed to emit light, a part of the control pulses is masked to allow the control pulses not to be supplied to the drive circuits configuring the respective light emitting elements in the one of the light emitting element blocks.

(V02) The control pulse generation device according to (V01), wherein each of the light emitting sections emits light multiple times based on the control pulses.

(V03) The control pulse generation device according to (V01) or (V02), wherein time intervals between the plurality of control pulses are fixed.

(V04) The control pulse generation device according to any one of (V01) to (V03), wherein the number of control pulses supplied to the drive circuit in one display frame is smaller than the number of control pulses in the one display frame.

(V05) The control pulse generation device according to any one of (U01) to (V04), wherein any of the light emitting element blocks constantly emit light in one display frame.

(V06) The control pulse generation device according to any one of (U01) to (V05), wherein a light emitting element block not emitting light exists in one display frame.

(V07) The control pulse generation device according to any one of (U01) to (V06), wherein an absolute value of a voltage of each of the control pulses is increased and then decreased with lapse of time.

(V08) The control pulse generation device according to (V07), wherein a gamma correction is performed based on the voltage of the control pulses varied with lapse of time.

(V09) The control pulse generation device according to (V08), wherein the voltage of the control pulses is represented by following expressions (1-1) and (1-2):

$$V=V_0[1-(2t/T_0)]^{1/\gamma} \quad (1\text{-}1)$$

$$V=V_0[(2t/T_0)-1]^{1/\gamma} \quad (1\text{-}2)$$

where t is a time, $V_0$ is an absolute value of a crest value, $T_0$ is a time length from start of the voltage variation of one control pulse until end of the voltage variation, and when $0 \leq (t/T_0) \leq 0.5$ is established, the voltage of the control pulses is represented by the expression (1-1), and when $0.5 \leq (t/T_0) \leq 1.0$ is established, the voltage of the control pulses is represented by the expression (1-2).

(V10) The control pulse generation device according to any one of (U01) to (V09), wherein, in each light emitting element block, the drive circuits of all light emitting elements in one line in the second direction are put into an operation state together.

(V11) The control pulse generation device according to (V10), wherein, in each light emitting element block, the operation in which the signal write transistors of all the light emitting elements in one line in the second direction are put into an operation state together is sequentially performed on the drive circuits from the drive circuits in all light emitting elements in a first row to the drive circuits in all light emitting elements in a last row in the first direction.

(V12) The control pulse generation device according to (V11), wherein, in each light emitting element block, the operation in which the drive circuits in all the light emitting elements in one line in the second direction are put into the operation state together is sequentially performed on the drive circuits from the drive circuits in all the light emitting elements in the first row in the first direction to the drive circuits in all the light emitting elements in the last row, and then the control pulses are supplied to the light emitting element block in which the operation has been performed.

(V13) The control pulse generation device according to any one of (U01) to (V12), wherein the light emitting section is configured of a light emitting diode.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit, comprising: a plurality of pixel blocks, each pixel block arranged in a form of a two-dimensional matrix of pixels and configured to include at least two pixels in each row, each of the pixels in the pixel block including a light emitting section and a drive circuit configured to drive the light emitting section; a control pulse generation circuit configured to generate and transmit control pulses having a sawtooth voltage variation via at least one control pulse line to inputs of the drive circuits of the pixels; and buffer circuits coupled to the at least one control pulse line, wherein each row of the pixels includes at least one of the buffer circuits arranged within that row, wherein each of the buffer circuits is configured to output buffered control pulses having the sawtooth voltage variation to the inputs of a plurality of the drive circuits in that row, and wherein the control pulse generation circuit is configured to generate a first number N of control pulses during a display frame and to supply a second number N/3 of the control pulses, less than the first number of the control pulses, to respective ones of the pixel blocks during different time periods of the display frame, such that each pixel block is activated two or more times during the display frame.

2. The display unit according to claim 1, wherein, each of the light emitting sections emits light multiple times based on the control pulses.

3. The display unit according to claim 1, wherein an absolute value of a voltage of each of the control pulses is increased and then decreased with lapse of time.

4. The display unit according to claim 1, wherein;

each of the drive circuits includes a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light; and the comparator device includes a signal write transistor configured to receive the signal voltage, and a capacitor connected to the signal write transistor and configured to retain the potential based on the signal voltage in response to operation of the signal write transistor.

5. A method of driving a display unit, the method comprising: providing the display unit, the display unit including a plurality of pixel blocks, each pixel block arranged in a form of a two-dimensional matrix of pixels and configured to include at least two pixels in each row, each of the pixels in the pixel block including a light emitting section and a drive circuit configured to drive the light emitting section; and generating and transmitting control pulses having a sawtooth voltage variation via at least one control pulse line to inputs of the drive circuits of the pixels; wherein the display unit includes buffer circuits coupled to the at least one control pulse line, wherein each row of the pixels includes at least one of the buffer circuits arranged within that row, wherein each of the buffer circuits is configured to output buffered control pulses having the sawtooth voltage variation to the inputs of a plurality of the drive circuits in that row, and wherein generating and transmitting control pulses includes generating a first number N of control pulses during a display frame and supplying a second number N/3 of the control pulses, less than the first number of the control pulses, to respective ones of the pixel blocks during different time periods of the display frame, such that each pixel block is activated two or more times during the display frame.

6. The display unit according to claim 1, wherein the drive circuit includes a comparator device that compares control pulses with a potential that is based on a signal voltage and output a predetermined voltage based on a comparison result, and a light emitting section drive transistor that supplies a current to the light emitting section according to the predetermined voltage from the comparator device to allow the light emitting section to emit light.

7. The method according to claim 5, wherein, each of the light emitting sections emits light multiple times based on the control pulses.

8. The method according to claim 5, wherein an absolute value of a voltage of each of the control pulses is increased and then decreased with lapse of time.

9. The method according to claim 5, wherein;

each of the drive circuits includes a comparator device and a light emitting section drive transistor, the comparator device being configured to compare control pulses with a potential that is based on a signal voltage and output a predetermined voltage based on a comparison result, and the light emitting section drive transistor being configured to supply a current to the light emitting section according to the predetermined voltage from the comparator device to allow the light emitting section to emit light; and the method further comprises:

receiving the signal voltage with a signal write transistor, and with a capacitor connected to the signal write transistor, retaining the potential based on the signal voltage in response to operation of the signal write transistor.

10. The method unit according to claim 5, further comprising:

comparing control pulses with a potential that is based on a signal voltage and outputting a predetermined voltage based on a comparison result; and supplying a current to the light emitting section according to the predetermined voltage from the comparator device to allow the light emitting section to emit light.

* * * * *